US007094028B2

(12) United States Patent
Chang et al.

(10) Patent No.: US 7,094,028 B2
(45) Date of Patent: Aug. 22, 2006

(54) OUTLET AIRFLOW DIRECTION CONTROL DEVICE

(75) Inventors: Bor-Haw Chang, Taipei Hsien (TW); Wen-Hao Liu, Taipei Hsien (TW)

(73) Assignee: Asia Vital Components Co., Ltd., (TW)

( * ) Notice: Subject to any disclaimer, the term of this patent is extended or adjusted under 35 U.S.C. 154(b) by 340 days.

(21) Appl. No.: 10/629,687

(22) Filed: Jul. 30, 2003

(65) Prior Publication Data

US 2005/0025619 A1 Feb. 3, 2005

(51) Int. Cl.
*F04D 29/54* (2006.01)

(52) U.S. Cl. ..... 415/211.2

(58) Field of Classification Search ..... 415/211.2, 415/220, 221
See application file for complete search history.

(56) References Cited

U.S. PATENT DOCUMENTS 1,971,386 A * 8/1934 Schmidt ..... 415/201
6,142,733 A * 11/2000 Alizadeh et al. ..... 415/208.2

* cited by examiner

*Primary Examiner*—Ninh H. Nguyen
(74) *Attorney, Agent, or Firm*—Bacon & Thomas PLLC

(57) ABSTRACT

An outlet airflow direction control device includes a fan and a frame. The frame has an inlet and an outlet via which an amount of fluid flows into and out of the frame, and is internally provided at the outlet with a hub seat for supporting the fan thereon. A plurality of fluid control elements are radially provided between the frame and the hub seat to connect them to each other. Each of the fluid control elements is connected at an outer end, which forms a directional-guide section, to the frame, and at an inner end, which forms a connecting section, to the hub seat. The directional-guide section has an area larger than that of the connecting section, so that the fluid control elements are adapted to control a flow direction of the fluid flown out of the outlet of the frame.

3 Claims, 45 Drawing Sheets

OUTLET AIRFLOW DIRECTION CONTROL DEVICE

FIELD OF THE INVENTION

The present invention relates to an outlet airflow direction control device that includes a frame and a fan mounted to a hub seat provided in the frame, and a plurality of fluid control elements radially arranged between the frame and the hub seat to connect them to each other.

BACKGROUND OF THE INVENTION

Most currently developed electronic products are miniaturized while they have powerful functions and constantly increased working frequency and operating speed. The higher the working frequency is, the more heat is produced during the operation of the electronic products. The electronic products tend to become unstable when they operate under a high-temperature state. Therefore, it has become an important issue to effectively and quickly remove waste heat from the electronic products to reduce an internal temperature thereof. The use of a fan is one of many economical ways to effectively remove heat from the operating electronic products. When a motor of the fan is actuated to rotate blades of the fan, electric energy is converted into mechanical energy, which is transferred via the blades to cause flowing of a fluid and increasing a coefficient of convection in a limited space, so that flowing of fluid produced by changes in pressure and increase of speed is used to carry away extra heat produced by the electronic products during operation thereof and achieve the purpose of dissipating heat.

Generally, when an amount of fluid is driven by the rotating blades of the fan to flow through an outlet of the fan, the fluid only diffuses into outer areas surrounding the fan. Since the fan is not able to control the flow direction of the fluid, a relatively large dead-air zone is formed behind a hub of the fan to largely reduce the radiation effect that may be achieved by the fan. When the conventional fan is mounted at a location having poor air ventilation and high impedance to dissipate heat produced by electronic elements, the dead-air zone behind the hub of the fan actually largely reduces the radiation effect that may be achieved by the fan, resulting in damaged electronic elements due to high temperature produced during working of the electronic elements.

Taiwanese Invention Patent Application No. 090118816 entitled "Sectional Fan and a Fan Frame Thereof" discloses a sectional fan that includes a fan and a fan frame. The fan frame further includes a first frame and a first flow-guiding element provided in the first frame. The first flow-guiding element includes a plurality of radially extended stationary blades. When the fan is rotated, the stationary blades are adapted to enhance the volume and pressure of airflow produced by the fan.

With the above-mentioned sectional fan, it is possible to produce an increased amount of fluid flown through the fan, however, it is unable to control the direction in which the fluid flown out of the rotating fan, just as in most cases of the conventional fans. Thus, there is still a relatively large dead-air zone behind the hub of the sectional fan to adversely affect the effective radiating of heat produced by the electronic products.

It is therefore tried by the inventor to develop an outlet airflow direction control device to eliminate drawbacks existed in the conventional radiating fans.

SUMMARY OF THE INVENTION

A primary object of the present invention is to provide an outlet airflow direction control device that uses fluid control elements to produce a relative large radial pressure against the fluid flown through the device, so as to affect the flow direction of the fluid at the outlet of the device.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
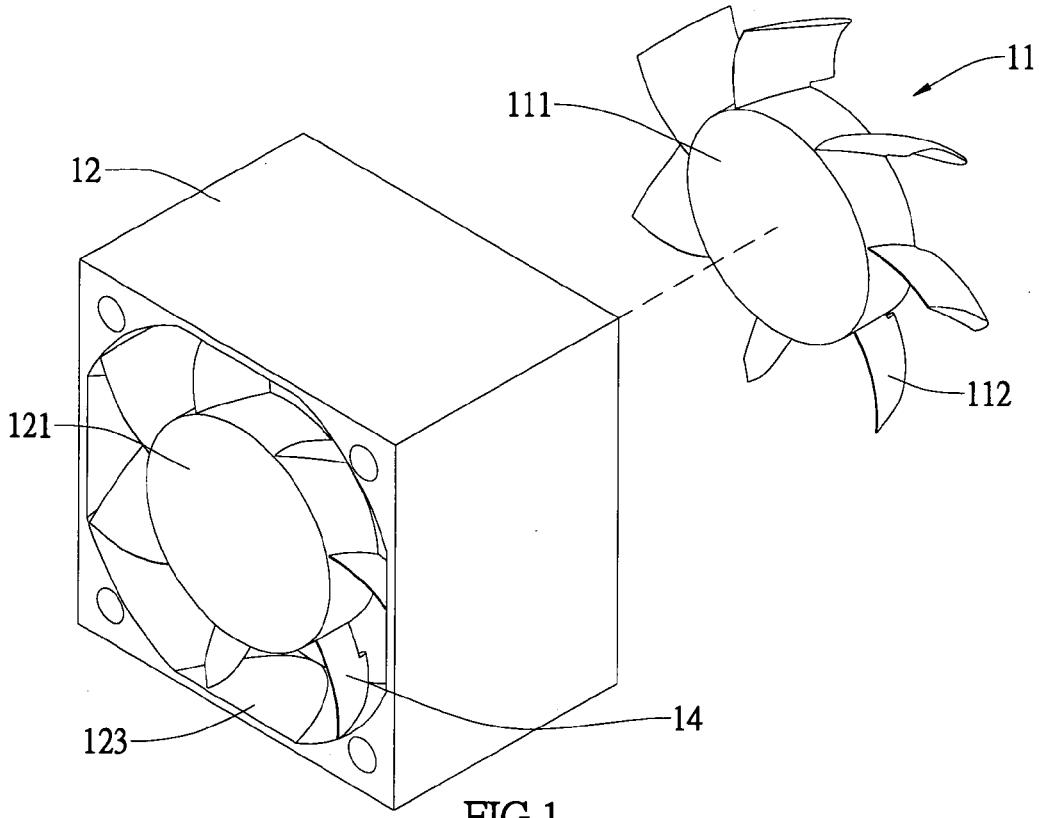
FIG. 1 is a rear exploded perspective view of an outlet airflow direction control device according to a first embodiment of the present invention.
Figure 2:
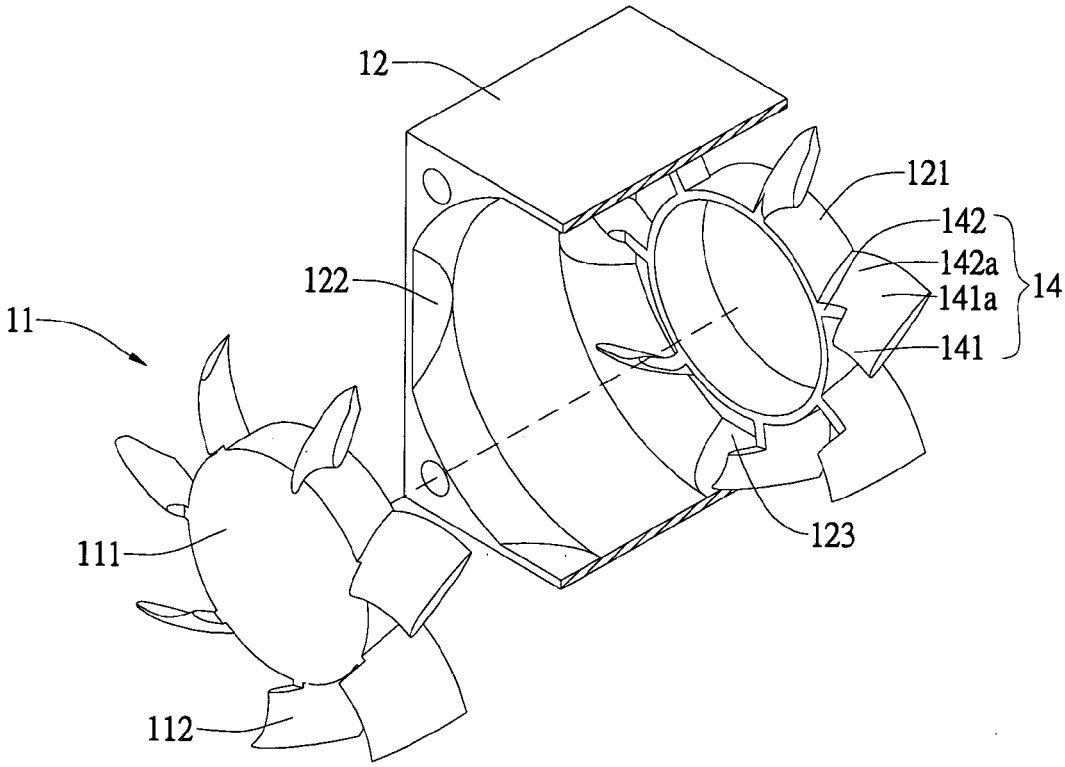
FIG. 2 is a front exploded and partially cutaway perspective view of the outlet airflow direction control device of FIG. 1.
Figure 3:
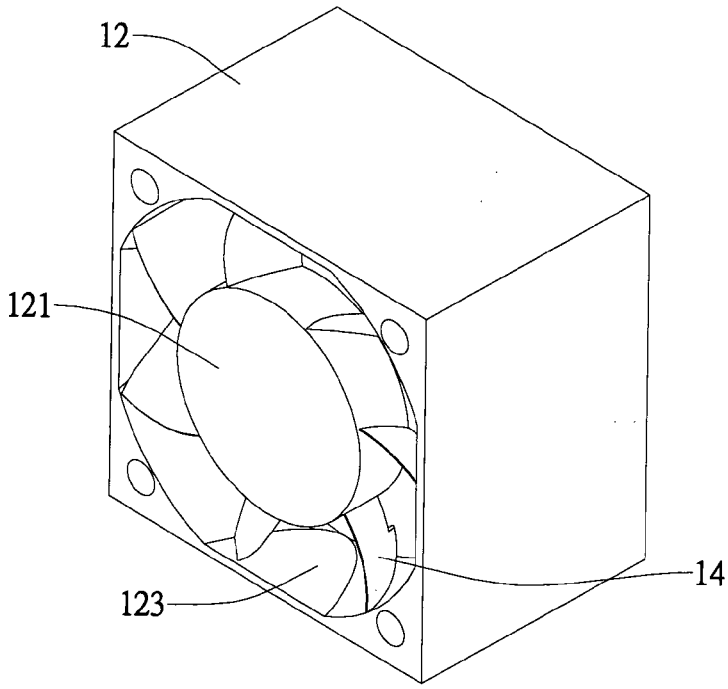
FIG. 3 is a rear assembled perspective view of the outlet airflow direction control device of FIG. 1.

Please refer to FIGS. 1, 2, and 3, in which an outlet airflow direction control device according to a first embodiment of the present invention is shown. As shown, the outlet airflow direction control device mainly includes a fan 11 and a frame 12. The frame 12 includes an inlet 122 and an outlet 123 via which an amount of fluid flows into and out of the frame 12. The fan 11 includes a hub 111 and a plurality of blades 112. The frame 12 is also internally provided with a hub seat 121 corresponding to the hub 111 of the fan 11 so as to support the fan 11 in the frame 12 by mounting the hub 111 to the hub seat 121. The hub seat 121 at the outlet 123 of the frame 12 is formed on an outer circumferential surface with a plurality of radially projected directional-guide blades 14. Each of the directional-guide blades 14 is connected at an outer end, which forms a directional-guide section 141 of the directional-guide blade 14, to the frame 12, and at an inner end, which forms a connecting section 142 of the directional-guide blade 14, to the hub seat 121. It is noted the directional-guide section 141 has an area 141a larger than an area 142*a* of the connecting section 142. The directional-guide blades 14 are adapted to change a radial pressure against the fluid flowing through the frame 12, so that the fluid flown through the outlet 123 flows radially inward without quickly diffusing outward. Therefore, directions in which the fluid at the outlet 123 flows may be controlled and a noise produced by the fluid while flowing through the outlet 123 is reduced. Please refer to FIG. 4. When the blades 112 of the fan 11 are rotated, a non-constant flow field is produced to cause the fluid to flow into the frame 12 via the inlet 122 and out of the frame 12 via the outlet 123. When the fluid flows through the outlet 123, it is controlled by the area 141*a* of the directional-guide section 141 of the directional-guide blades 14 and is subject to a relatively large radial pressure to flow toward a center behind the hub seat 121 of the frame 12. That is, there is an increased amount of the fluid flown to a rear side of the hub seat 121 to reduce a dead-air zone behind the hub seat 121. Therefore, the outlet airflow direction control device of the present invention may be used to carry heat produced in a system to external environments at a largely upgraded radiation efficiency to provide an enhanced radiation effect.

Figure 4:
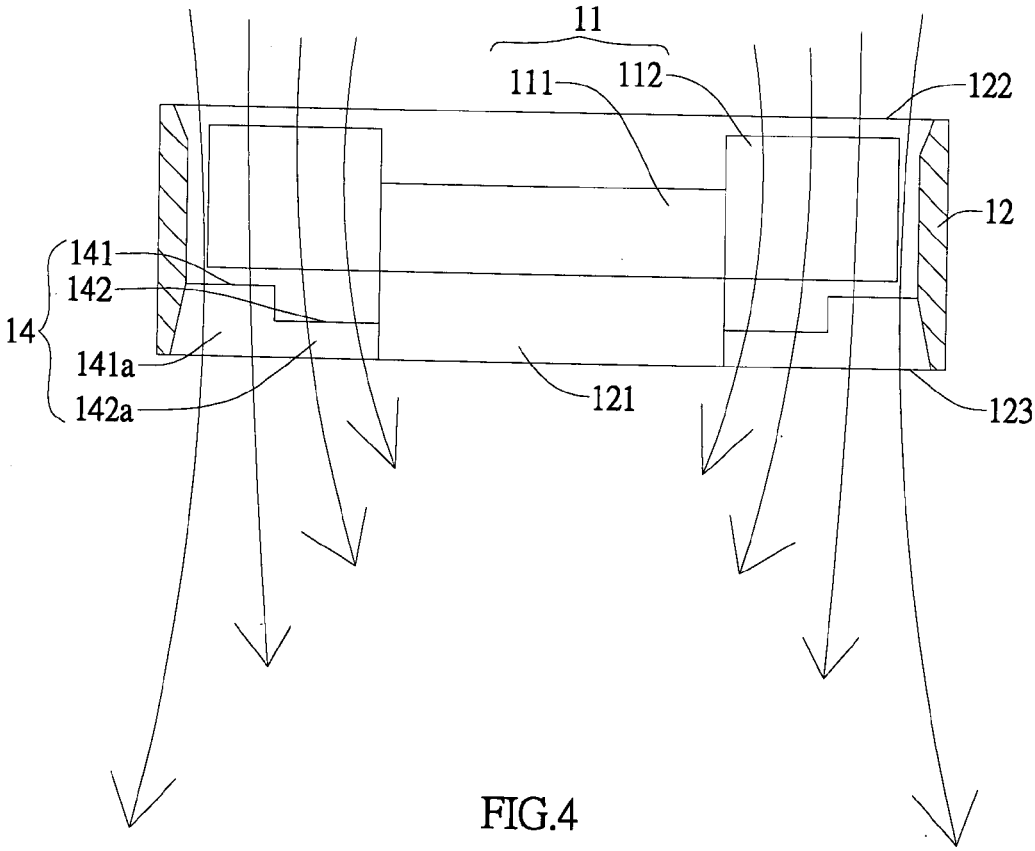
FIG. 4 is a cross sectional view of the outlet airflow direction control device of FIG. 1 showing airflow directions at an outlet of the device.
Figure 5:
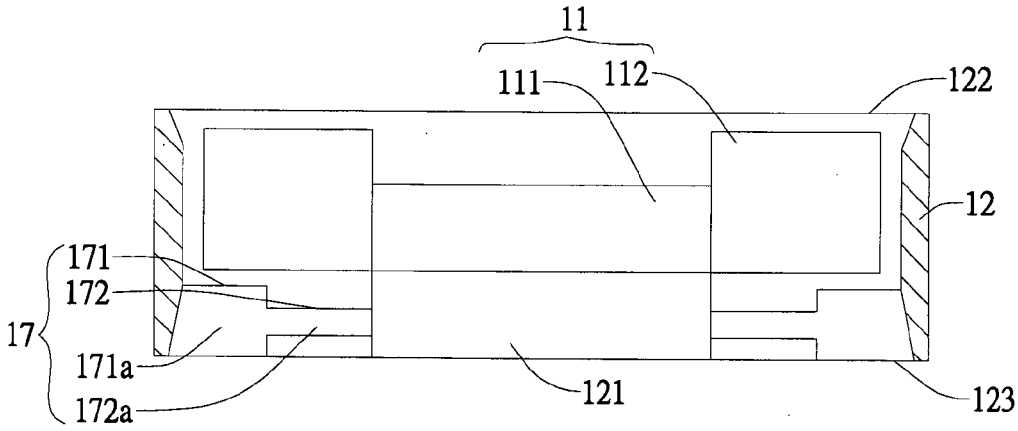
FIG. 5 shows a variant of the directional-guide blade included in the first embodiment of the present invention.
Figure 6:
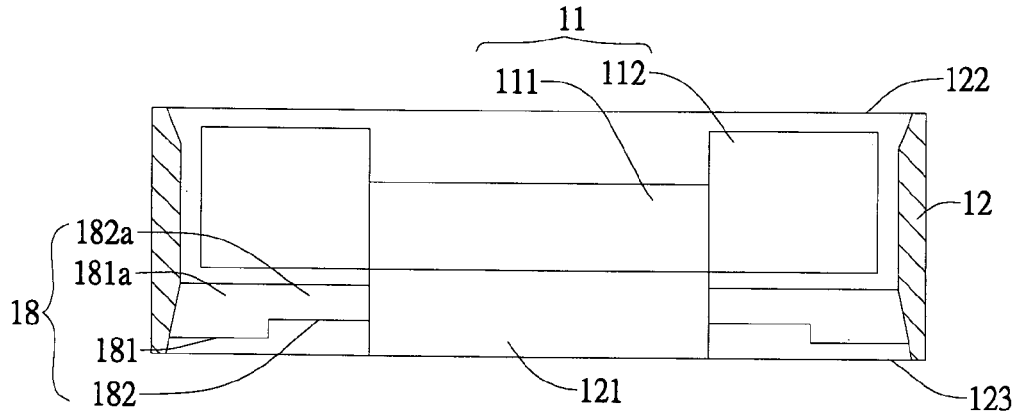
FIG. 6 shows another variant of the directional-guide blade included in the first embodiment of the present invention.
Figure 7:
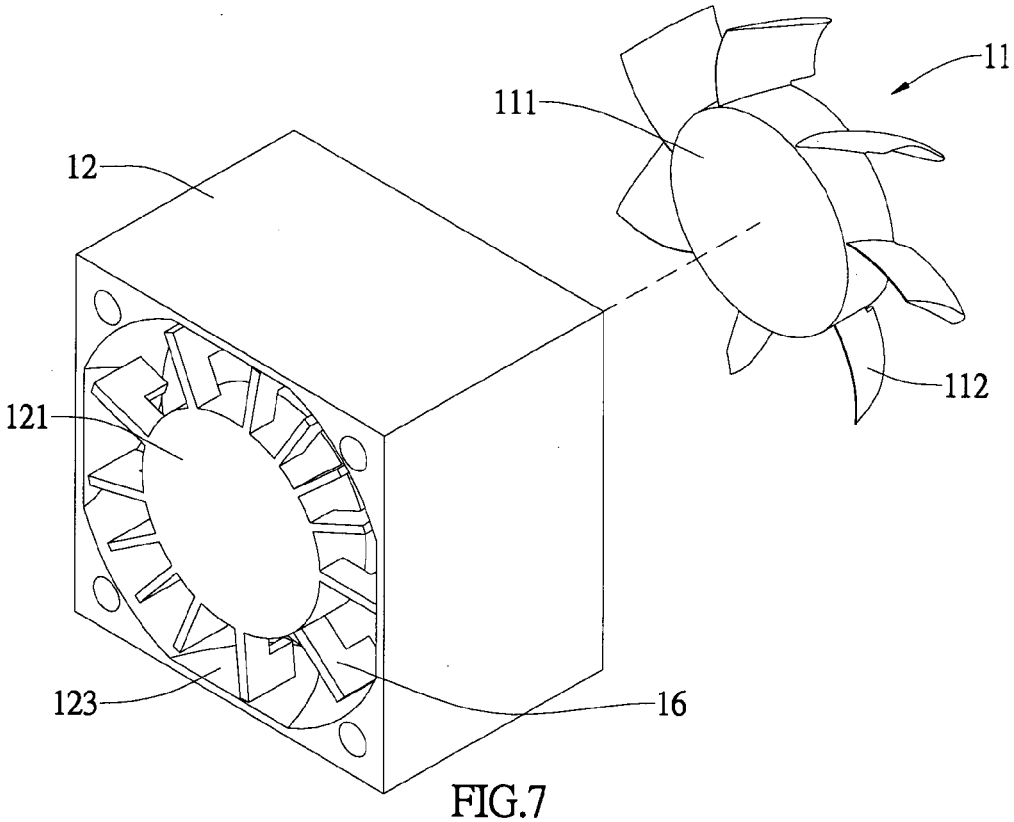
FIG. 7 is a rear exploded perspective view of an outlet airflow direction control device according to a second embodiment of the present invention.
Figure 8:
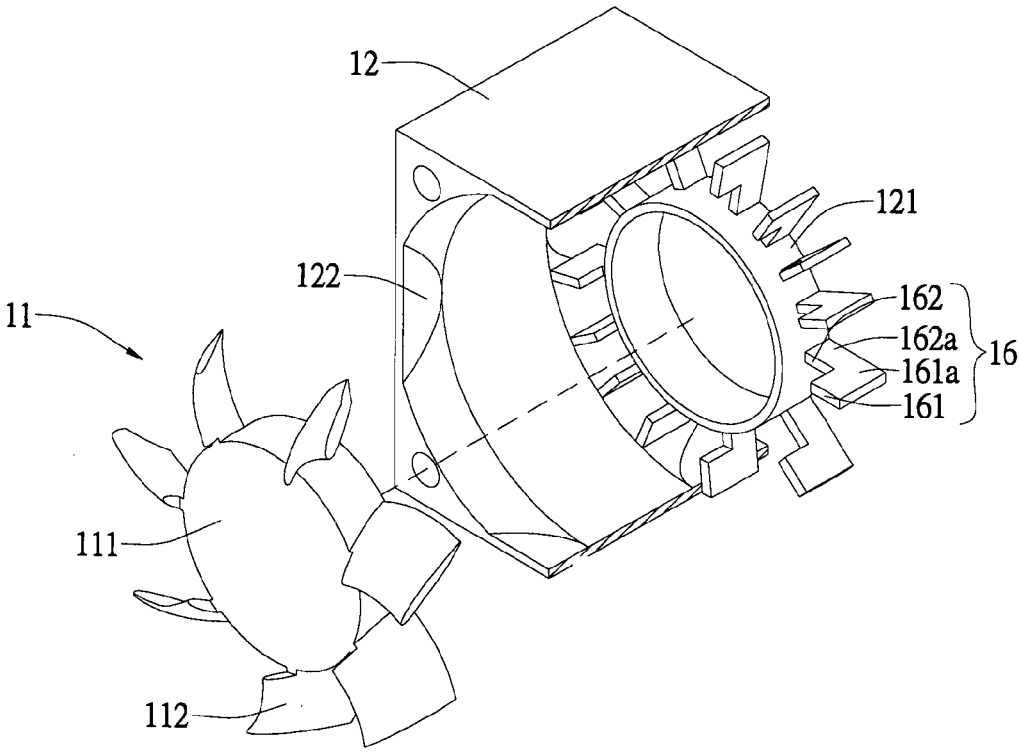
FIG. 8 is a front exploded and partially cutaway perspective view of the outlet airflow direction control device of FIG. 7.
Figure 9:
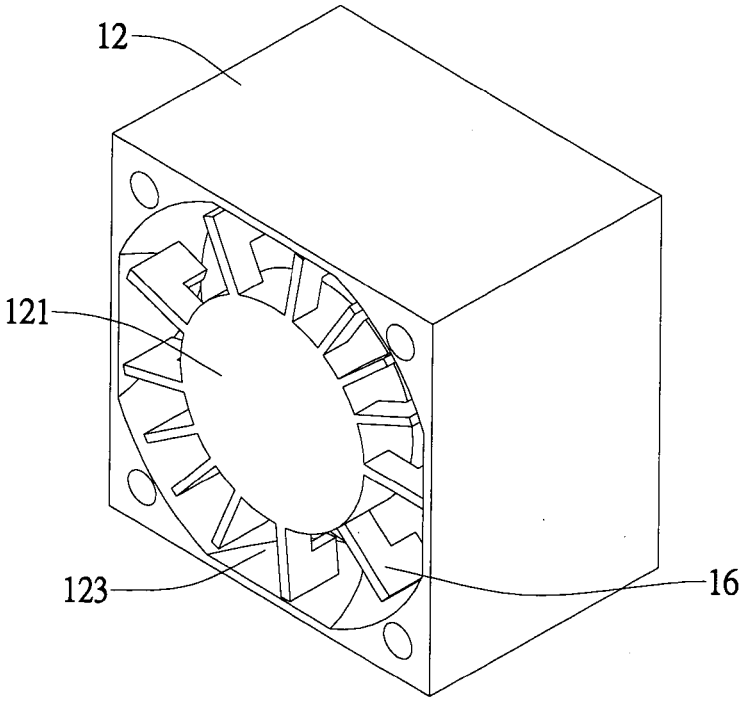
FIG. 9 is a rear assembled perspective view of the outlet airflow direction control device of FIG. 7.
Figure 10:
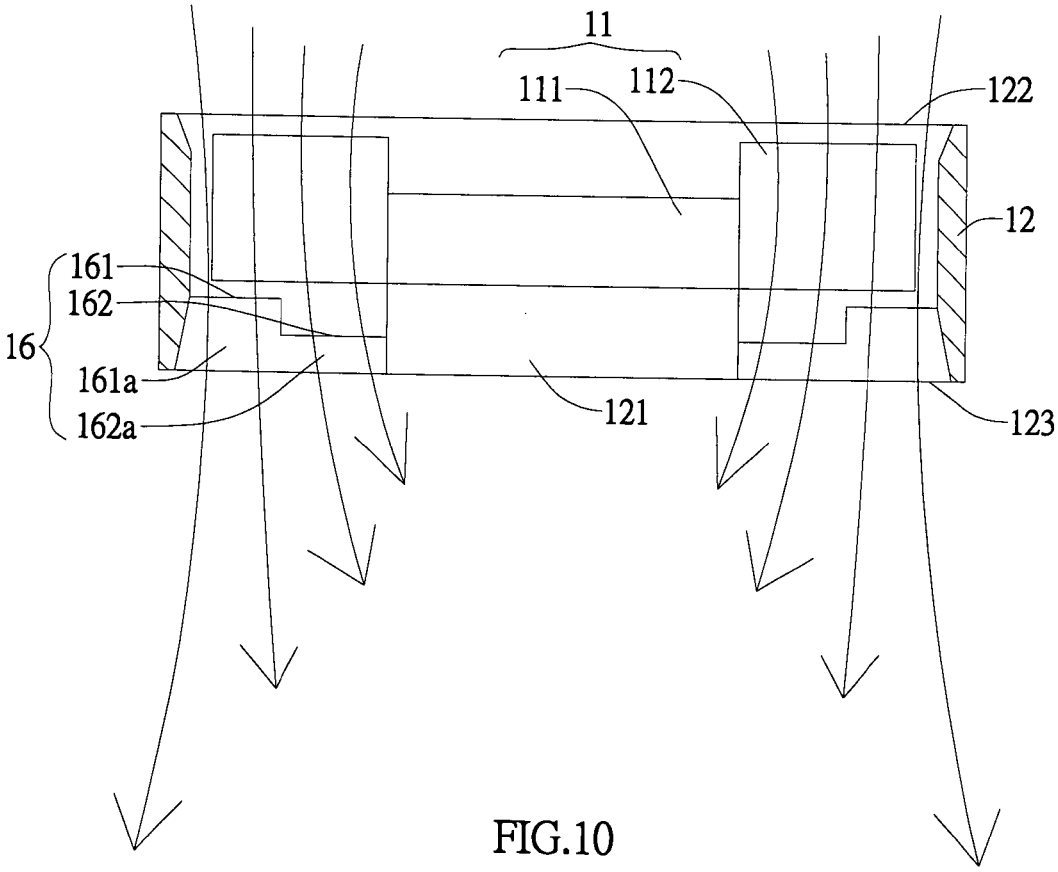
FIG. 10 is a cross sectional view of the outlet airflow direction control device of FIG. 7 showing airflow directions at an outlet of the device.

Please refer to FIGS. 4, 5, and 6. The directional-guide blade 14 for the present invention may be differently configured, such as T-shaped and L-shaped blades 17, 18, as shown in FIGS. 5 and 6, respectively. The T-shaped directional-guide blade 17 includes a directional-guide section 171 having an area 171*a*, and a connecting section 172 having an area 172*a*. The area 171*a* is larger than the area 172*a*. The L-shaped directional-guide blade 18 includes a directional-guide section 181 having an area 181*a*, and a connecting section 182 having an area 182*a*. The area 181*a* is larger than the area 182*a*. In each of the blades 17, 18 it can be seen that the directional guide section (171, 181) has a uniform axial length (first axial length) and that the connecting section (172, 182) has a uniform axial length (second axial length) wherein the axial length of the directional guide section is greater than the axial length of the connecting section. All the above two types of directional-guide blades are adapted to change the radial pressure against the fluid passing through the outlet 123 to achieve the effect of controlling the flow direction of the fluid and producing enhanced radiating power.

Please refer to FIGS. 7, 8, 9, and 10 that are rear exploded, front exploded, rear assembled, and cross sectional views, respectively, of an outlet airflow direction control device according to a second embodiment of the present invention. As shown, the second embodiment is structurally and functionally similar to the first embodiment, except that the hub seat 121 at the outlet 123 of the frame 12 of the second embodiment is formed on a peripheral wall thereof with a plurality of radially projected ribs 16. Each of the ribs 16 includes an outer end forming a directional-guide section 161 having an area 161*a*, and an inner end forming a connecting section 162 having an area 162*a*. The area 161*a* is larger than the area 162*a*, so that the ribs 16 are adapted to change the radial pressure against the fluid flowing through the frame 12 and thereby achieve the effect of controlling the flow direction of the fluid and producing enhanced radiating power.

Figure 11:
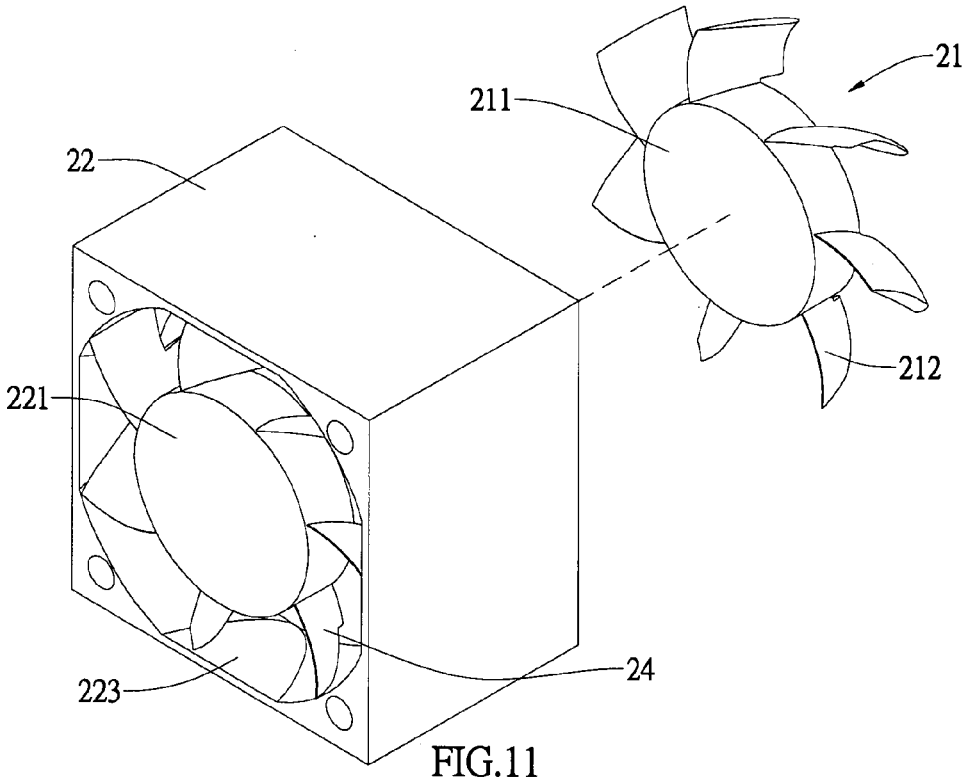
FIG. 11 is a rear exploded perspective view of an outlet airflow direction control device according to a third embodiment of the present invention.
Figure 12:
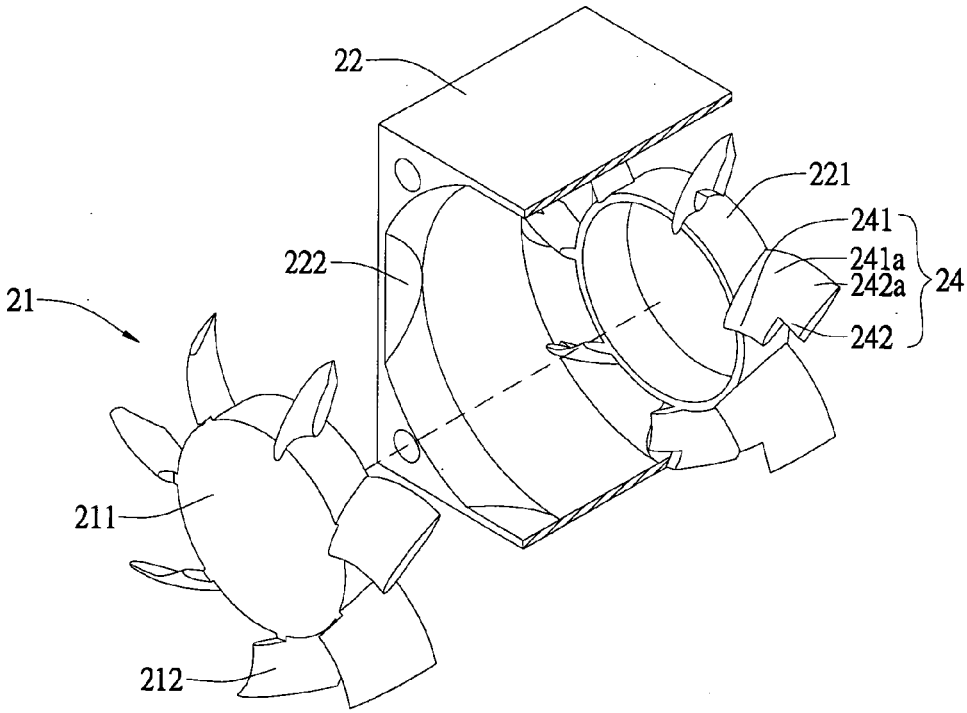
FIG. 12 is a front exploded and partially cutaway perspective view of the outlet airflow direction control device of FIG. 11.
Figure 13:
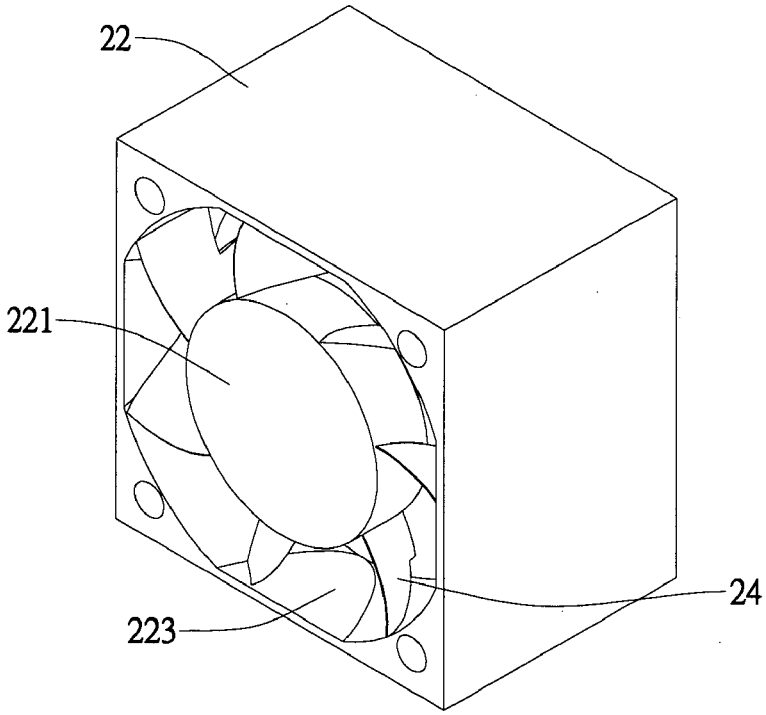
FIG. 13 is a rear assembled perspective view of the outlet airflow direction control device of FIG. 11.

Please refer to FIGS. 11, 12, and 13, in which an outlet airflow direction control device according to a third embodiment of the present invention is shown. As shown, the outlet airflow direction control device mainly includes a fan 21 and a frame 22. The frame 22 includes an inlet 222 and an outlet 223 via which an amount of fluid flows into and out of the frame 22. The fan 21 includes a hub 211 and a plurality of blades 212. The frame 22 is also internally provided with a hub seat 221 corresponding to the hub 211 of the fan 21 so as to support the fan 21 in the frame 22 by mounting the hub 211 to the hub seat 221. The hub seat 221 at the outlet 223 of the frame 22 is formed on an outer circumferential surface with a plurality of radially projected directional-guide blades 24. Each of the directional-guide blades 24 is connected at an inner end, which forms a directional-guide section 241 of the directional-guide blade 24, to the hub seat 221, and at an outer end, which forms a connecting section 242 of the directional-guide blade 24, to the frame 22. It is noted the directional-guide section 241 has an area 241*a* larger than an area 242*a* of the connecting section 242. The directional-guide blades 24 are adapted to change a radial pressure against the fluid flowing through the frame 22 and thereby achieve the effect of controlling the flow direction of the fluid.

Figure 14:
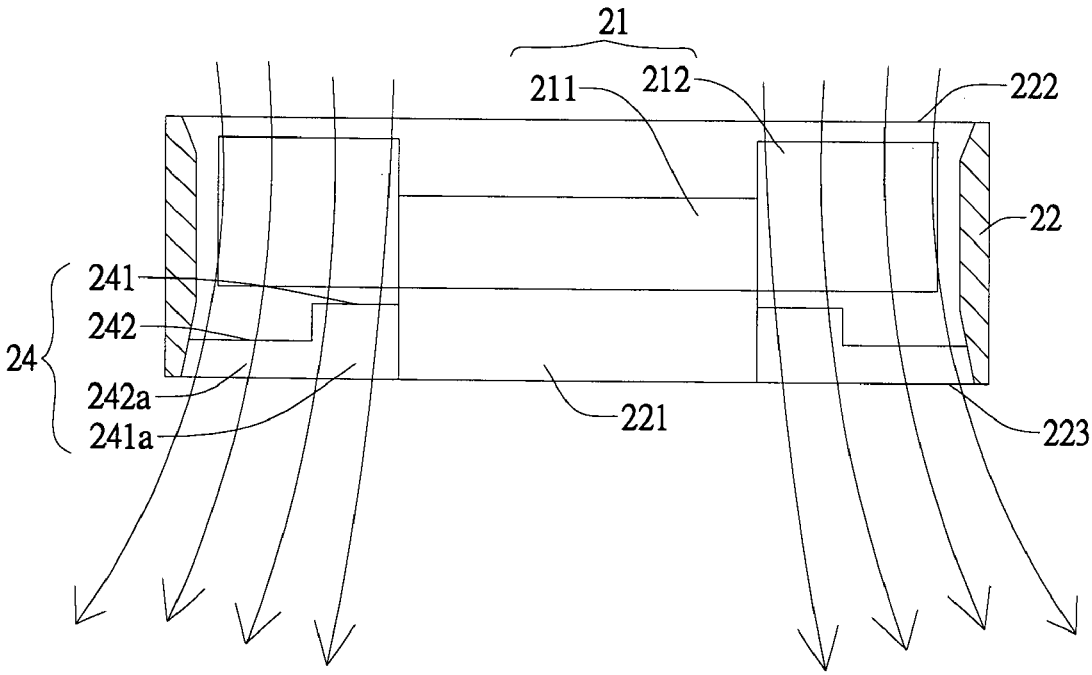
FIG. 14 is a cross sectional view of the outlet airflow direction control device of FIG. 11 showing airflow directions at an outlet of the device.

Please refer to FIG. 14. When the blades 212 of the fan 21 are rotated, a non-constant flow field is produced to cause the fluid to flow into the frame 22 via the inlet 222 and out of the frame 22 via the outlet 223. When the fluid flows through the outlet 223, it is controlled by the area 241*a* of the directional-guide section 241 of the directional-guide blades 24 and is subject to a relatively large radial pressure to diffuse outward into an increased space.

Figure 15:
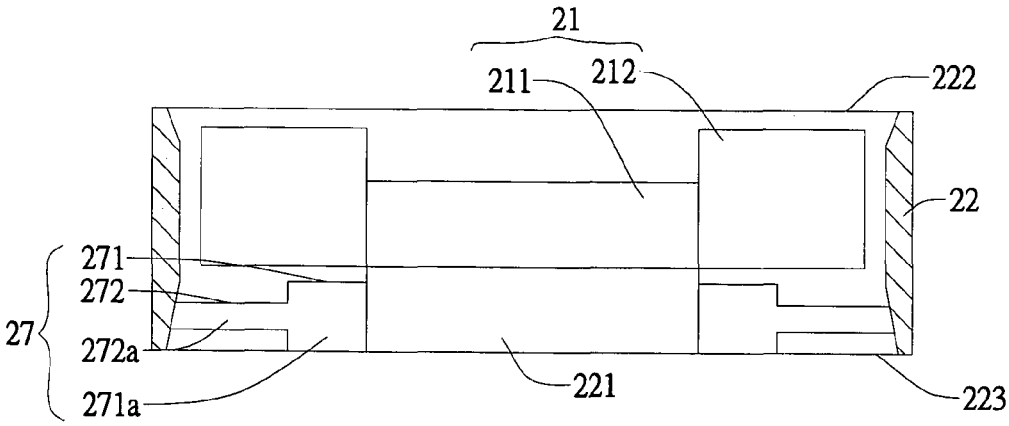
FIG. 15 shows a variant of the directional-guide blade included in the third embodiment of the present invention.
Figure 16:
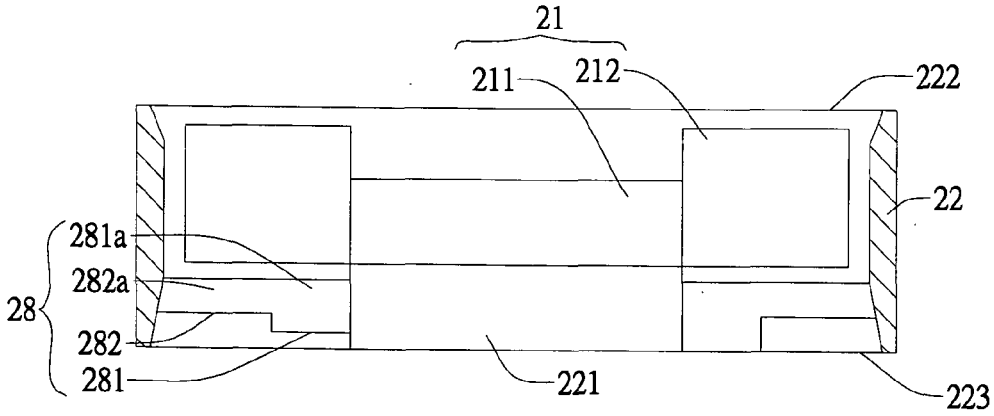
FIG. 16 shows another variant of the directional-guide blade included in the third embodiment of the present invention.
Figure 17:
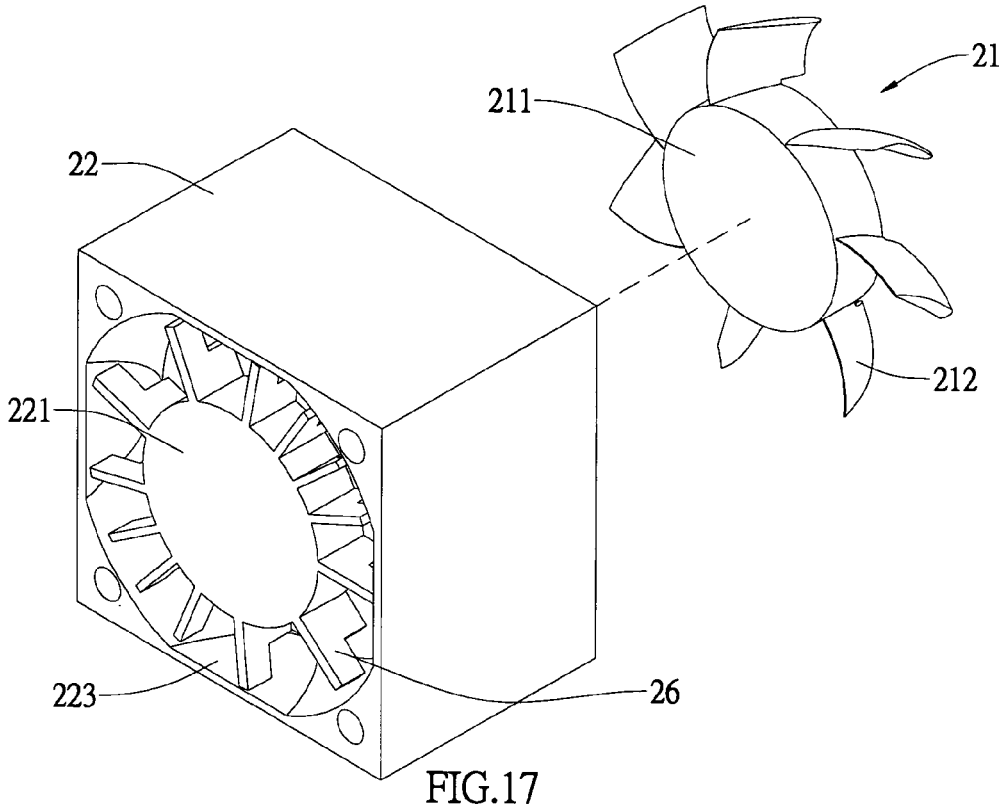
FIG. 17 is a rear exploded perspective view of an outlet airflow direction control device according to a fourth embodiment of the present invention.
Figure 18:
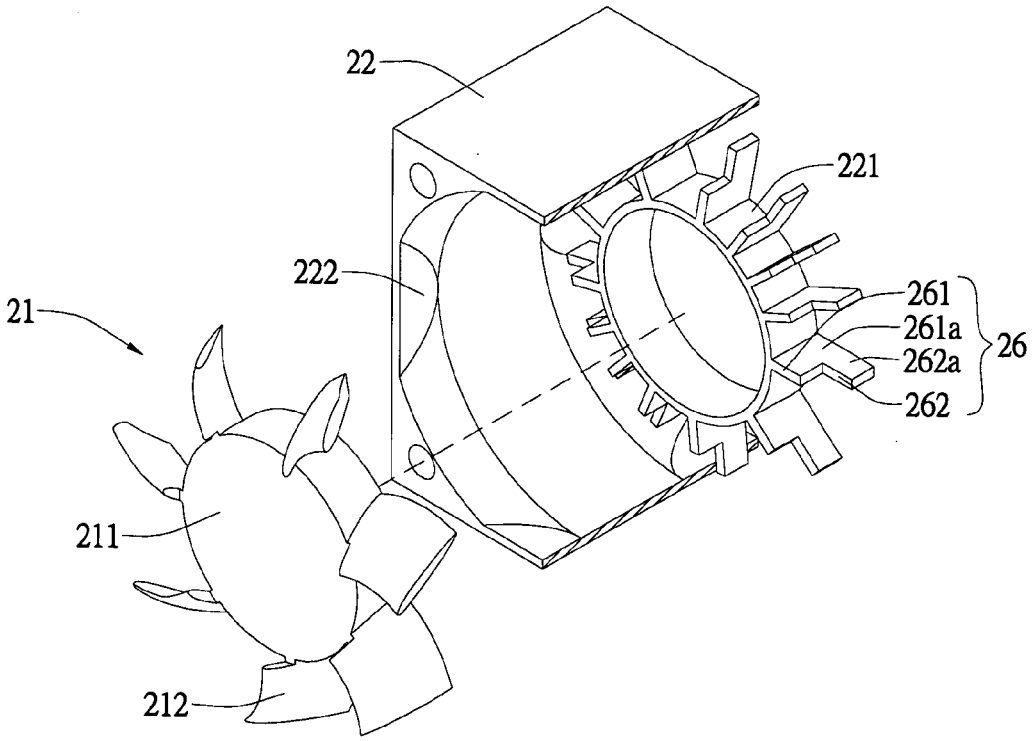
FIG. 18 is a front exploded and partially cutaway perspective view of the outlet airflow direction control device of FIG. 17.
Figure 19:
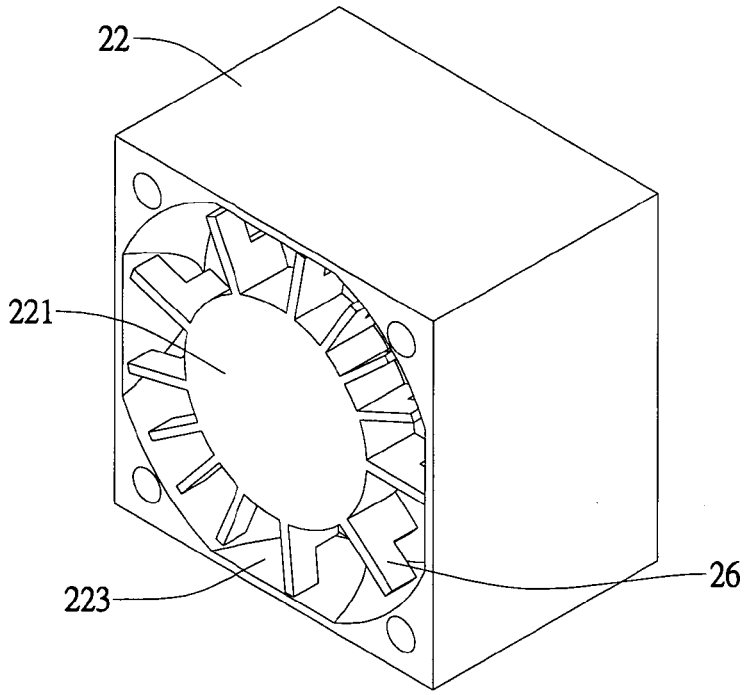
FIG. 19 is a rear assembled perspective view of the outlet airflow direction control device of FIG. 17.
Figure 20:
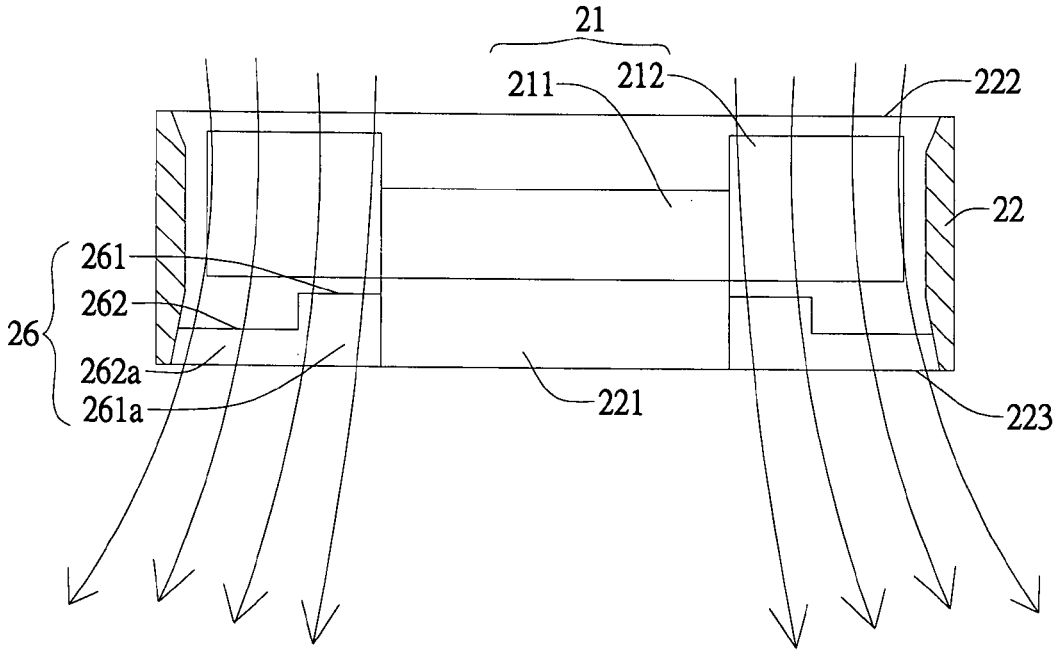
FIG. 20 is a cross sectional view of the outlet airflow direction control device of FIG. 17 showing airflow directions at an outlet of the device.

Please refer to FIGS. 14, 15, and 16. The directional-guide blade 24 for the present invention may be differently configured, such as T-shaped and L-shaped blades 27, 28, as shown in FIGS. 15 and 16, respectively. The T-shaped directional-guide blade 27 includes a directional-guide section 271 having an area 271*a*, and a connecting section 272 having an area 272a. The area 271*a* is larger than the area 272*a*. The L-shaped directional-guide blade 28 includes a directional-guide section 281 having an area 281*a*, and a connecting section 282 having an area 282*a*. The area 281*a* is larger than the area 282*a*. All the above two types of directional-guide blades are adapted to change the radial pressure against the fluid passing through the outlet 223 to achieve the effect of controlling the flow direction of the fluid.

Please refer to FIGS. 17, 18, 19, and 20 that are rear exploded, front exploded, rear assembled, and cross sectional views, respectively, of an outlet airflow direction control device according to a fourth embodiment of the present invention. As shown, the fourth embodiment is structurally and functionally similar to the third embodiment, except that the hub seat 221 at the outlet 223 of the frame 22 of the fourth embodiment is formed on a peripheral wall thereof with a plurality of radially projected ribs 26. Each of the ribs 26 includes an inner end forming a directional-guide section 261 having an area 261*a*, and an outer end forming a connecting section 262 having an area 262*a*. The area 261*a* is larger than the area 262*a*, so that the ribs 26 are adapted to change the radial pressure against the fluid flowing through the frame 22 and thereby achieve the effect of controlling the flow direction of the fluid.

Figure 21:
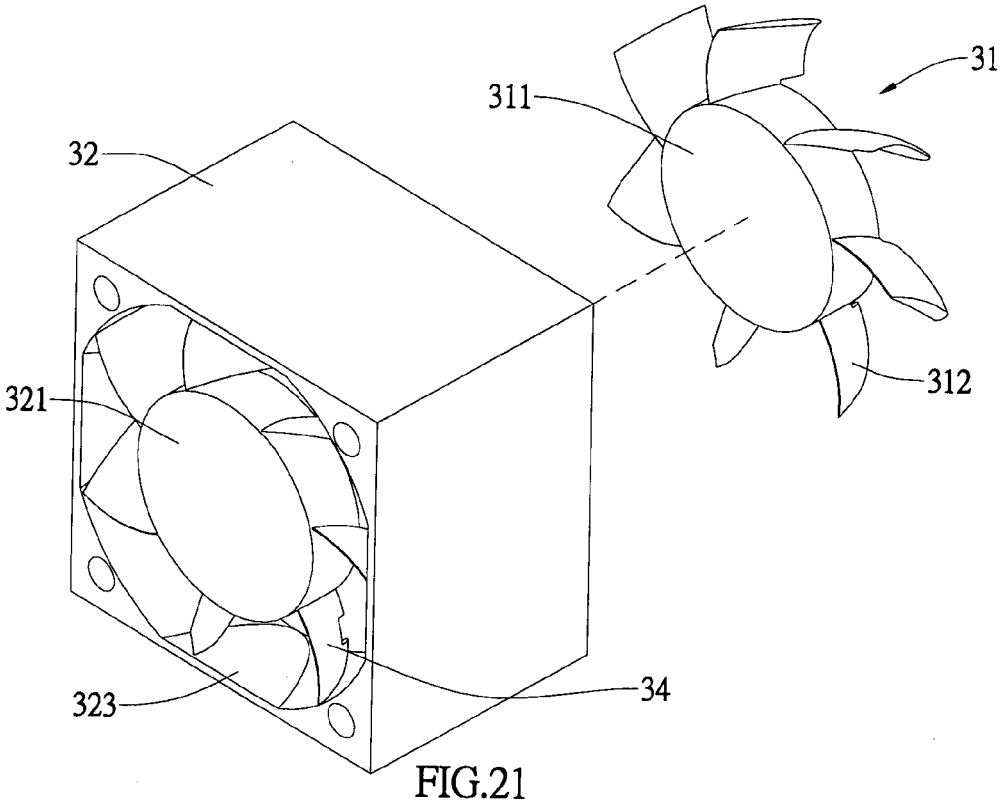
FIG. 21 is a rear exploded perspective view of an outlet airflow direction control device according to a fifth embodiment of the present invention.
Figure 22:
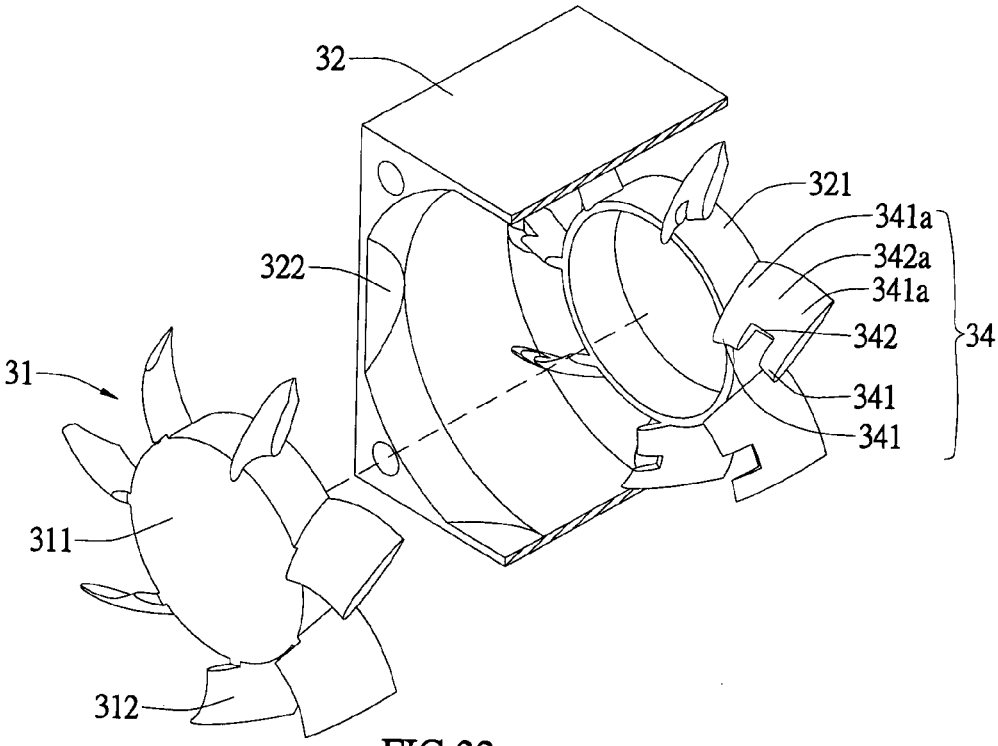
FIG. 22 is a front exploded and partially cutaway perspective view of the outlet airflow direction control device of FIG. 21.
Figure 23:
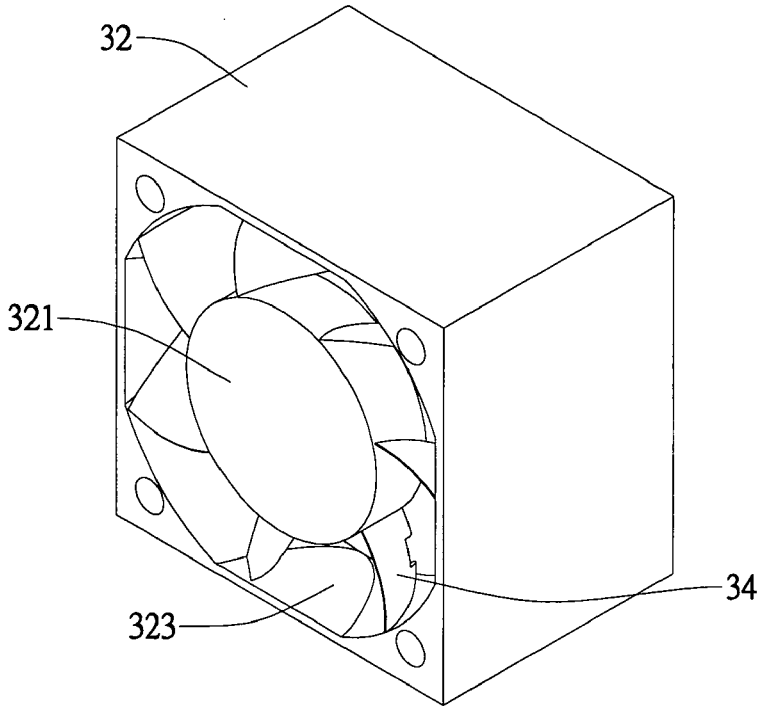
FIG. 23 is a rear assembled perspective view of the outlet airflow direction control device of FIG. 21.

Please refer to FIGS. 21, 22, and 23, in which an outlet airflow direction control device according to a fifth embodiment of the present invention is shown. As shown, the outlet airflow direction control device mainly includes a fan 31 and a frame 32. The frame 32 includes an inlet 322 and an outlet 323 via which an amount of fluid flows into and out of the frame 32. The fan 31 includes a hub 311 and a plurality of blades 312. The frame 32 is also internally provided with a hub seat 321 corresponding to the hub 311 of the fan 31 so as to support the fan 31 in the frame 32 by mounting the hub 311 to the hub seat 321. The hub seat 321 at the outlet 323 of the frame 32 is formed on an outer circumferential surface with a plurality of radially projected directional-guide blades 34. Each of the directional-guide blades 34 is connected at outer and inner end, which form two directional-guide sections 341 of the directional-guide blade 34, to the frame 32 and the hub seat 321, respectively. A middle portion of the directional-guide blade 34 is a connecting section 342 that connects the two directional-guide sections 341 to each other. It is noted the directional-guide section 341 has an area 341*a* larger than an area 342*a* of the connecting section 342. The directional-guide blades 34 are adapted to change a radial pressure against the fluid flowing through the frame 32, so that the fluid flown through the outlet 323 flows radially inward without quickly diffusing outward. Therefore, directions in which the fluid at the outlet 323 flows may be controlled and a noise produced by the fluid while flowing through the outlet 323 is reduced.

Figure 24:
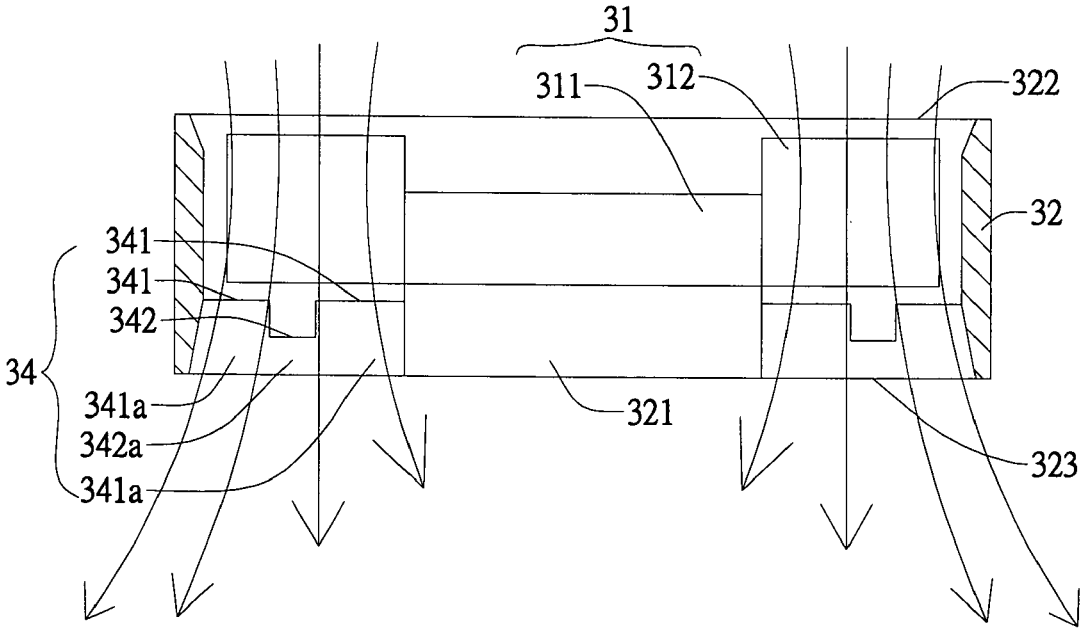
FIG. 24 is a cross sectional view of the outlet airflow direction control device of FIG. 21 showing airflow directions at an outlet of the device.

Please refer to FIG. 24. When the blades 312 of the fan 31 are rotated, a non-constant flow field is produced to cause the fluid to flow into the frame 32 via the inlet 322 and out of the frame 32 via the outlet 323. When the fluid flows through the outlet 323, it is controlled by the areas 341*a* of the directional-guide sections 341 of the directional-guide blades 34 and is subject to a relatively large radial pressure to flow toward a center behind the hub seat 321 of the frame 32 and diffuse outward. That is, there is an increased amount of the fluid flown to a rear side of the hub seat 321 to reduce a dead-air zone behind the hub seat 321.

Therefore, the outlet airflow direction control device of the present invention may be used to carry heat produced in a system to external environments at a largely upgraded radiation efficiency to provide an enhanced radiation effect.

Figure 25:
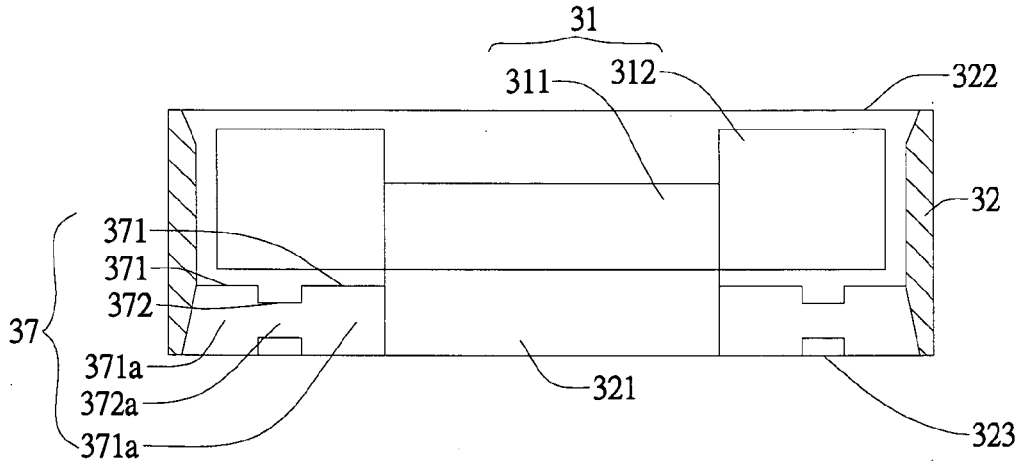
FIG. 25 shows a variant of the directional-guide blade included in the fifth embodiment of the present invention.
Figure 26:
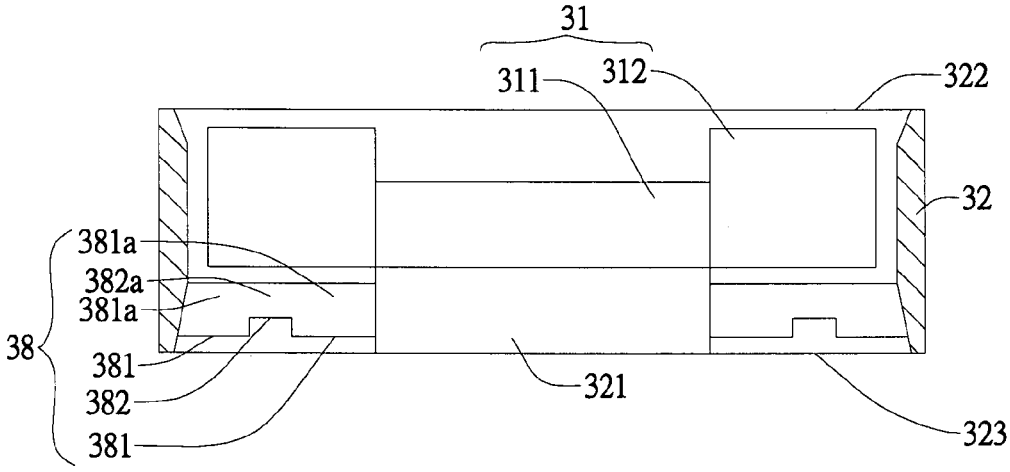
FIG. 26 shows another variant of the directional-guide blade included in the fifth embodiment of the present invention.
Figure 27:
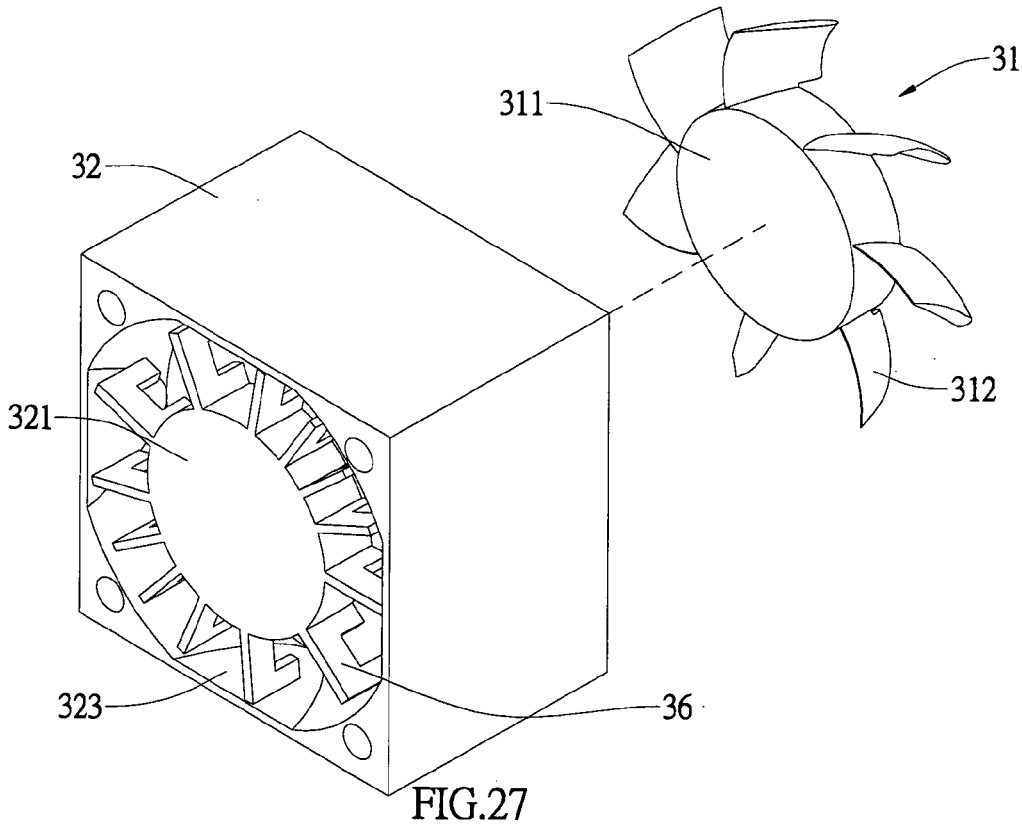
FIG. 27 is a rear exploded perspective view of an outlet airflow direction control device according to a sixth embodiment of the present invention.
Figure 28:
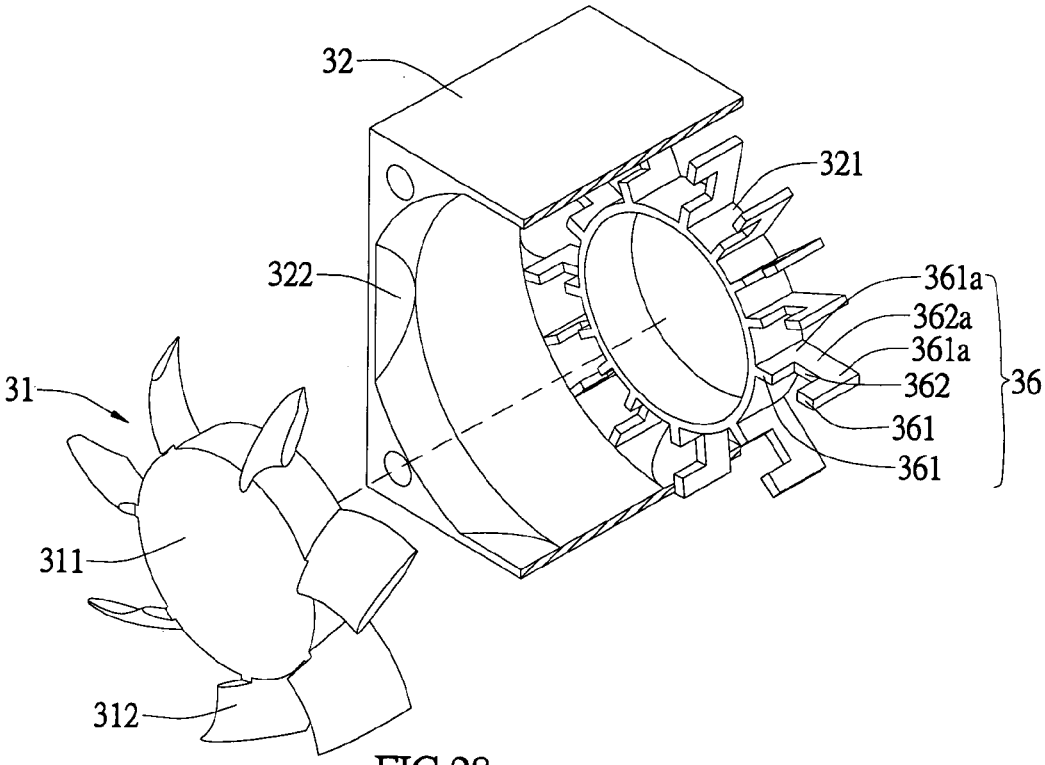
FIG. 28 is a front exploded and partially cutaway perspective view of the outlet airflow direction control device of FIG. 27.
Figure 29:
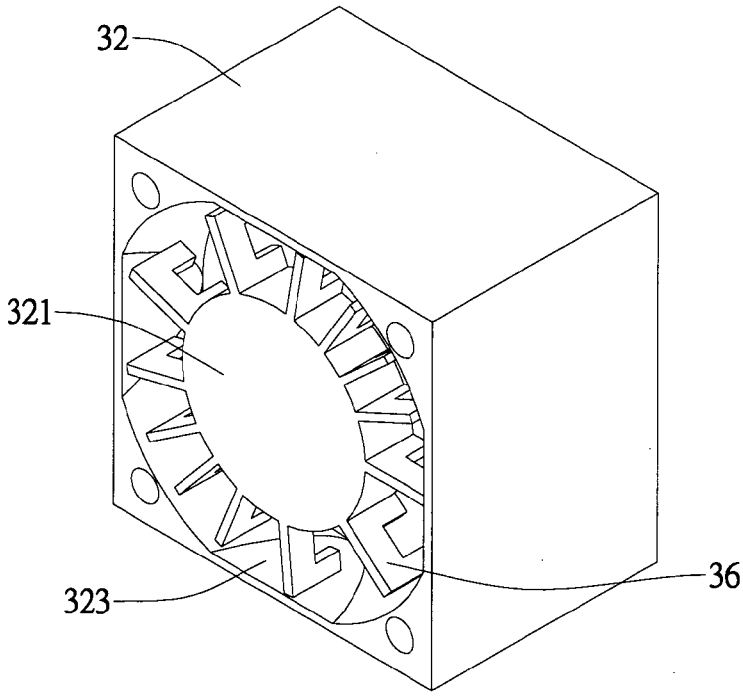
FIG. 29 is a rear assembled perspective view of the outlet airflow direction control device of FIG. 27.
Figure 30:
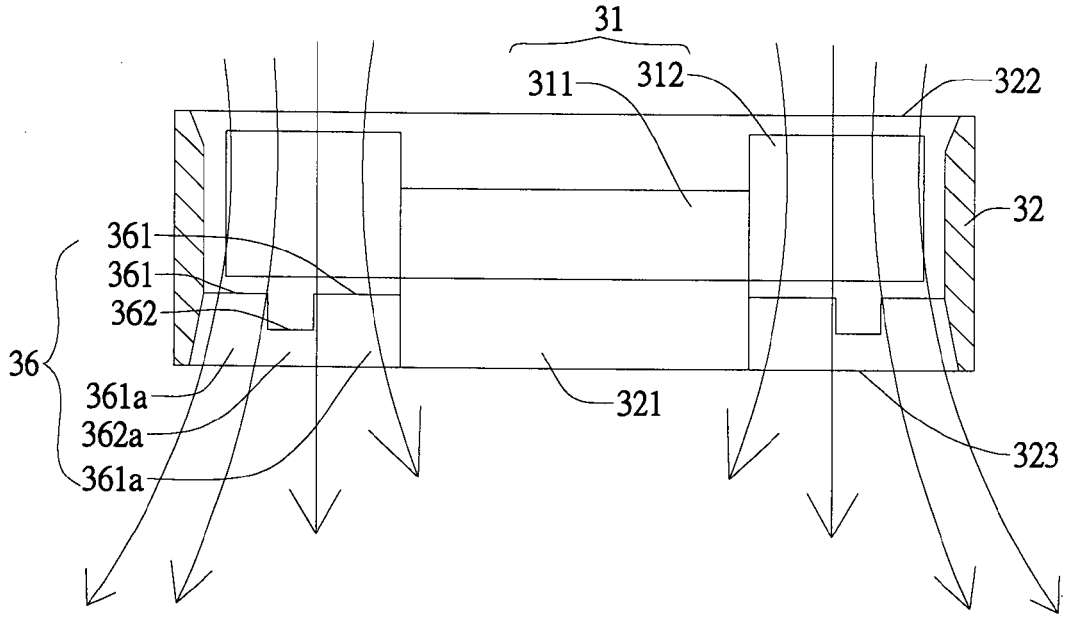
FIG. 30 is a cross sectional view of the outlet airflow direction control device of FIG. 27 showing airflow directions at an outlet of the device.

Please refer to FIGS. 24, 25, and 26. The directional-guide blade 34 for the present invention may be differently configured, such as H-shaped and U-shaped blades 37, 38, as shown in FIGS. 25 and 26, respectively. The H-shaped directional-guide blade 37 includes two directional-guide sections 371 each having an area 371*a*, and a connecting section 372 having an area 372*a*. The area 371*a* is larger than the area 372*a*. The U-shaped directional-guide blade 38 includes two directional-guide sections 381 each having an area 381*a*, and a connecting section 382 having an area 382*a*. The area 381*a* is larger than the area 382*a*. All the above two types of directional-guide blades are adapted to change the radial pressure against the fluid passing through the outlet 323 to achieve the effect of controlling the flow direction of the fluid and producing enhanced radiating power.

Please refer to FIGS. 27, 28, 29, and 30 that are rear exploded, front exploded, rear assembled, and cross sectional views, respectively, of an outlet airflow direction control device according to a sixth embodiment of the present invention. As shown, the sixth embodiment is structurally and functionally similar to the fifth embodiment, except that the hub seat 321 at the outlet 323 of the frame 32 of the sixth embodiment is formed on a peripheral wall thereof with a plurality of radially projected ribs 36. Each of the ribs 36 includes an outer and an inner end forming two directional-guide sections 361 each having an area 361*a*, and a middle portion forming a connecting section 362 having an area 362*a* to connect the two directional-guide sections 361 to each other. The area 361*a* is larger than the area 362*a*, so that the ribs 36 are adapted to change the radial pressure against the fluid flowing through the frame 32 and thereby achieve the effect of controlling the flow direction of the fluid.

Figure 31:
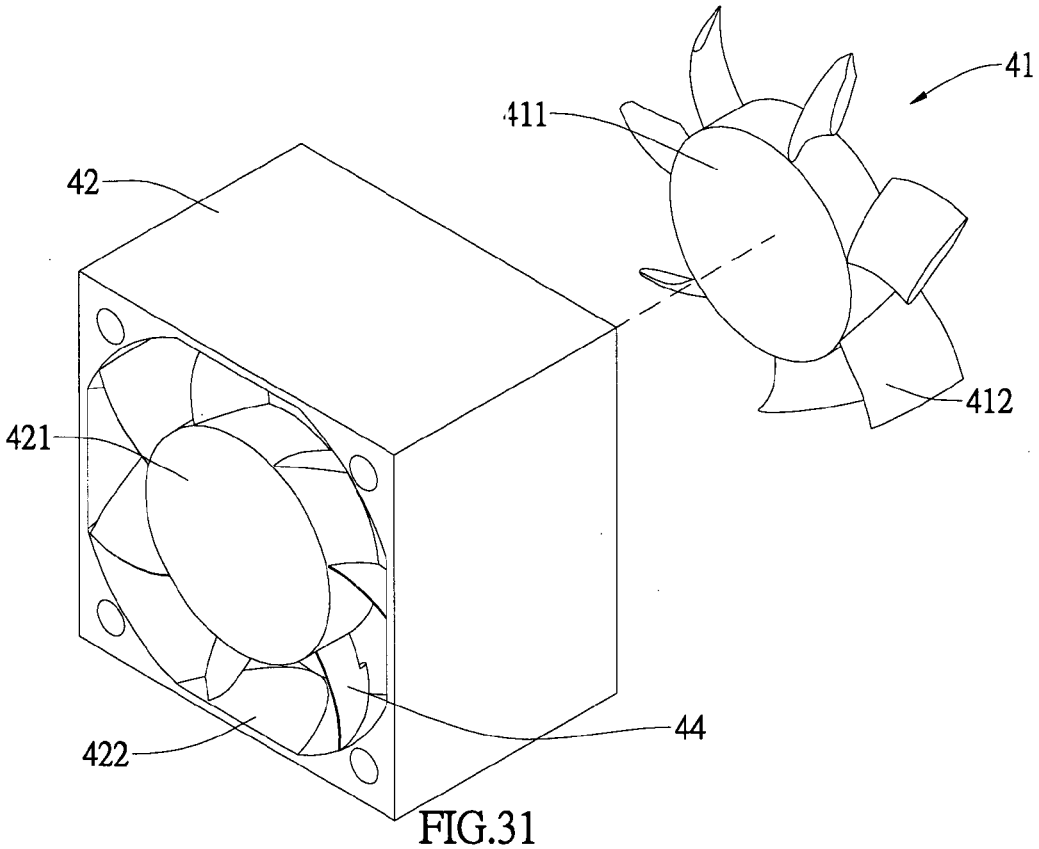
FIG. 31 is a front exploded perspective view of an outlet airflow direction control device according to a seventh embodiment of the present invention.
Figure 32:
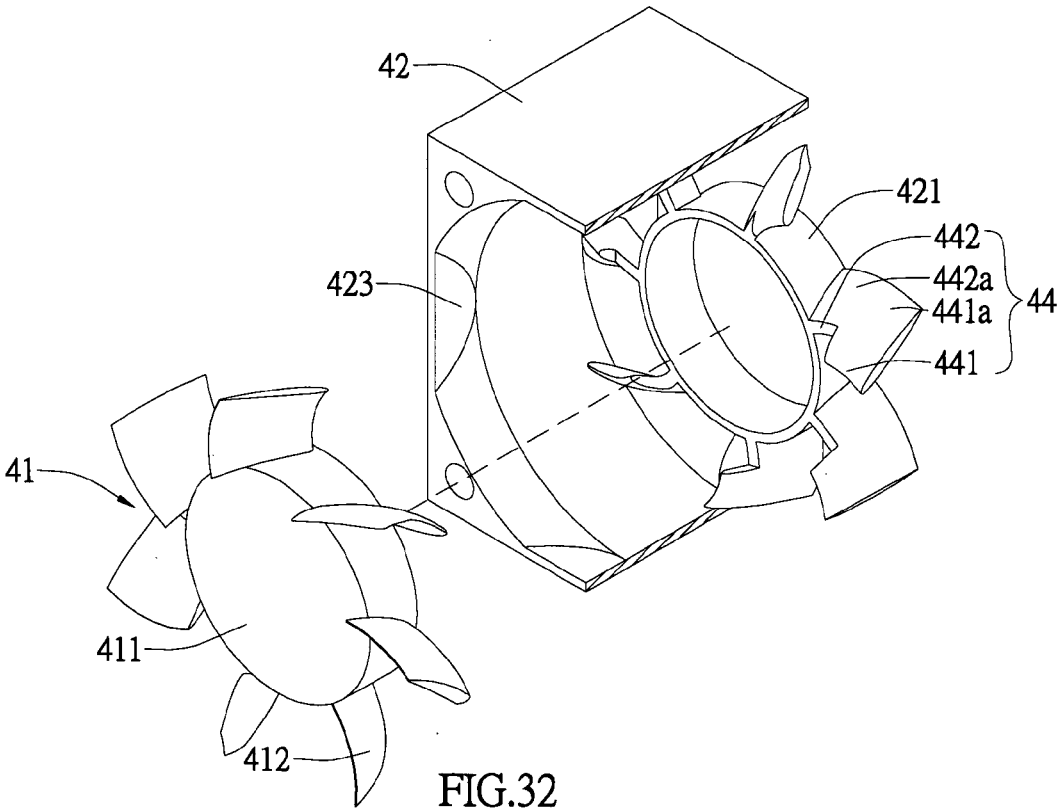
FIG. 32 is a rear exploded and partially cutaway perspective view of the outlet airflow direction control device of FIG. 31.
Figure 33:
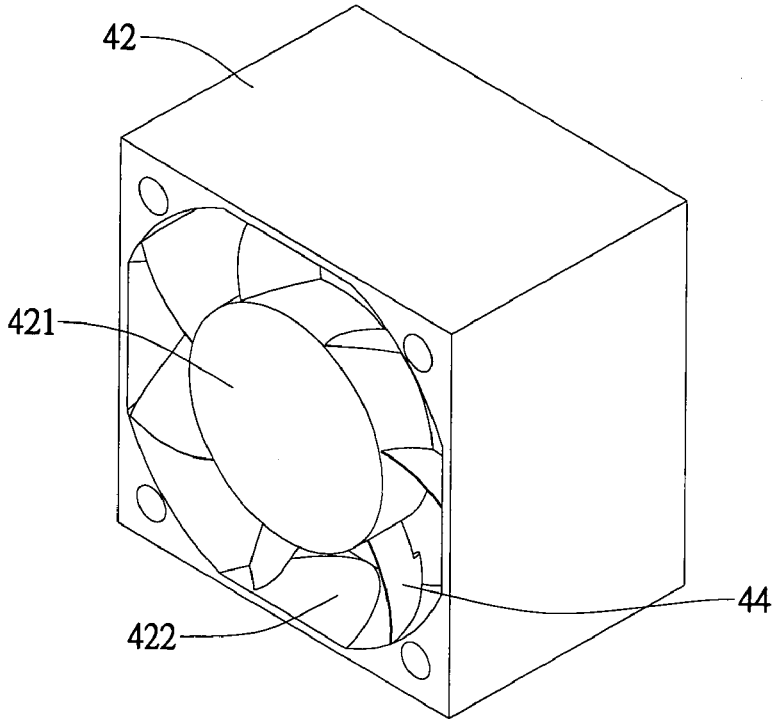
FIG. 33 is a front assembled perspective view of the outlet airflow direction control device of FIG. 31.

Please refer to FIGS. 31, 32, and 33, in which an outlet airflow direction control device according to a seventh embodiment of the present invention is shown. As shown, the outlet airflow direction control device mainly includes a fan 41 and a frame 42. The frame 42 includes an inlet 422 and an outlet 423 via which an amount of fluid flows into and out of the frame 42. The fan 41 includes a hub 411 and a plurality of blades 412. The frame 42 is also internally provided with a hub seat 421 corresponding to the hub 411 of the fan 41 so as to support the fan 41 in the frame 42 by mounting the hub 411 to the hub seat 421. The hub seat 421 at the inlet 422 of the frame 42 is formed on an outer circumferential surface with a plurality of radially projected directional-guide blades 44. Each of the directional-guide blades 44 is connected at an outer end, which forms a directional-guide section 441 of the directional-guide blade 44, to the frame 42, and at an inner end, which forms a connecting section 442 of the directional-guide blade 44, to the hub seat 421. It is noted the directional-guide section 441 has an area 441*a* larger than an area 442*a* of the connecting section 442. The directional-guide blades 44 are adapted to change a radial pressure against the fluid flowing through the frame 42, so that the fluid flown through the outlet 423 flows radially inward without quickly diffusing outward. Therefore, directions in which the fluid at the outlet 423 flows may be controlled and a noise produced by the fluid while flowing through the outlet 423 is reduced.

Figure 34:
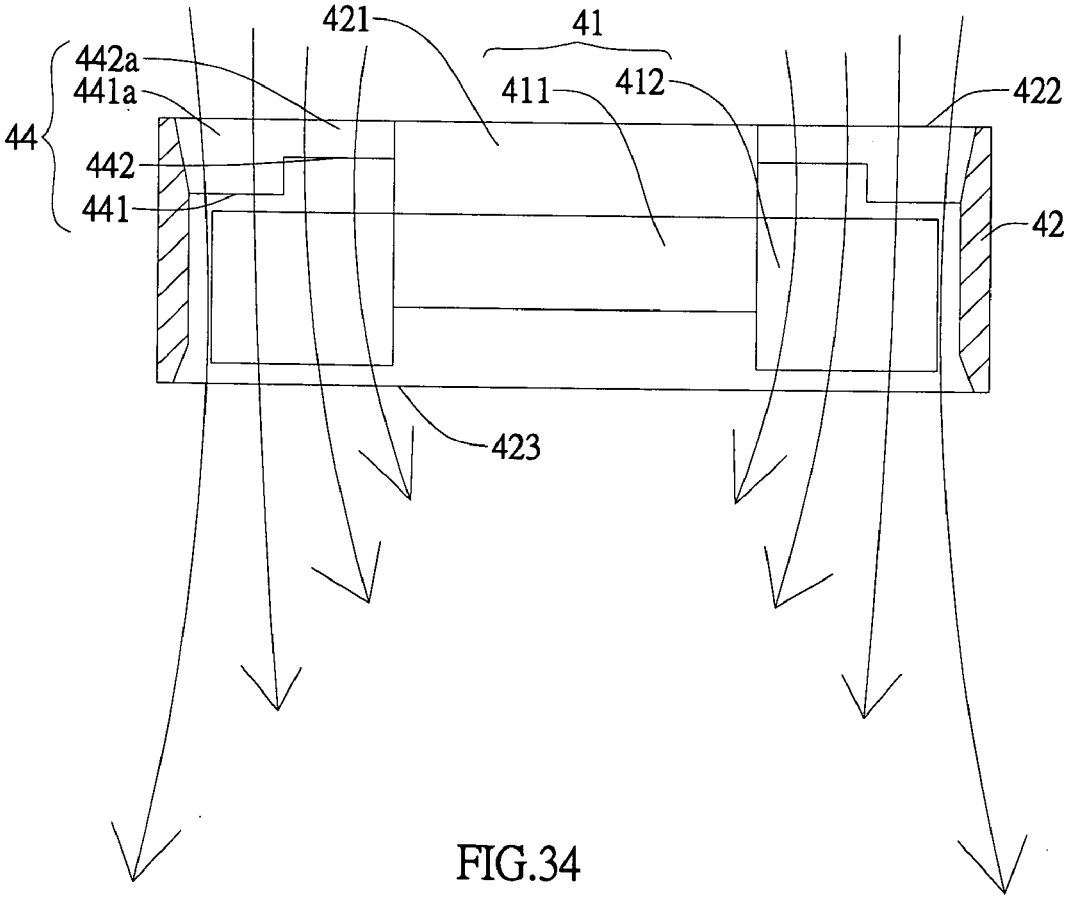
FIG. 34 is a cross sectional view of the outlet airflow direction control device of FIG. 31 showing airflow directions at an outlet of the device.

Please refer to FIG. 34. When the blades 412 of the fan 41 are rotated, a non-constant flow field is produced to cause the fluid to flow into the frame 42 via the inlet 422 and out of the frame 42 via the outlet 423. When the fluid flows through the inlet 422, it is controlled by the area 441*a* of the directional-guide section 441 of the directional-guide blades 44 and is subject to a relatively large radial pressure to flow toward a center of the hub 411. When the fluid passes through the rotating blades 412 and the outlet 423, it flows toward a center behind the hub 411 of the fan 41. That is, there is an increased amount of the fluid flown to a rear side of the hub 411 to reduce a dead-air zone behind the hub 411. Therefore, the outlet airflow direction control device of the present invention may be used to carry heat produced in a system to external environments at a largely upgraded radiation efficiency to provide an enhanced radiation effect.

Figure 35:
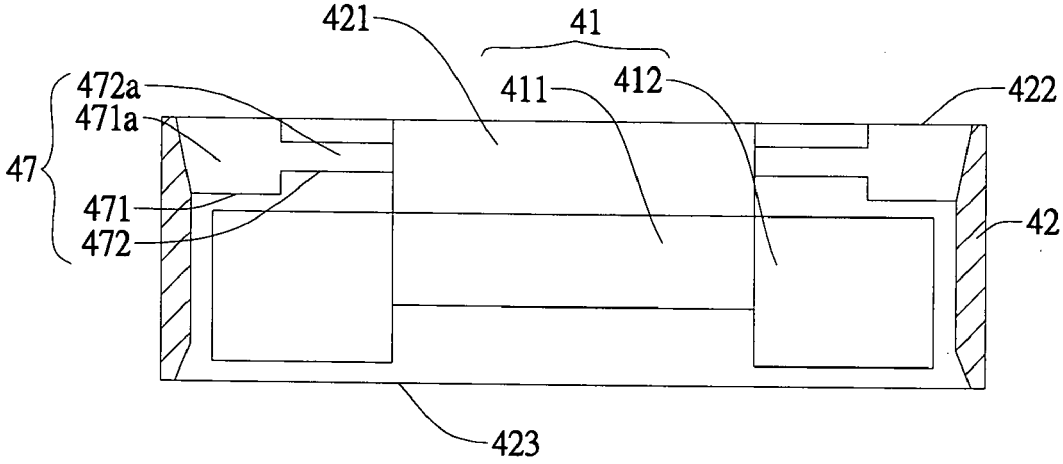
FIG. 35 shows a variant of the directional-guide blade included in the seventh embodiment of the present invention.
Figure 36:
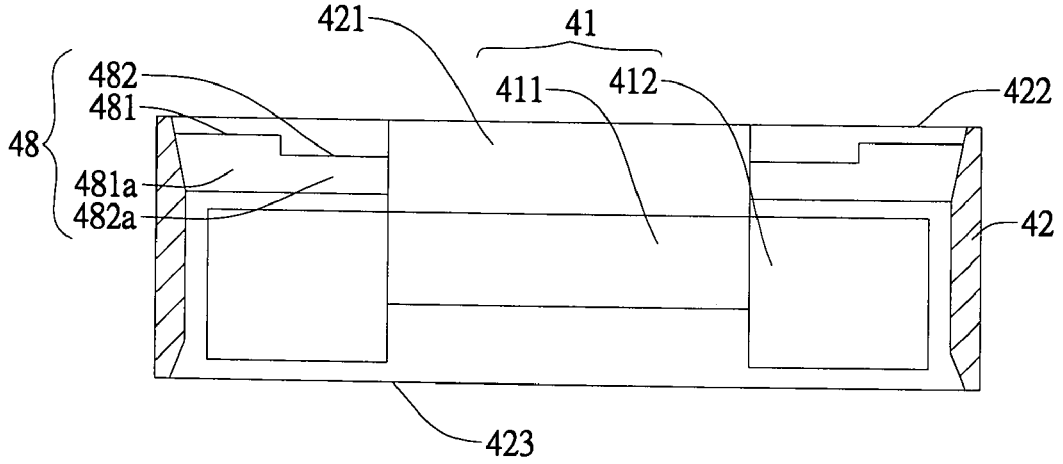
FIG. 36 shows another variant of the directional-guide blade included in the seventh embodiment of the present invention.
Figure 37:
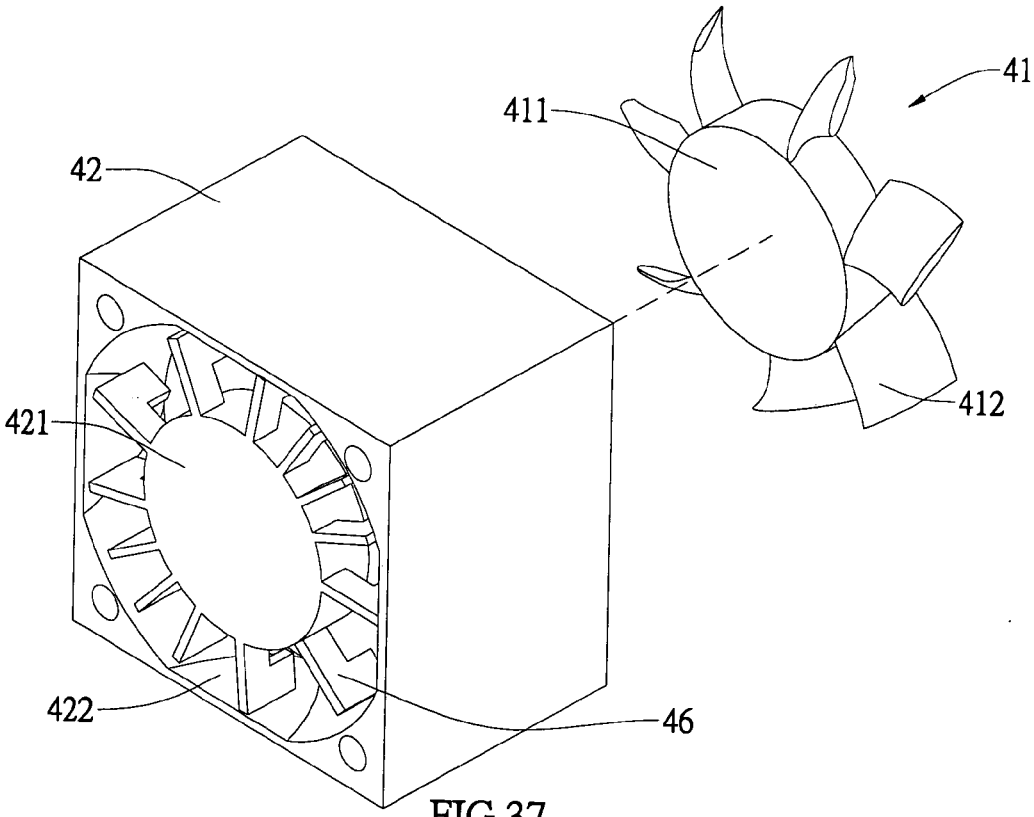
FIG. 37 is a front exploded perspective view of an outlet airflow direction control device according to an eighth embodiment of the present invention.
Figure 38:
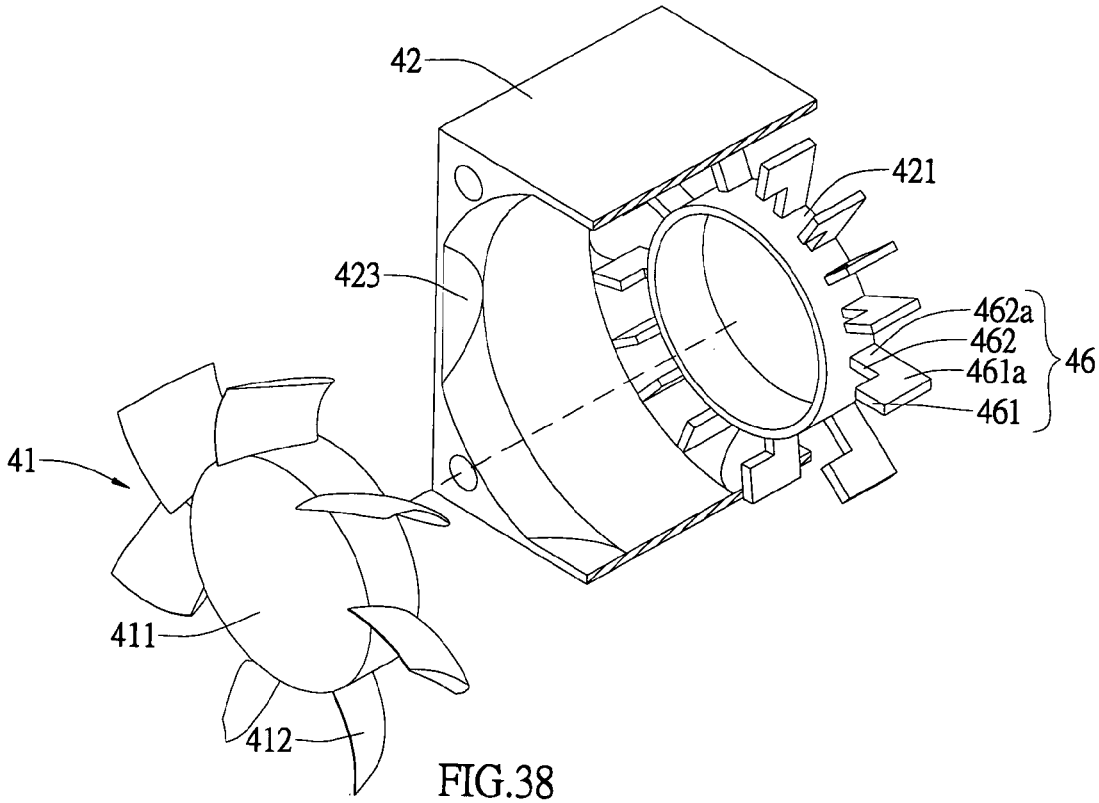
FIG. 38 is a rear exploded and partially cutaway perspective view of the outlet airflow direction control device of FIG. 37.
Figure 39:
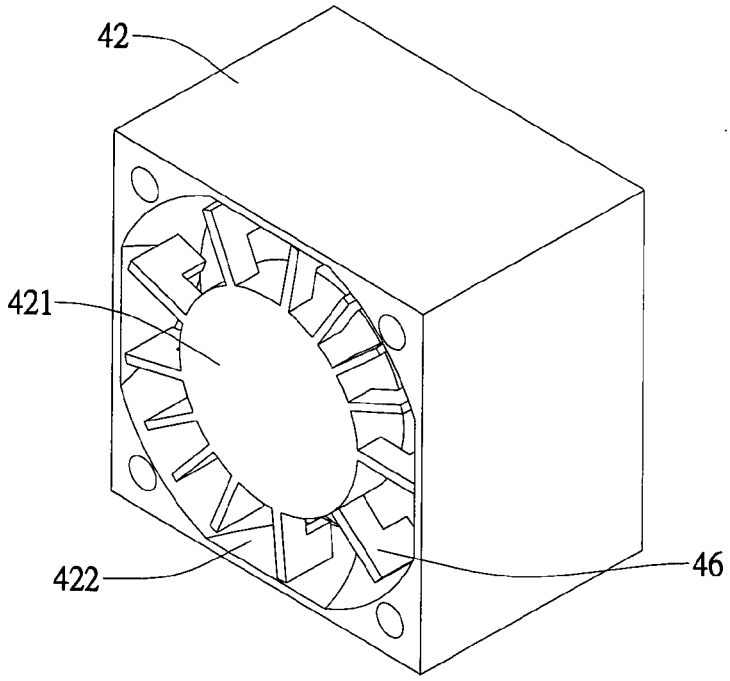
FIG. 39 is a front assembled perspective view of the outlet airflow direction control device of FIG. 37.
Figure 40:
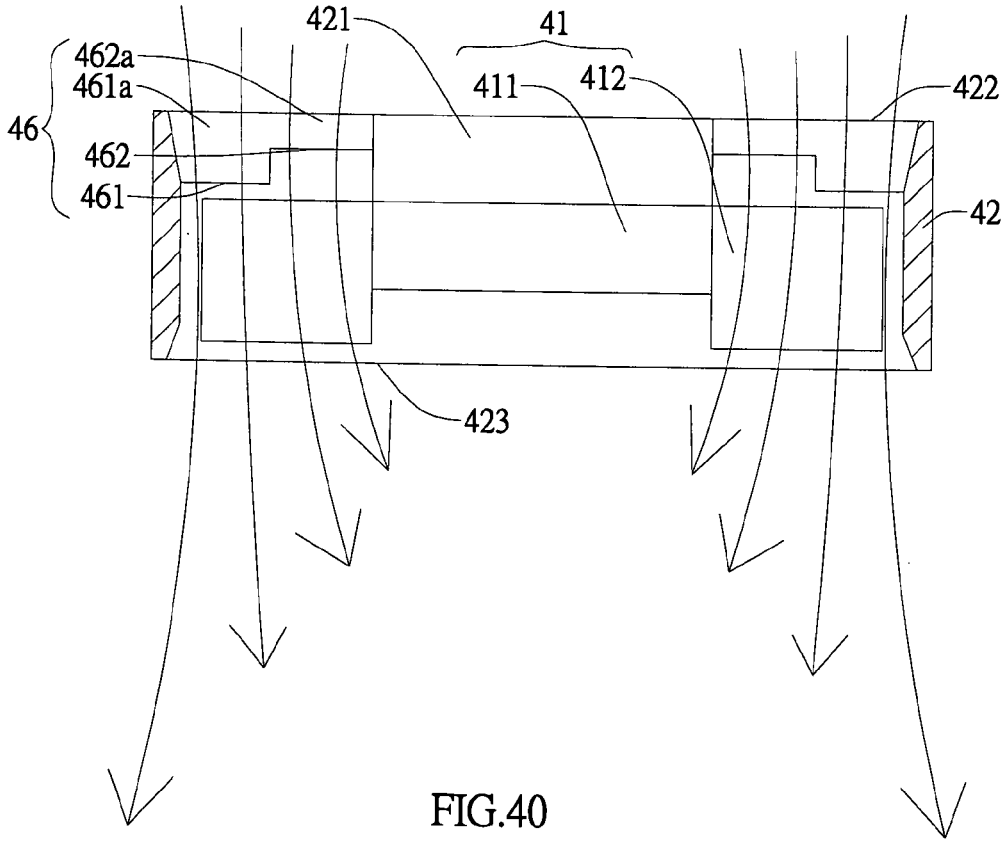
FIG. 40 is a cross sectional view of the outlet airflow direction control device of FIG. 37 showing airflow directions at an outlet of the device.

Please refer to FIGS. 34, 35, and 36. The directional-guide blade 44 for the present invention may be differently configured, such as T-shaped and L-shaped blades 47, 48, as shown in FIGS. 35 and 36, respectively. The T-shaped directional-guide blade 47 includes a directional-guide section 471 having an area 471*a*, and a connecting section 472 having an area 472*a*. The area 471*a* is larger than the area 472*a*. The L-shaped directional-guide blade 48 includes a directional-guide section 481 having an area 481*a*, and a connecting section 482 having an area 482*a*. The area 481*a* is larger than the area 482*a*. All the above two types of directional-guide blades are adapted to change the radial pressure against the fluid passing through the outlet 423 to achieve the effect of controlling the flow direction of the fluid and producing enhanced radiating power.

Please refer to FIGS. 37, 38, 39, and 40 that are front exploded, rear exploded, front assembled, and cross sectional views, respectively, of an outlet airflow direction control device according to an eighth embodiment of the present invention. As shown, the eighth embodiment is structurally and functionally similar to the seventh embodiment, except that the hub seat 421 at the inlet 422 of the frame 42 of the eighth embodiment is formed on a peripheral wall thereof with a plurality of radially projected ribs 46. Each of the ribs 46 includes an outer end forming a directional-guide section 161 having an area 661*a*, and an inner end forming a connecting section 462 having an area 462*a*. The area 461*a* is larger than the area 462*a*, so that the ribs 46 are adapted to change the radial pressure against the fluid flowing through the frame 42 and thereby achieve the effect of controlling the flow direction of the fluid and producing enhanced radiating power.

Figure 41:
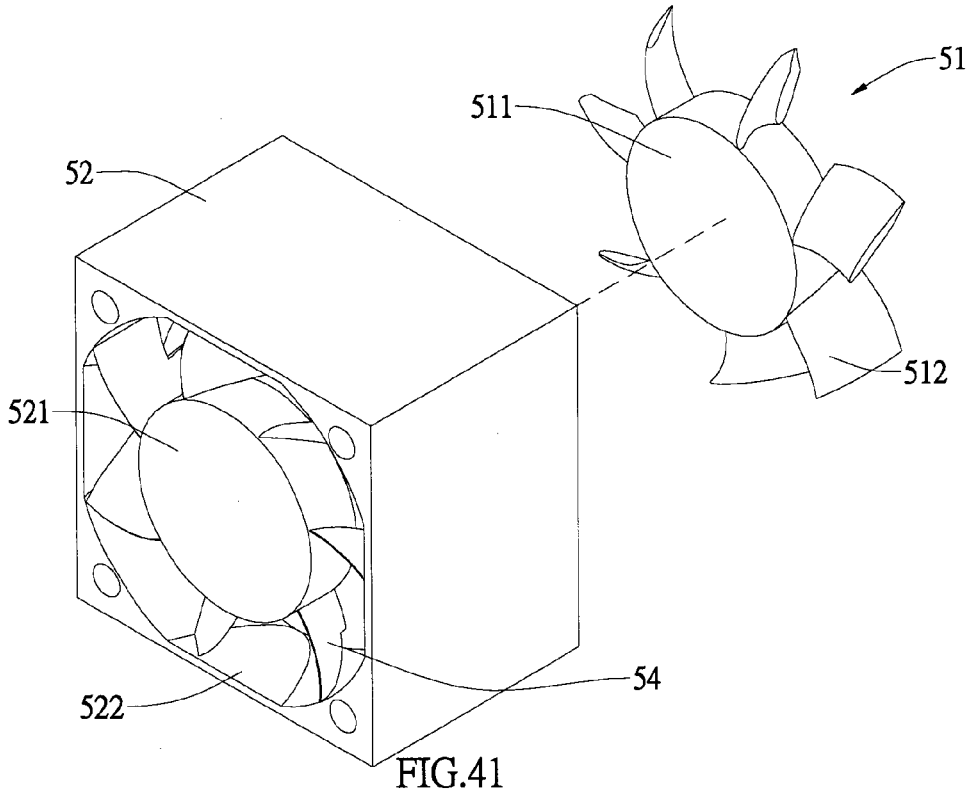
FIG. 41 is a front exploded perspective view of an outlet airflow direction control device according to a ninth embodiment of the present invention.
Figure 42:
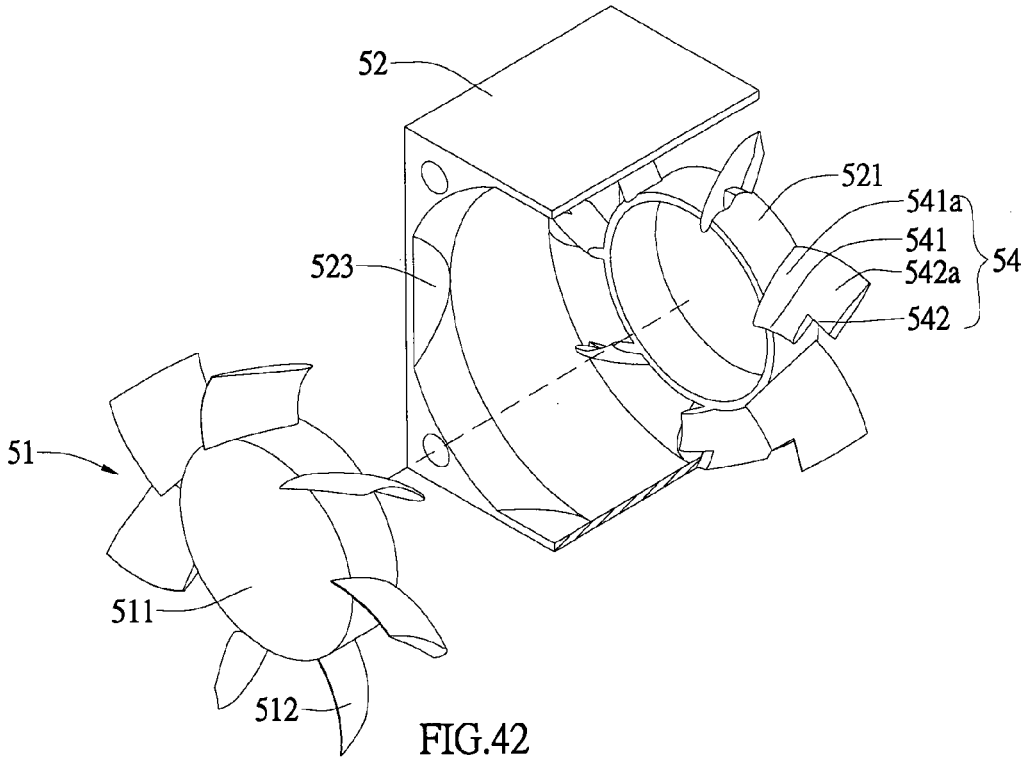
FIG. 42 is a rear exploded and partially cutaway perspective view of the outlet airflow direction control device of FIG. 41.
Figure 43:
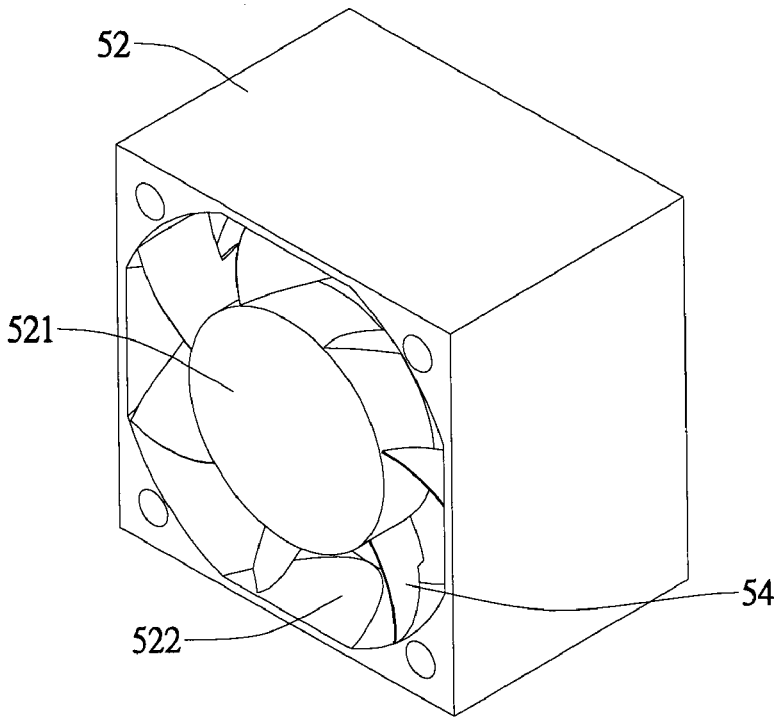
FIG. 43 is a front assembled perspective view of the outlet airflow direction control device of FIG. 41.

Please refer to FIGS. 41, 42, and 43, in which an outlet airflow direction control device according to a ninth embodiment of the present invention is shown. As shown, the outlet airflow direction control device mainly includes a fan 51 and a frame 52. The frame 52 includes an inlet 522 and an outlet 523 via which an amount of fluid flows into and out of the frame 52. The fan 51 includes a hub 511 and a plurality of blades 512. The frame 52 is also internally provided with a hub seat 521 corresponding to the hub 511 of the fan 51 so as to support the fan 51 in the frame 52 by mounting the hub 511 to the hub seat 521. The hub seat 521 at the inlet 522 of the frame 52 is formed on an outer circumferential surface with a plurality of radially projected directional-guide blades 54. Each of the directional-guide blades 54 is connected at an inner end, which forms a directional-guide section 541 of the directional-guide blade 54, to the hub seat 521, and at an outer end, which forms a connecting section 542 of the directional-guide blade 54, to the frame 52. It is noted the directional-guide section 541 has an area 541*a* larger than an area 542*a* of the connecting section 542. The directional-guide blades 54 are adapted to change a radial pressure against the fluid flowing through the frame 52, and thereby achieve the effect of controlling the flow direction of the fluid.

Figure 44:
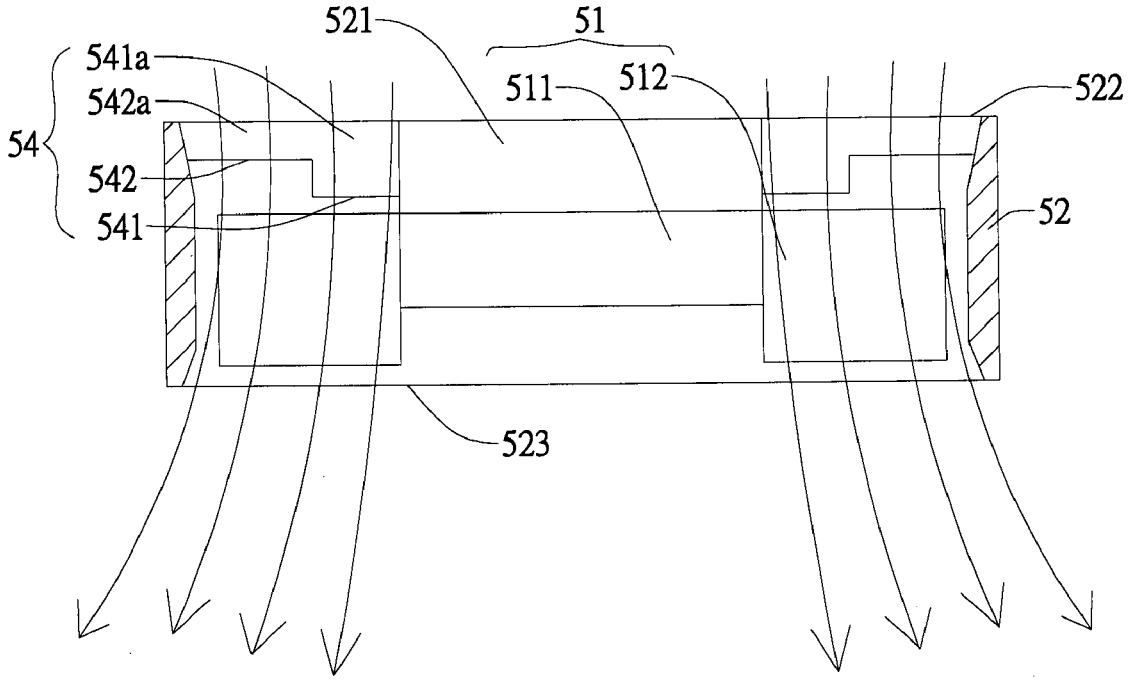
FIG. 44 is a cross sectional view of the outlet airflow direction control device of FIG. 41 showing airflow directions at an outlet of the device.

Please refer to FIG. 44. When the blades 512 of the fan 51 are rotated, a non-constant flow field is produced to cause the fluid to flow into the frame 52 via the inlet 522 and out of the frame 52 via the outlet 523. When the fluid flows through the inlet 522, it is controlled by the area 541*a* of the directional-guide section 541 of the directional-guide blades 54 and is subject to a relatively large radial pressure to flow toward outer ends of the blades 512. When the fluid passes through the rotating blades 512 and the outlet 523, it diffuses outward into an increased space due to the relatively large radial pressure.

Figure 45:
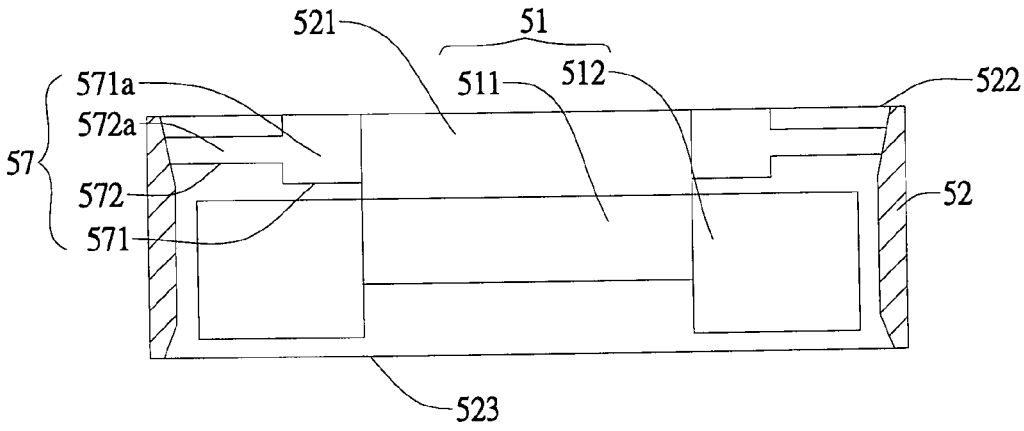
FIG. 45 shows a variant of the directional-guide blade included in the ninth embodiment of the present invention.
Figure 46:
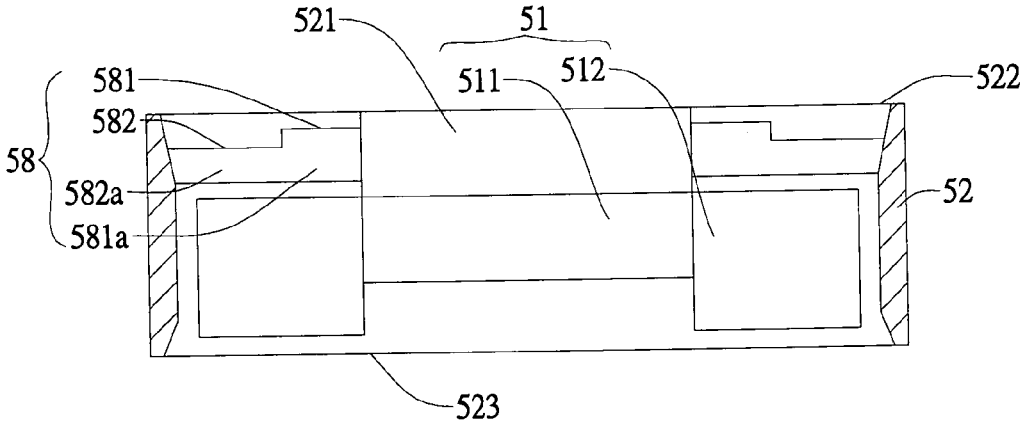
FIG. 46 shows another variant of the directional-guide blade included in the ninth embodiment of the present invention.
Figure 47:
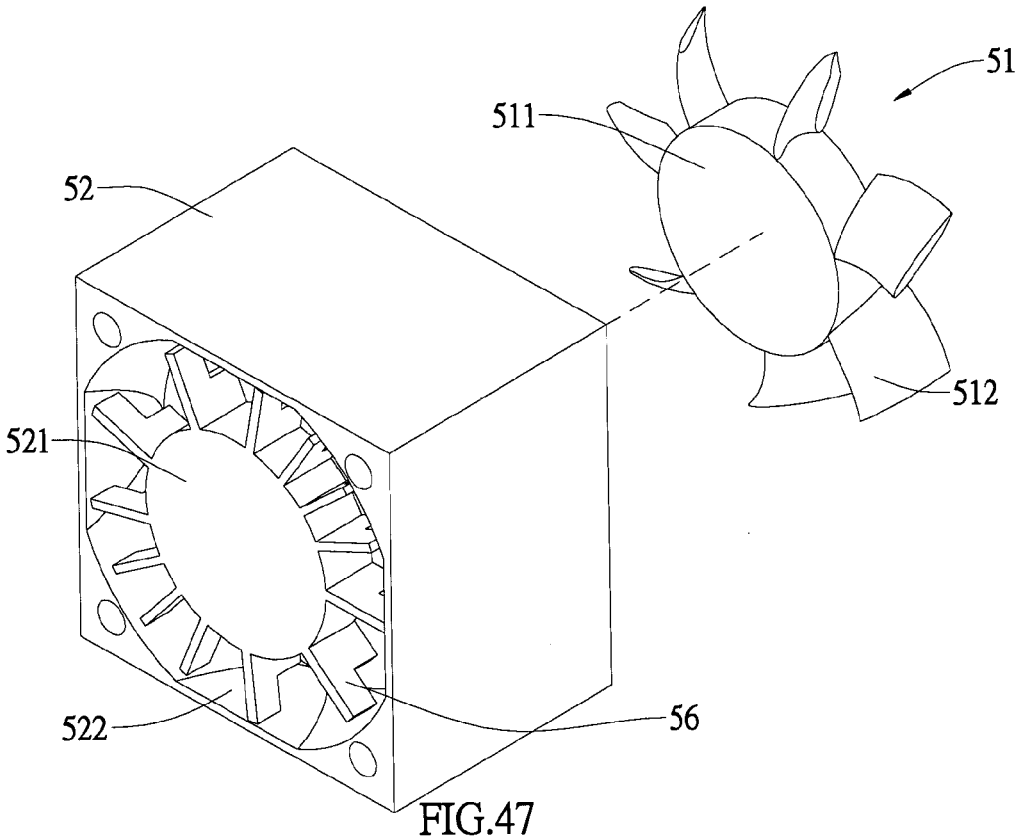
FIG. 47 is a front exploded perspective view of an outlet airflow direction control device according to a tenth embodiment of the present invention.
Figure 48:
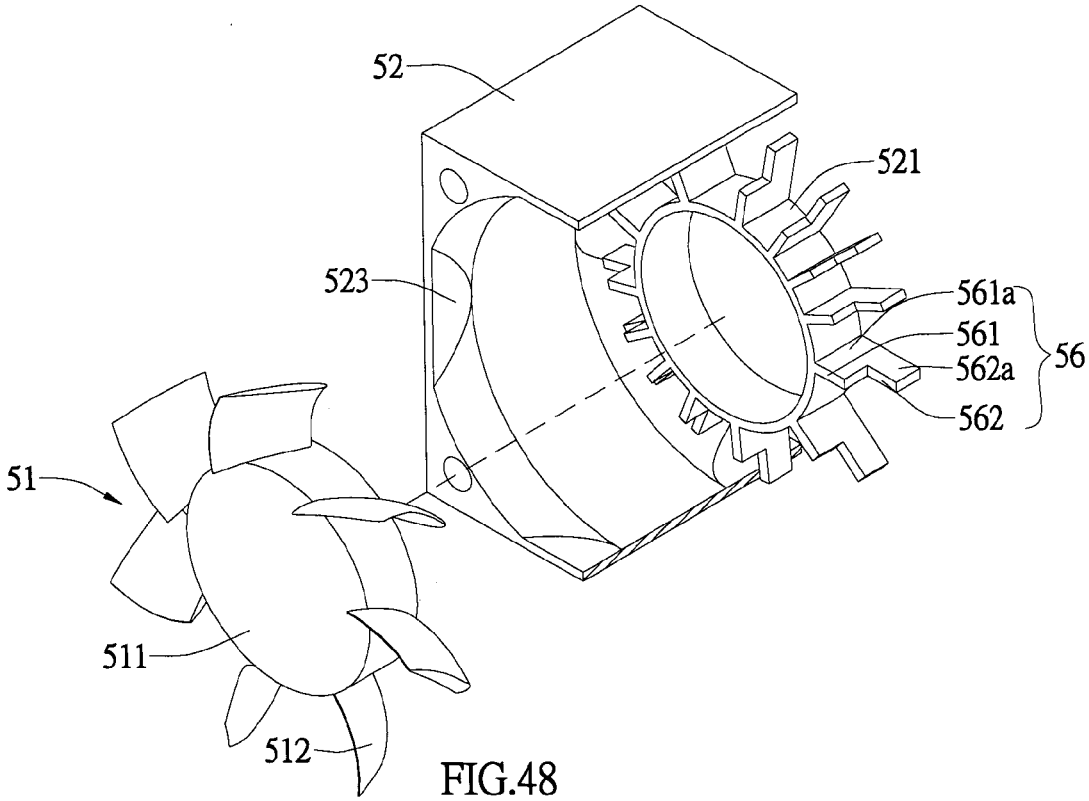
FIG. 48 is a rear exploded and partially cutaway perspective view of the outlet airflow direction control device of FIG. 47.
Figure 49:
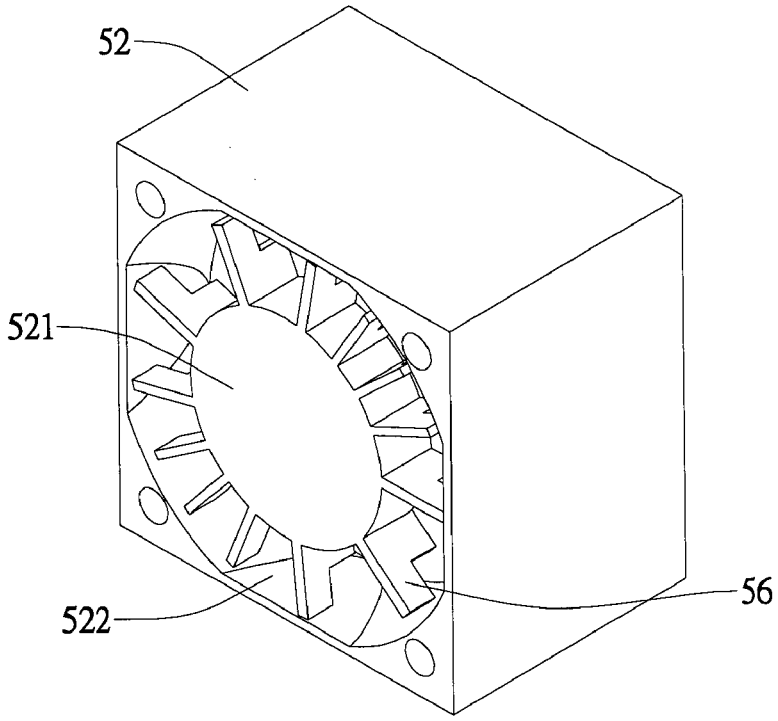
FIG. 49 is a front assembled perspective view of the outlet airflow direction control device of FIG. 47.
Figure 50:
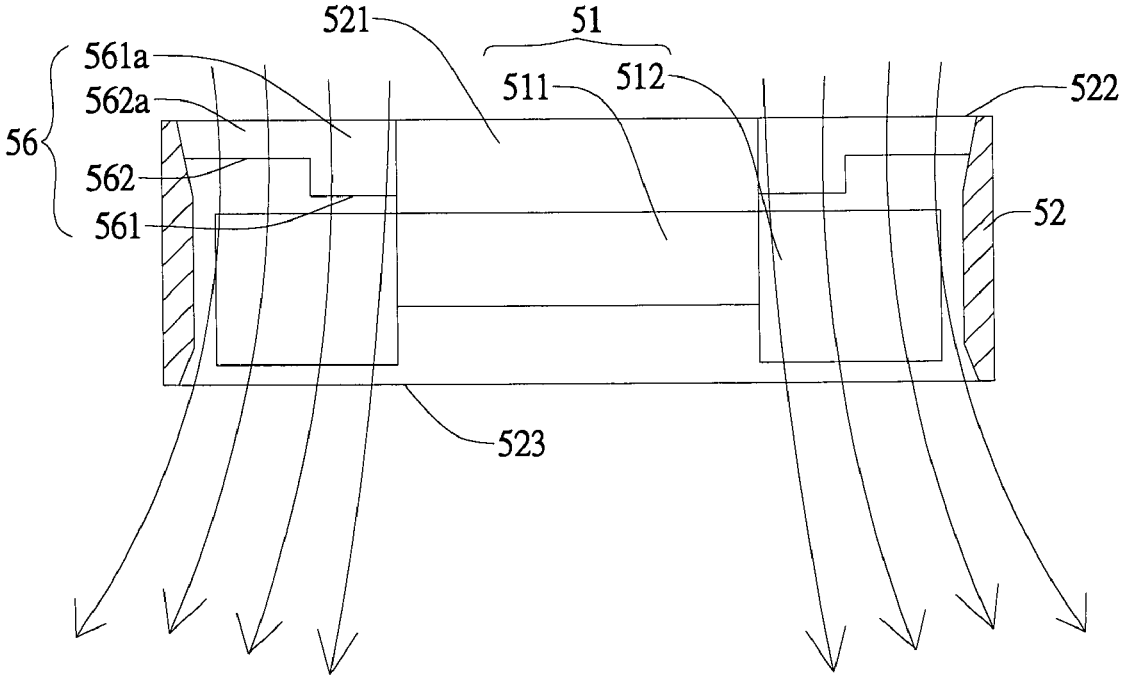
FIG. 50 is a cross sectional view of the outlet airflow direction control device of FIG. 47 showing airflow directions at an outlet of the device.

Please refer to FIGS. 44, 45, and 46. The directional-guide blade 54 for the present invention may be differently configured, such as T-shaped and L-shaped blades 57, 58, as shown in FIGS. 45 and 46, respectively. The T-shaped directional-guide blade 57 includes a directional-guide section 571 having an area 571*a*, and a connecting section 572 having an area 572*a*. The area 571*a* is larger than the area 572*a*. The L-shaped directional-guide blade 58 includes a directional-guide section 581 having an area 581*a*, and a connecting section 582 having an area 582*a*. The area 581*a* is larger than the area 582*a*. All the above two types of directional-guide blades are adapted to change the radial pressure against the fluid passing through the outlet 523 to achieve the effect of controlling the flow direction of the fluid.

Please refer to FIGS. 47, 48, 49, and 50 that are front exploded, rear exploded, front assembled, and cross sectional views, respectively, of an outlet airflow direction control device according to a tenth embodiment of the present invention. As shown, the tenth embodiment is structurally and functionally similar to the ninth embodiment, except that the hub seat 521 at the inlet 522 of the frame 52 of the tenth embodiment is formed on a peripheral wall thereof with a plurality of radially projected ribs 56. Each of the ribs 56 includes an outer end forming a directional-guide section 561 having an area 561*a*, and an inner end forming a connecting section 562 having an area 562*a*. The area 561*a* is larger than the area 562*a*, so that the ribs 56 are adapted to change the radial pressure against the fluid flowing through the frame 52 and thereby achieve the effect of controlling the flow direction of the fluid.

Figure 51:
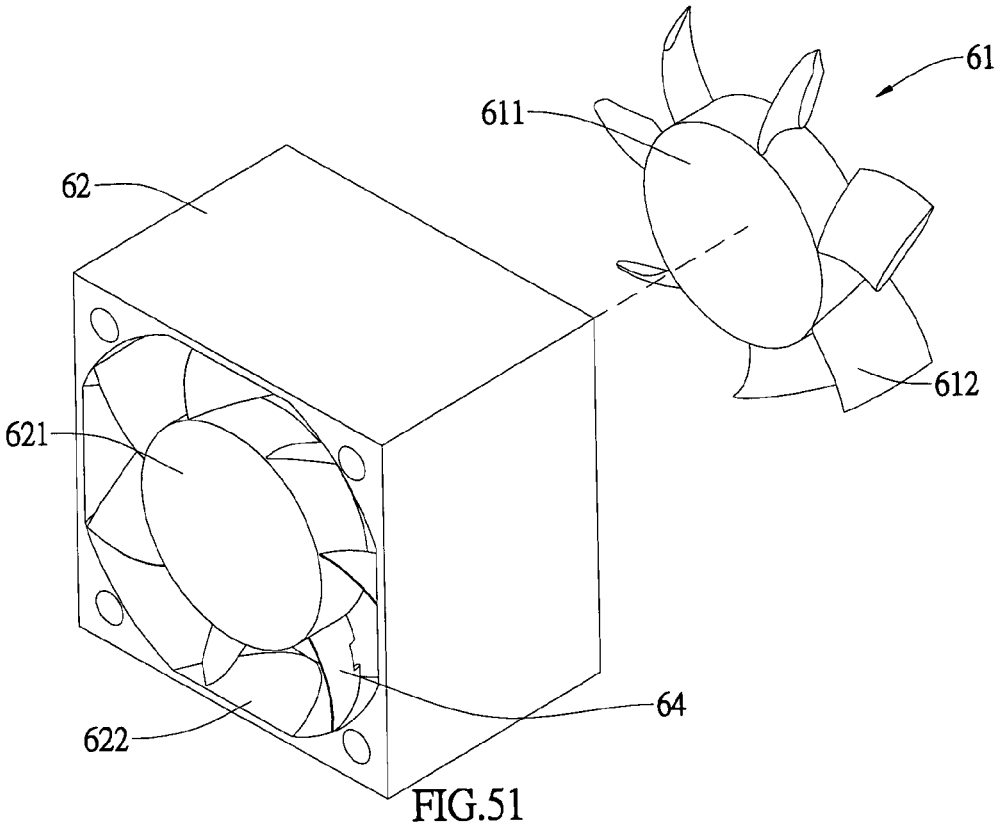
FIG. 51 is a front exploded perspective view of an outlet airflow direction control device according to an eleventh embodiment of the present invention.
Figure 52:
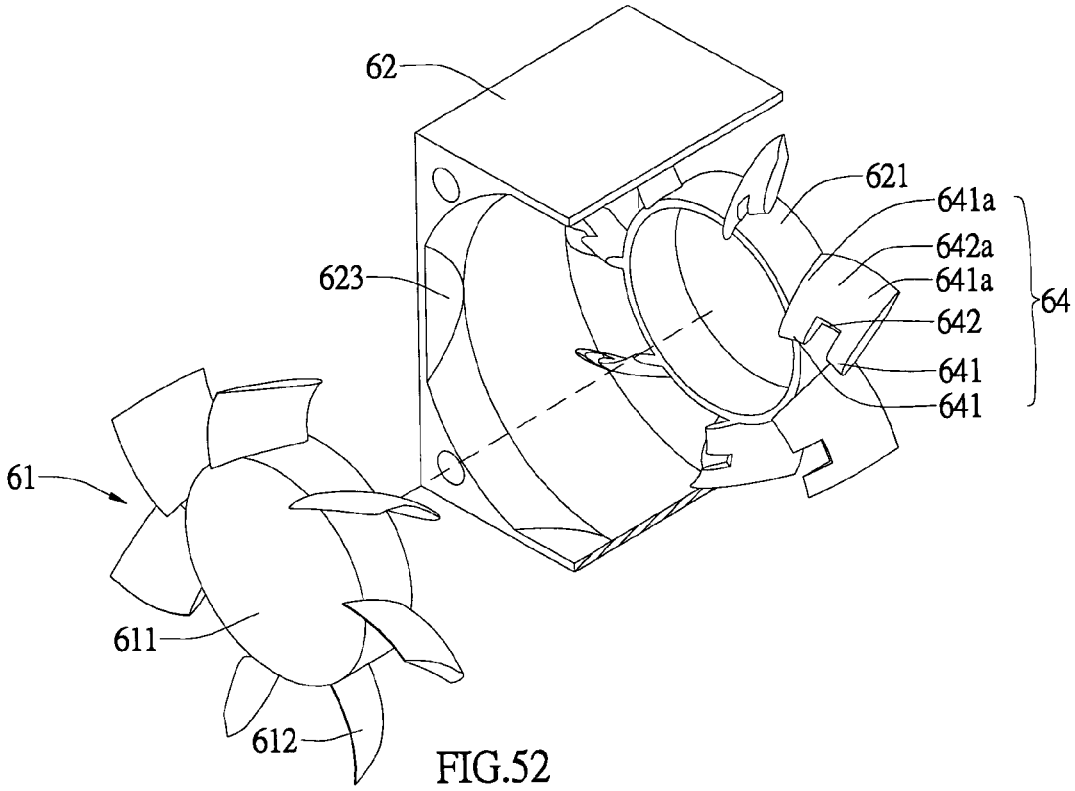
FIG. 52 is a rear exploded and partially cutaway perspective view of the outlet airflow direction control device of FIG. 51.
Figure 53:
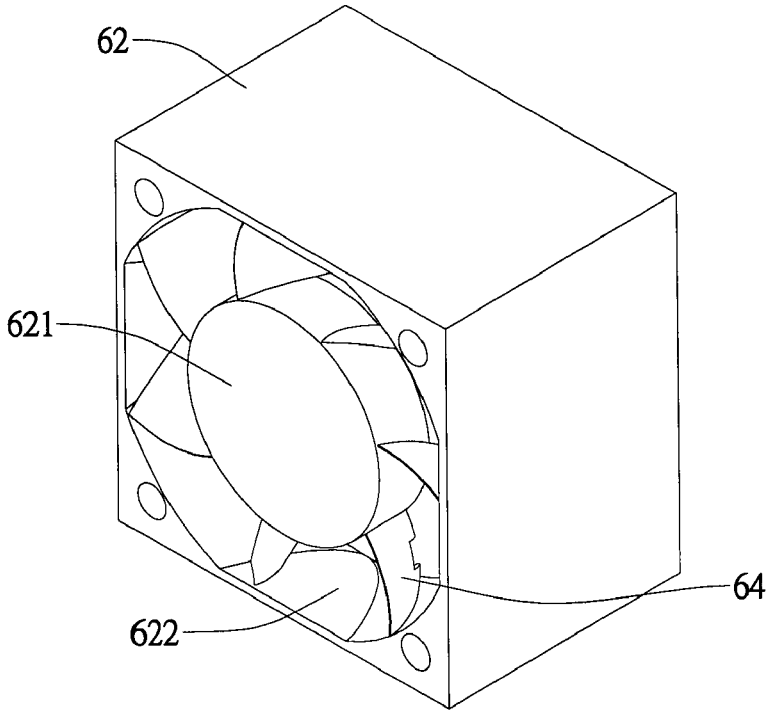
FIG. 53 is a front assembled perspective view of the outlet airflow direction control device of FIG. 51.

Please refer to FIGS. 51, 52, and 53, in which an outlet airflow direction control device according to an eleventh embodiment of the present invention is shown. As shown, the outlet airflow direction control device mainly includes a fan 61 and a frame 62. The frame 62 includes an inlet 622 and an outlet 623 via which an amount of fluid flows into and out of the frame 62. The fan 61 includes a hub 611 and a plurality of blades 612. The frame 62 is also internally provided with a hub seat 621 corresponding to the hub 611 of the fan 61 so as to support the fan 61 in the frame 62 by mounting the hub 611 to the hub seat 621. The hub seat 621 at the inlet 622 of the frame 62 is formed on an outer circumferential surface with a plurality of radially projected directional-guide blades 64. Each of the directional-guide blades 64 is connected at outer and inner end, which form two directional-guide sections 641 of the directional-guide blade 64, to the frame 62 and the hub seat 621, respectively. A middle portion of the directional-guide blade 64 is a connecting section 642 that connects the two directional-guide sections 641 to each other. It is noted the directional-guide section 641 has an area 641*a* larger than an area 642*a* of the connecting section 642. The directional-guide blades 64 are adapted to change a radial pressure against the fluid flowing through the frame 62 and thereby achieve the effect of controlling the direction in which the fluid at the outlet 323 flows.

Figure 54:
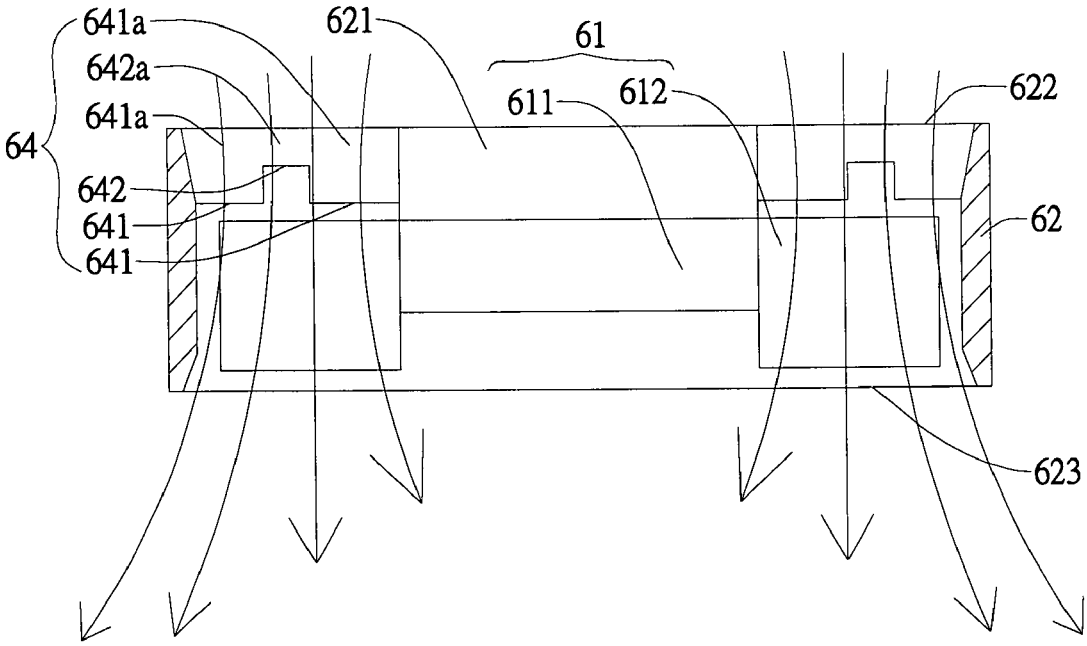
FIG. 54 is a cross sectional view of the outlet airflow direction control device of FIG. 51 showing airflow directions at an outlet of the device.

Please refer to FIG. 54. When the blades 612 of the fan 61 are rotated, a non-constant flow field is produced to cause the fluid to flow into the frame 62 via the inlet 622 and out of the frame 62 via the outlet 623. When the fluid flows through the inlet 622, it is controlled by the areas 641*a* of the directional-guide sections 641 of the directional-guide blades 64 and is subject to a relatively large radial pressure to flow toward the hub 611 and outer ends of the blades 612. When the fluid passes through the rotating blades 612 and the outlet 623, it flows toward a center behind the hub 611 of the fan 61 and diffuse outward. That is, there is an increased amount of the fluid flown to a rear side of the hub 611 to reduce a dead-air zone behind the hub 611. Therefore, the outlet airflow direction control device of the present invention may be used to carry heat produced in a system to external environments at a largely upgraded radiation efficiency to provide an enhanced radiation effect.

Figure 55:
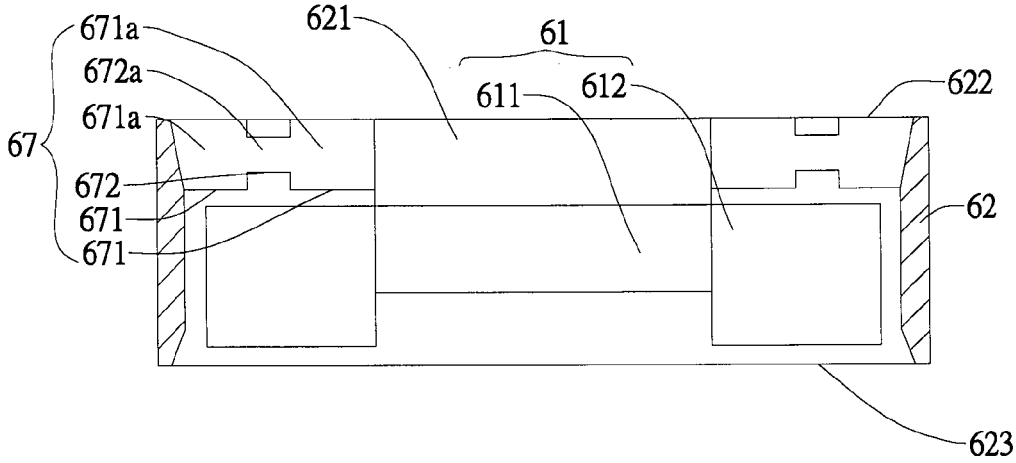
FIG. 55 shows a variant of the directional-guide blade included in the eleventh embodiment of the present invention.
Figure 56:
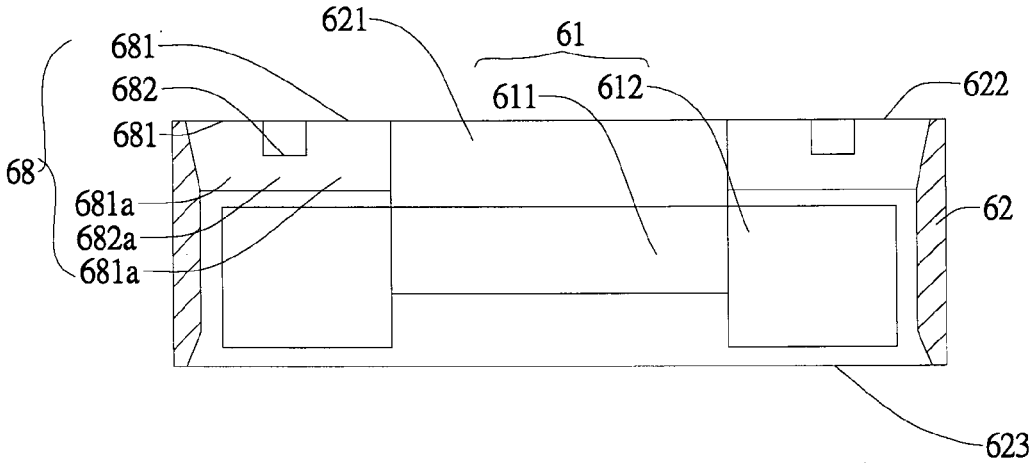
FIG. 56 shows another variant of the directional-guide blade included in the eleventh embodiment of the present invention.
Figure 57:
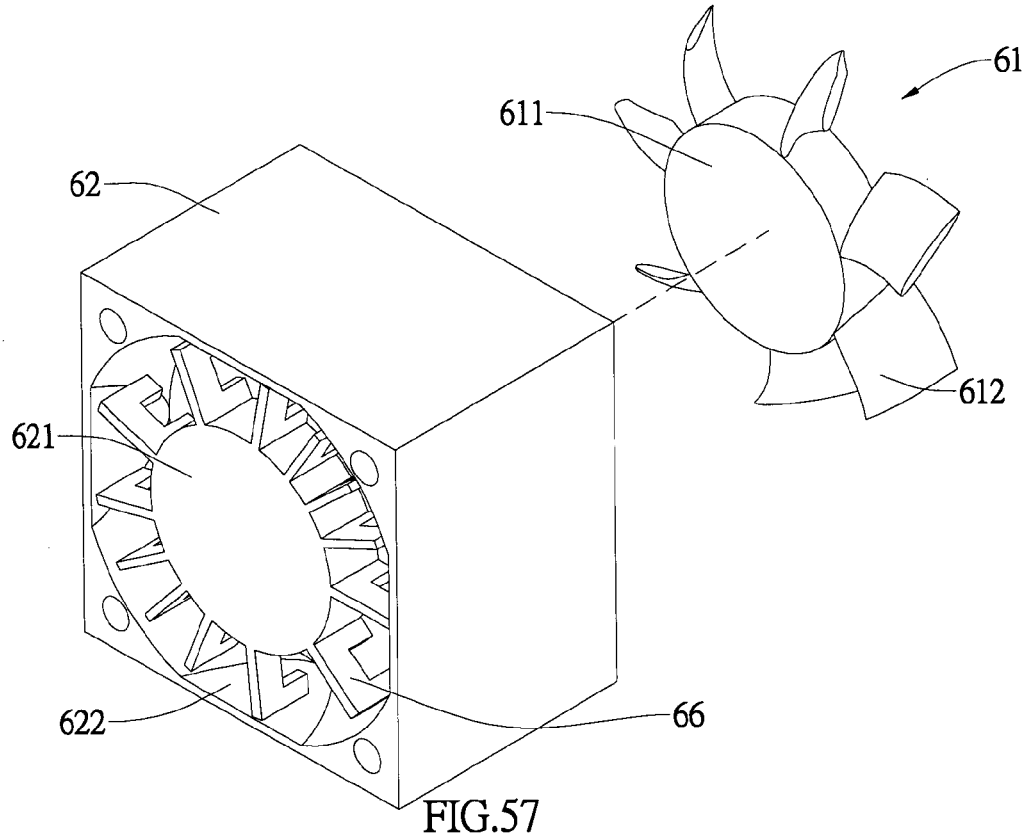
FIG. 57 is a front exploded perspective view of an outlet airflow direction control device according to a twelfth embodiment of the present invention.
Figure 58:
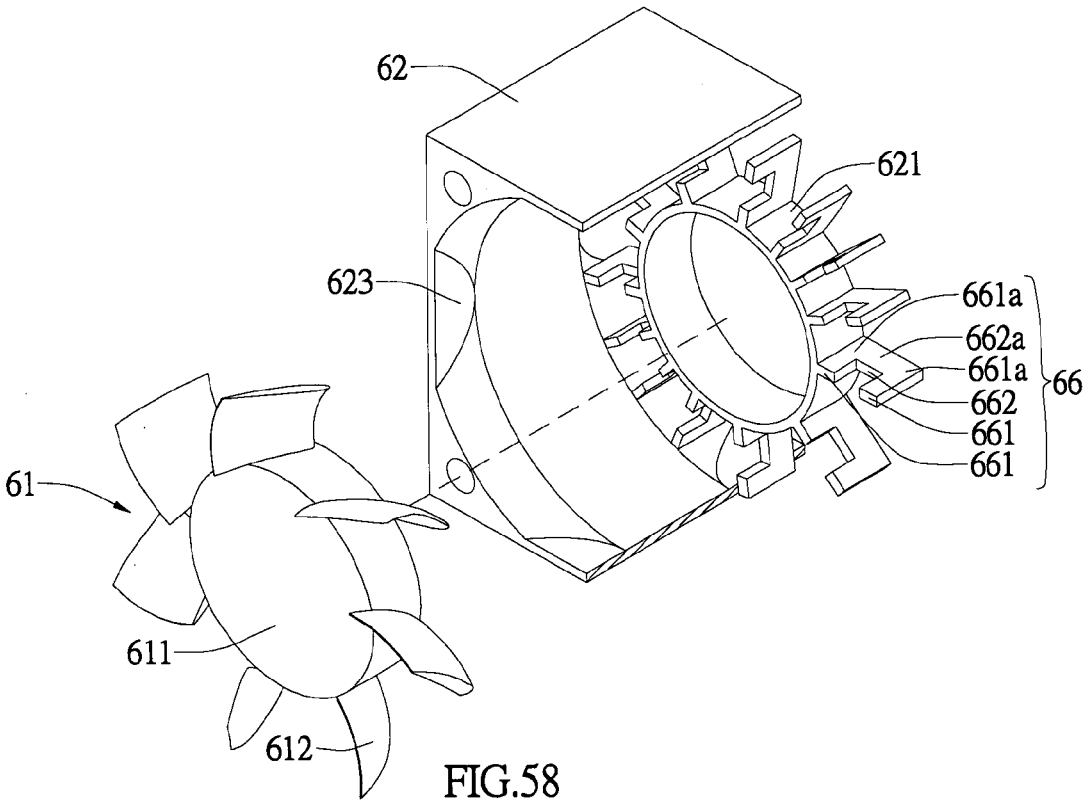
FIG. 58 is a rear exploded and partially cutaway perspective view of the outlet airflow direction control device of FIG. 57.
Figure 59:
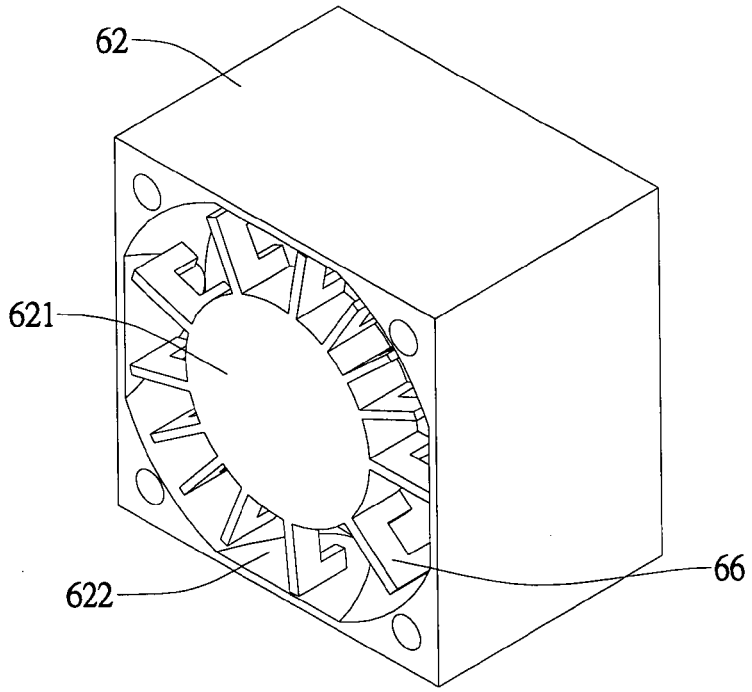
FIG. 59 is a front assembled perspective view of the outlet airflow direction control device of FIG. 57.
Figure 60:
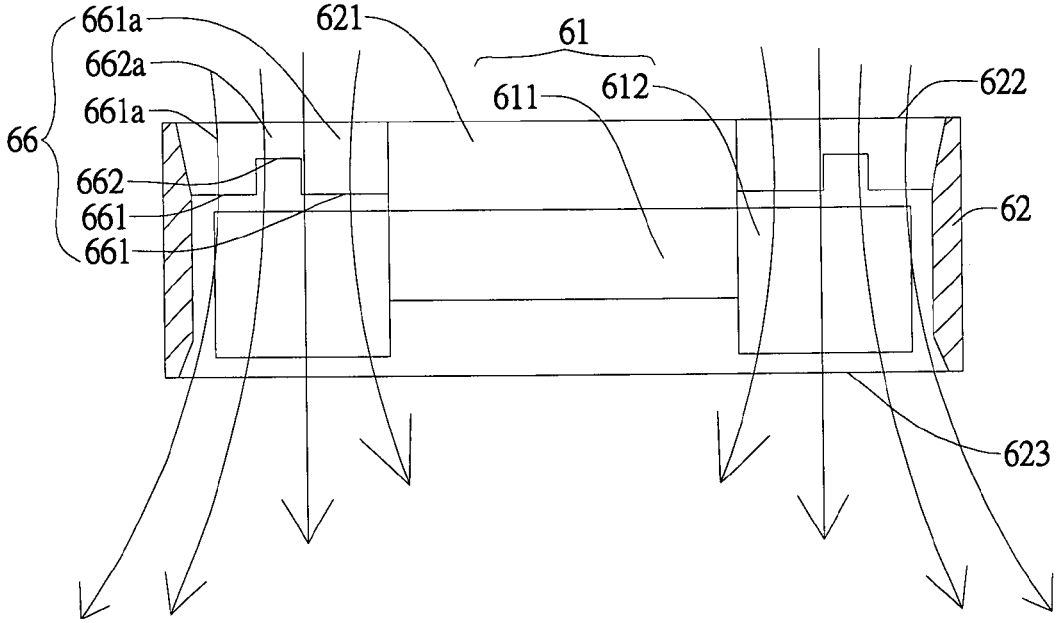
FIG. 60 is a cross sectional view of the outlet airflow direction control device of FIG. 57 showing airflow directions at an outlet of the device.

Please refer to FIGS. 54, 55, and 56. The directional-guide blade 64 for the present invention may be differently configured, such as H-shaped and U-shaped blades 67, 68, as shown in FIGS. 55 and 56, respectively. The H-shaped directional-guide blade 67 includes two directional-guide sections 671 each having an area 671*a*, and a connecting section 672 having an area 672*a*. The area 671*a* is larger than the area 672*a*. The U-shaped directional-guide blade 68 includes two directional-guide sections 681 each having an area 681*a*, and a connecting section 682 having an area 682*a*. The area 681*a* is larger than the area 682*a*. All the above two types of directional-guide blades are adapted to change the radial pressure against the fluid passing through the outlet 623 to achieve the effect of controlling the flow direction of the fluid and producing enhanced radiating power.

Please refer to FIGS. 57, 58, 59, and 60 that are front exploded, rear exploded, front assembled, and cross sectional views, respectively, of an outlet airflow direction control device according to a twelfth embodiment of the present invention. As shown, the twelfth embodiment is structurally and functionally similar to the eleventh embodiment, except that the hub seat 621 at the inlet 622 of the frame 62 of the twelfth embodiment is formed on a peripheral wall thereof with a plurality of radially projected ribs 66. Each of the ribs 66 includes an outer and an inner end forming two directional-guide sections 661 each having an area 661*a*, and a middle portion forming a connecting section 662 having an area 662*a* to connect the two directional-guide sections 661 to each other. The area 661*a* is larger than the area 662*a*, so that the ribs 66 are adapted to change the radial pressure against the fluid flowing through the frame 62 and thereby achieve the effect of controlling the flow direction of the fluid.

Figure 61:
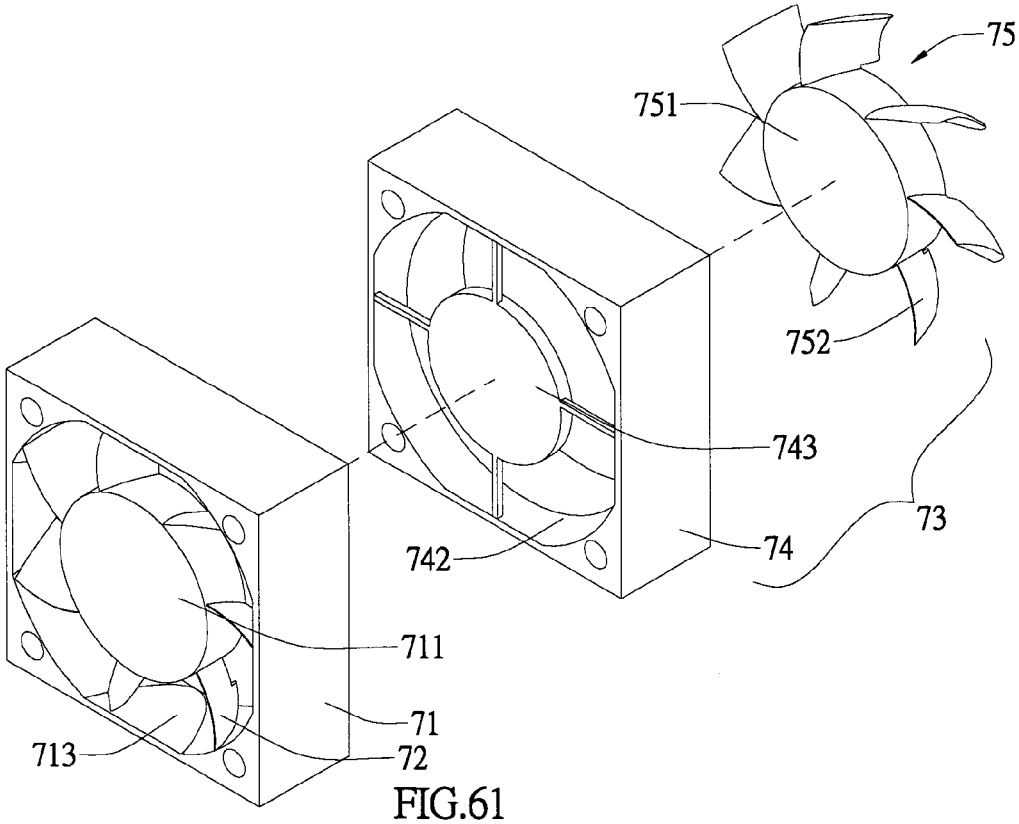
FIG. 61 is a rear exploded perspective view of an outlet airflow direction control device according to a thirteenth embodiment of the present invention.
Figure 62:
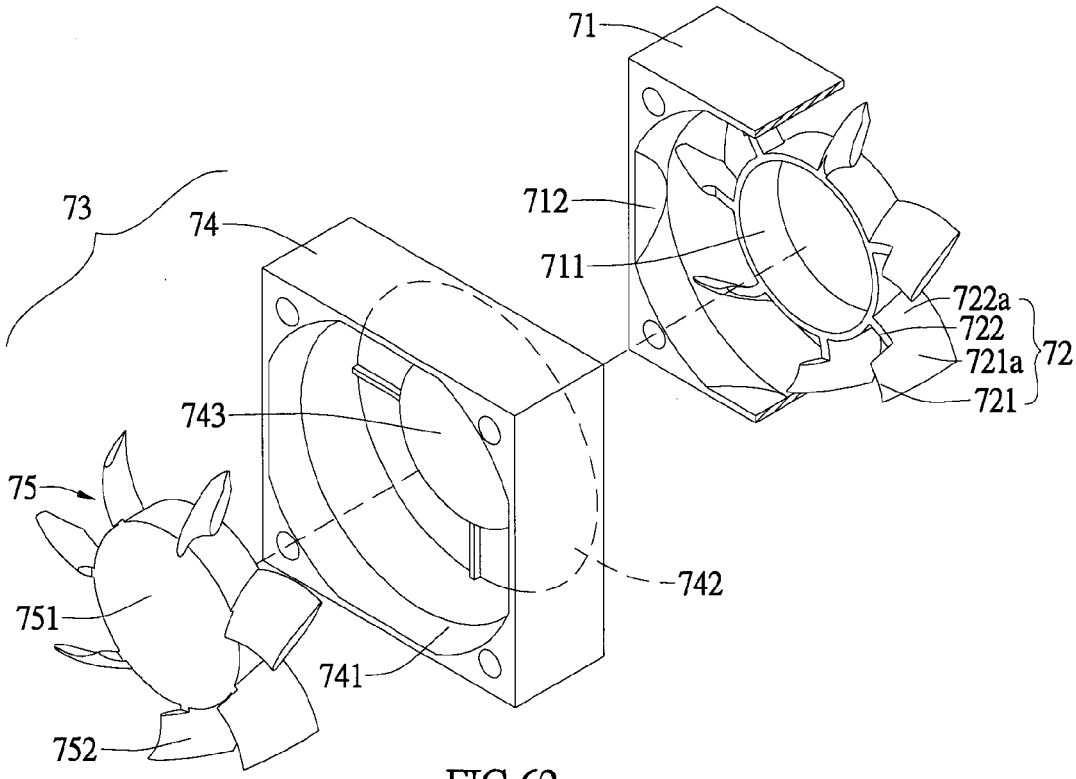
FIG. 62 is a front exploded and partially cutaway perspective view of the outlet airflow direction control device of FIG. 61.
Figure 63:
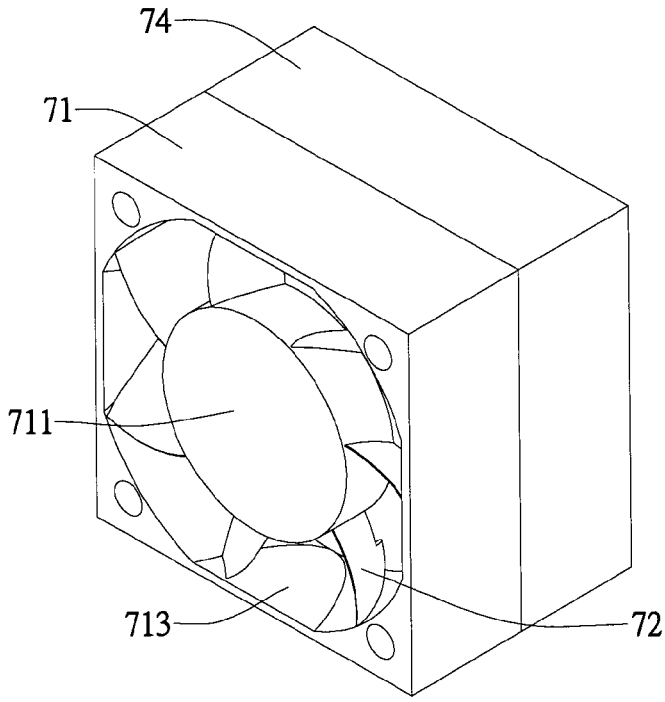
FIG. 63 is a rear assembled perspective view of the outlet airflow direction control device of FIG. 61.

Please refer to FIGS. 61, 62, and 63, in which an outlet airflow direction control device according to a thirteenth embodiment of the present invention is shown. As shown, the thirteenth embodiment includes a frame 71 and a fan module 73. The frame 71 includes an inlet 712 and an outlet 713 via which an amount of fluid flows in and out of the frame 71, respectively. The frame 71 is internally provided with a hub seat 711, on an outer peripheral wall of which a plurality of radially projected directional-guide blades 72 are formed.

The fan module 73 includes a fan frame 74 and a fan 75. The fan frame 74 includes an inlet 741 and an outlet 742, and is internally provided with a support member 743 to which the fan 75 is mounted. The fan 75 consists of a hub 751 and a plurality of blades 752. The hub 751 is supported on the support member 743 to locate the fan 75 in the fan frame 74.

Each of the directional-guide blades 72 is connected at an outer end, which forms a directional-guide section 721 of the directional-guide blade 72, to the frame 71, and at an inner end, which forms a connecting section 722 of the directional-guide blade 72, to the hub seat 711. It is noted the directional-guide section 721 has an area 721*a* larger than an area 722*a* of the connecting section 722. The frame 71 is connected at the inlet 712 to the outlet 742 of the fan module 73. The directional-guide blades 72 are adapted to change a radial pressure against the fluid flowing through the fan module 73 and the frame 71, and thereby control the flow direction of the fluid, so that the fluid flown through the outlet 713 of the frame 71 flows radially inward without quickly diffusing outward. Therefore, directions in which the fluid at the outlet 713 flows may be controlled and a noise produced by the fluid while flowing through the outlet 713 is reduced.

Figure 64:
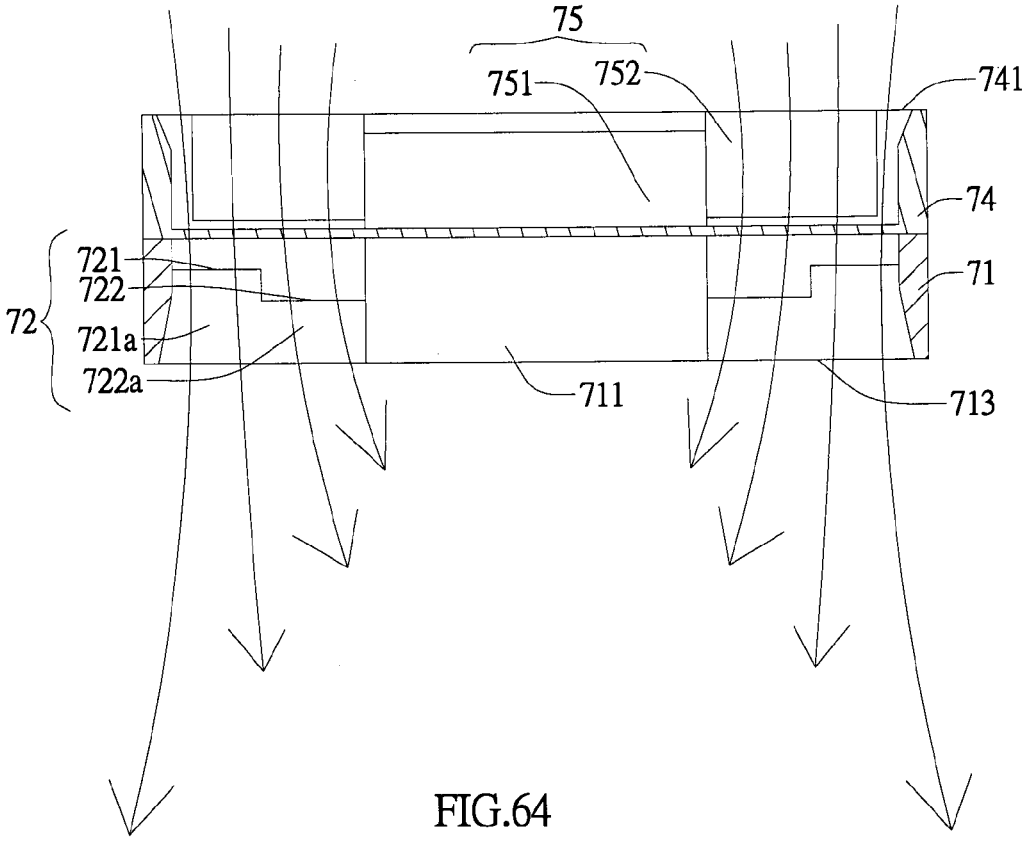
FIG. 64 is a cross sectional view of the outlet airflow direction control device of FIG. 61 showing airflow directions at an outlet of the device.

Please refer to FIGS. 61 and 64. When the blades 752 of the fan 75 are rotated, a non-constant flow field is produced to cause the fluid to flow into the fan module 73 via the inlet 741 thereof, pass through the outlet 742 of the fan module 73 and the inlet 712 of the frame 71, and flow out of the frame 71 via the outlet 713 thereof. When the fluid flows through the frame 71, it is controlled by the areas 721*a* of the directional-guide sections 721 of the radially projected directional-guide blades 72 and is subject to a relatively large radial pressure to therefore flow toward a center behind the hub seat 711. That is, there is an increased amount of the fluid flown to a rear side of the hub seat 711 to reduce a dead-air zone behind the hub seat 711. Therefore, the outlet airflow direction control device of the present invention may be used to carry heat produced in a system to external environments at a largely upgraded radiation efficiency to provide an enhanced radiation effect.

Figure 65:
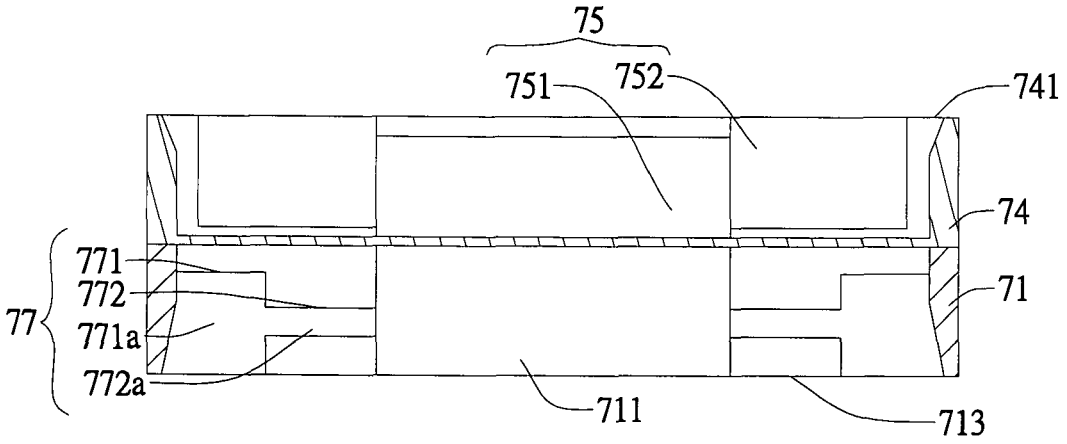
FIG. 65 shows a variant of the directional-guide blade included in the thirteenth embodiment of the present invention.
Figure 66:
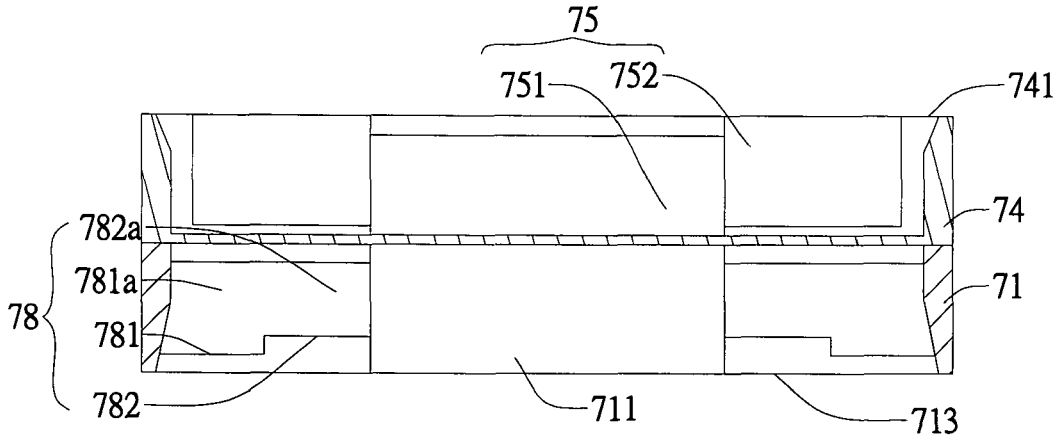
FIG. 66 shows another variant of the directional-guide blade included in the thirteenth embodiment of the present invention.
Figure 67:
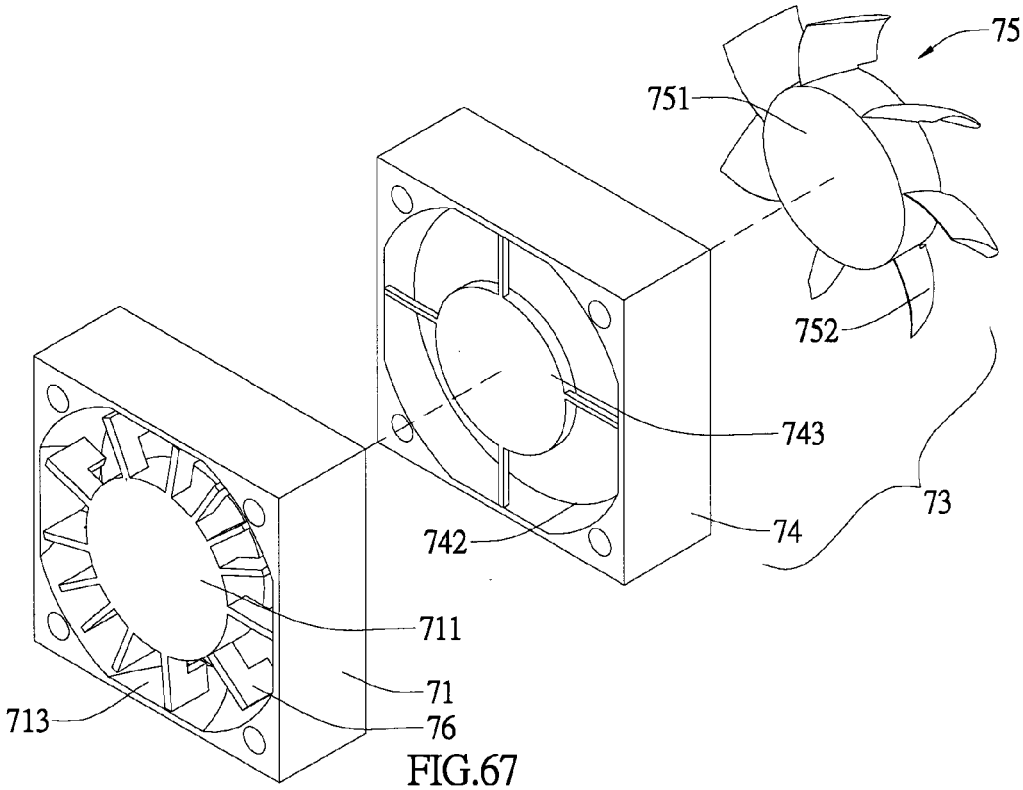
FIG. 67 is a rear exploded perspective view of an outlet airflow direction control device according to a fourteenth embodiment of the present invention.
Figure 68:
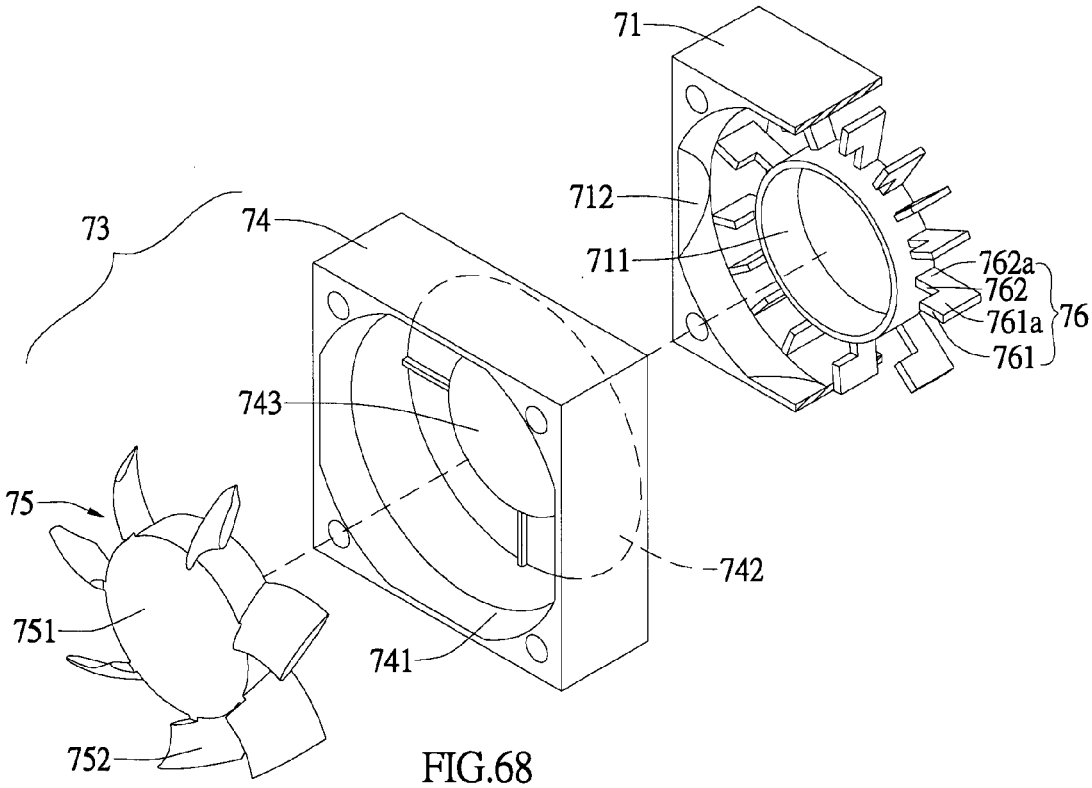
FIG. 68 is a front exploded and partially cutaway perspective view of the outlet airflow direction control device of FIG. 67.
Figure 69:
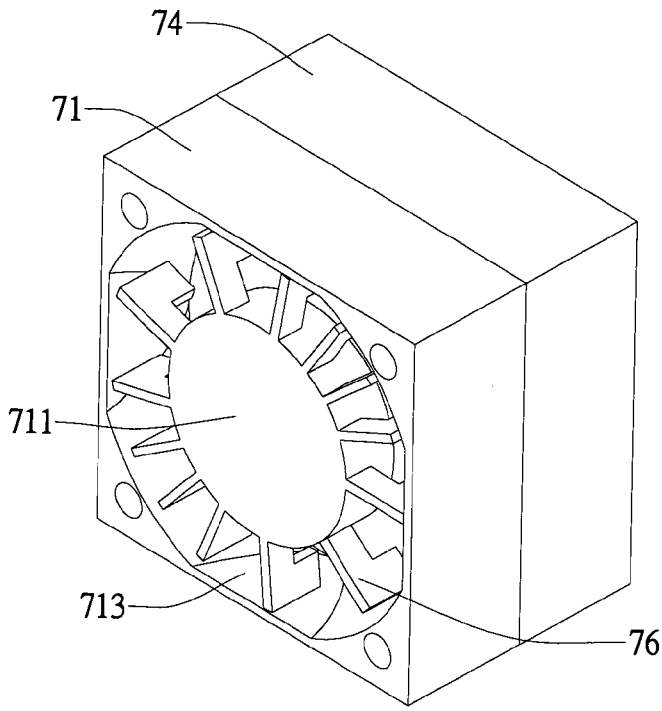
FIG. 69 is a rear assembled perspective view of the outlet airflow direction control device of FIG. 67.
Figure 70:
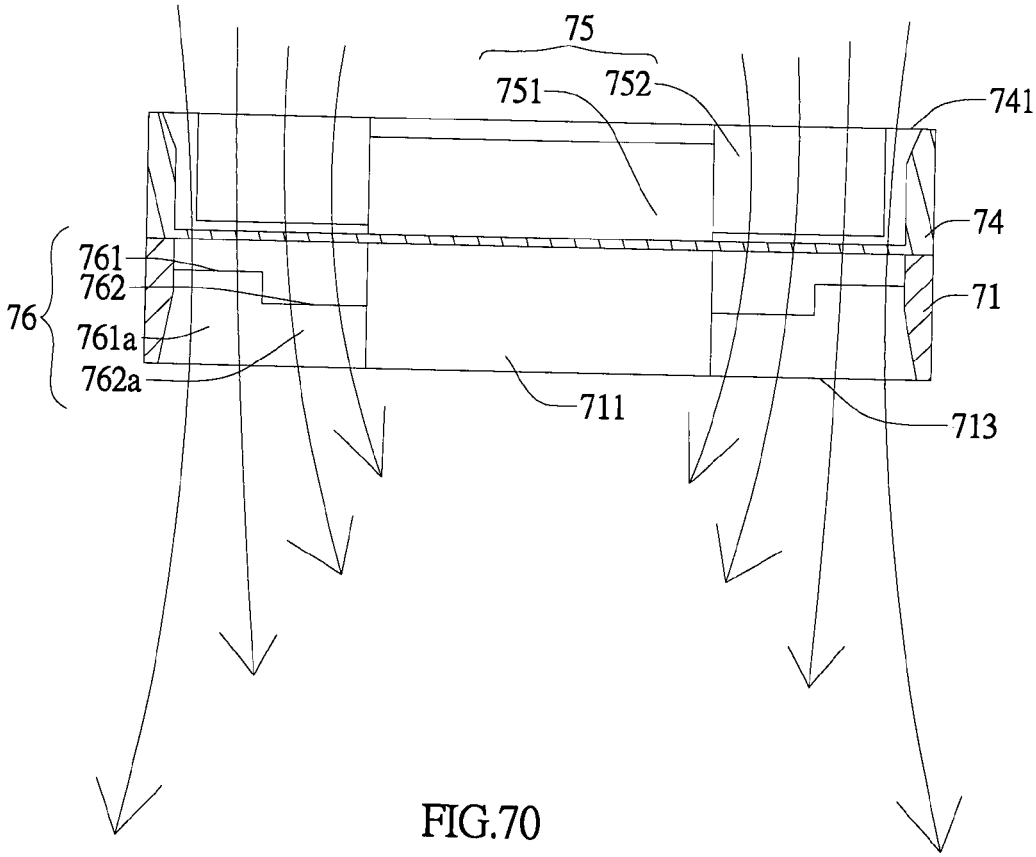
FIG. 70 is a cross sectional view of the outlet airflow direction control device of FIG. 67 showing airflow directions at an outlet of the device.

Please refer to FIGS. 64, 65, and 66. The directional-guide blade 72 for the present invention may be differently configured, such as T-shaped and L-shaped blades 77, 78, as shown in FIGS. 65 and 66, respectively. The T-shaped directional-guide blade 77 includes a directional-guide section 771 having an area 771*a*, and a connecting section 772 having an area 772*a*. The area 771*a* is larger than the area 772*a*. The L-shaped directional-guide blade 78 includes a directional-guide section 781 having an area 781*a*, and a connecting section 782 having an area 782*a*. The area 781*a* is larger than the area 782*a*. All the above two types of directional-guide blades are adapted to change the radial pressure against the fluid passing through the outlet 713 to achieve the effect of controlling the flow direction of the fluid and producing enhanced radiating power.

Please refer to FIGS. 67, 68, 69, and 70 that are rear exploded, front exploded, rear assembled, and cross sectional views, respectively, of an outlet airflow direction control device according to a fourteenth embodiment of the present invention. As shown, the fourteenth embodiment is structurally and functionally similar to the thirteenth embodiment, except that the hub seat 711 at the outlet 713 of the frame 71 of the fourteenth embodiment is formed on a peripheral wall thereof with a plurality of radially projected ribs 76. Each of the ribs 76 includes an outer end forming a directional-guide section 761 having an area 761*a*, and an inner end forming a connecting section 762 having an area 762*a*. The area 761*a* is larger than the area 762*a*, so that the ribs 76 are adapted to change the radial pressure against the fluid flowing through the frame 71 and the fan module 73 and thereby achieve the effect of controlling the flow direction of the fluid.

Alternatively, the frame 71 for the thirteenth and the fourteenth embodiment of the present invention may be otherwise connected to the inlet 741 of the fan module 73 to achieve the same functions of changing the radial pressure against the fluid and controlling the flow direction of the fluid.

Figure 71:
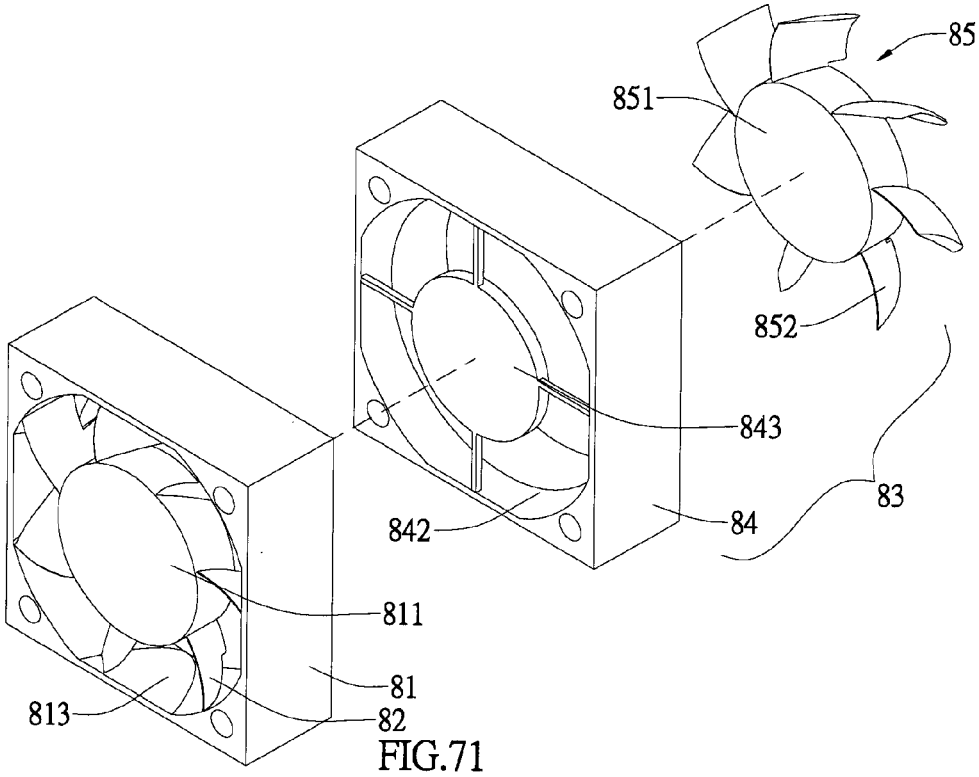
FIG. 71 is a rear exploded perspective view of an outlet airflow direction control device according to a fifteenth embodiment of the present invention.
Figure 72:
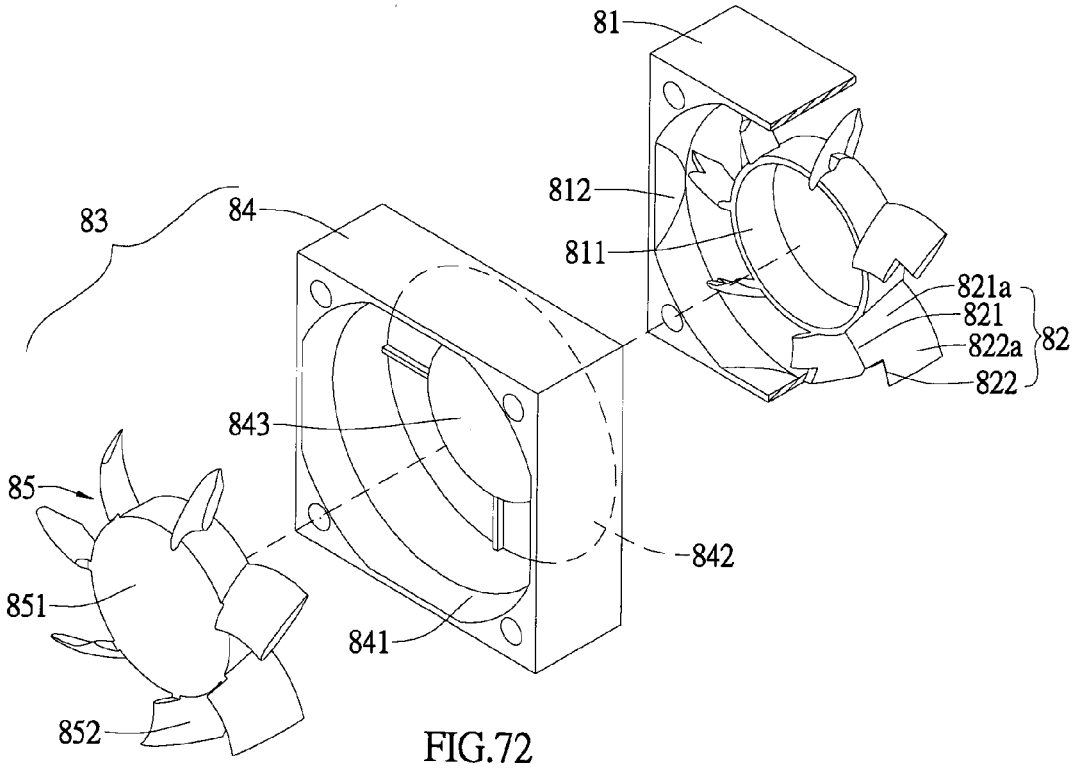
FIG. 72 is a front exploded and partially cutaway perspective view of the outlet airflow direction control device of FIG. 71.
Figure 73:
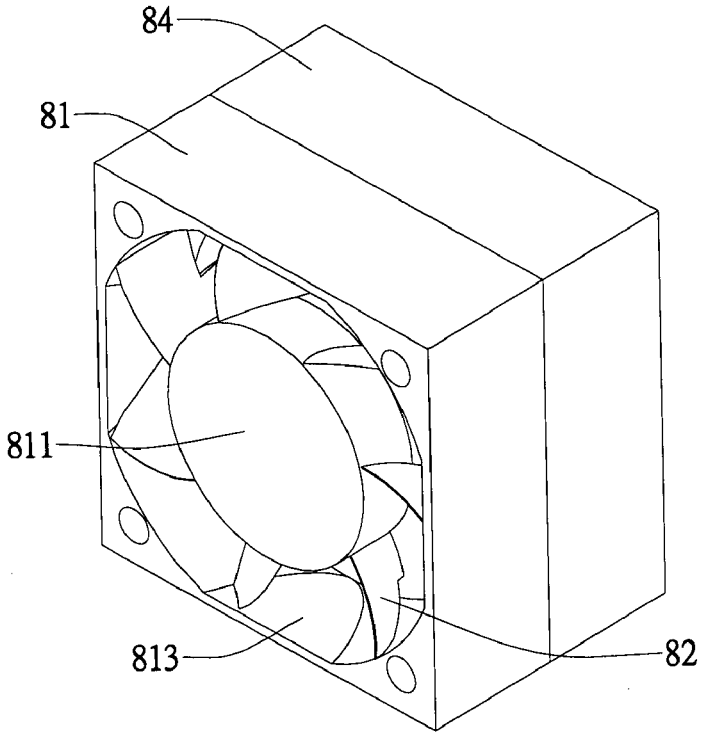
FIG. 73 is a rear assembled perspective view of the outlet airflow direction control device of FIG. 71.

Please refer to FIGS. 71, 72, and 73, in which an outlet airflow direction control device according to a fifteenth embodiment of the present invention is shown. As shown, the fifteenth embodiment includes a frame 81 and a fan module 83. The frame 81 includes an inlet 812 and an outlet 813 via which an amount of fluid flows into and out or the frame 81, respectively. The frame 81 is internally provided with a hub seat 811, on an outer peripheral wall of which a plurality of radially projected directional-guide blades 82 are formed.

The fan module 83 includes a fan frame 84 and a fan 85. The fan frame 84 includes an inlet 841 and an outlet 842, and is internally provided with a support member 843 to which the fan 85 is mounted. The fan 85 consists of a hub 851 and a plurality of blades 852. The hub 851 is supported on the support member 843 to locate the fan 85 in the fan frame 84.

Each of the directional-guide blades 82 is connected at an inner end, which forms a directional-guide section 821 of the directional-guide blade 82, to the hub seat 81, and at an outer end, which forms a connecting section 822 of the directional-guide blade 82, to the frame 81. It is noted the directional-guide section 821 has an area 821*a* larger than an area 822*a* of the connecting section 822. The frame 81 is connected at the inlet 812 to the outlet 842 of the fan module 83. The directional-guide blades 82 are adapted to change a radial pressure against the fluid flowing through the fan module 83 and the frame 81.

Figure 74:
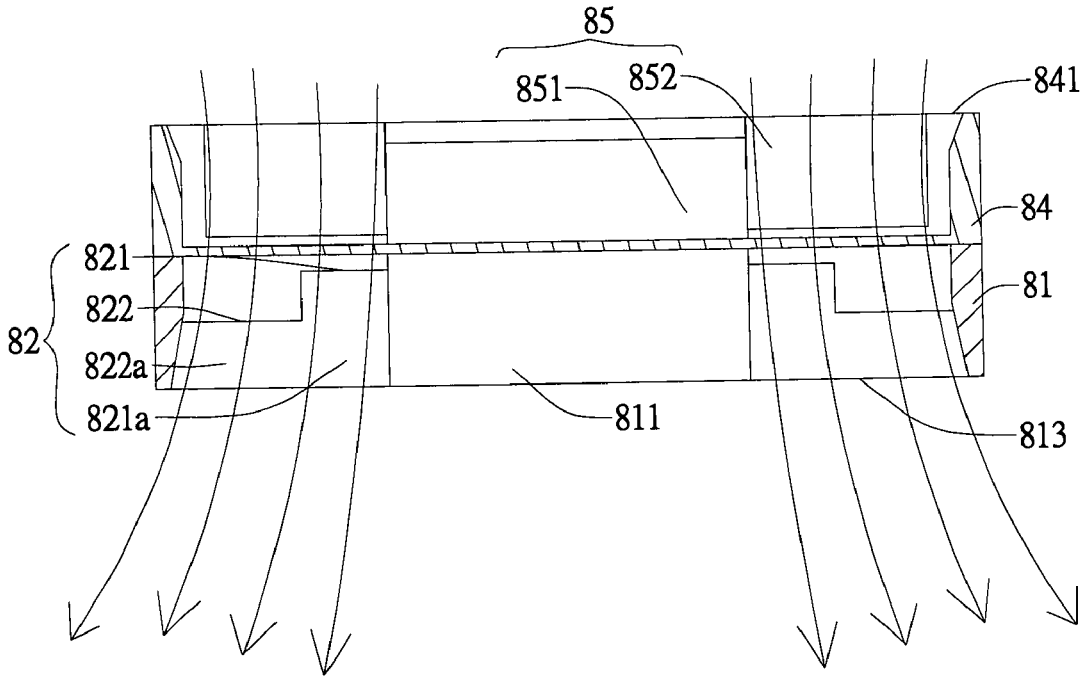
FIG. 74 is a cross sectional view of the outlet airflow direction control device of FIG. 71 showing airflow directions at an outlet of the device.

Please refer to FIGS. 71 and 74. When the blades 852 of the fan 85 are rotated, a non-constant flow field is produced to cause the fluid to flow into the fan frame 84 via the inlet 841 thereof, pass through the outlet 842 of the fan frame 84 and the inlet 812 of the frame 81, and flow out of the frame 81 via the outlet 813 thereof. When the fluid flows through the outlet 813 of the frame 81, it is controlled by the areas 821*a* of the directional-guide sections 821 of the radially projected directional-guide blades 82 on the frame 81 and is subject to a relatively large radial pressure to therefore diffuse outward. It is noted the fluid diffuses outward into an increased space due to the relatively large radial pressure.

Figure 75:
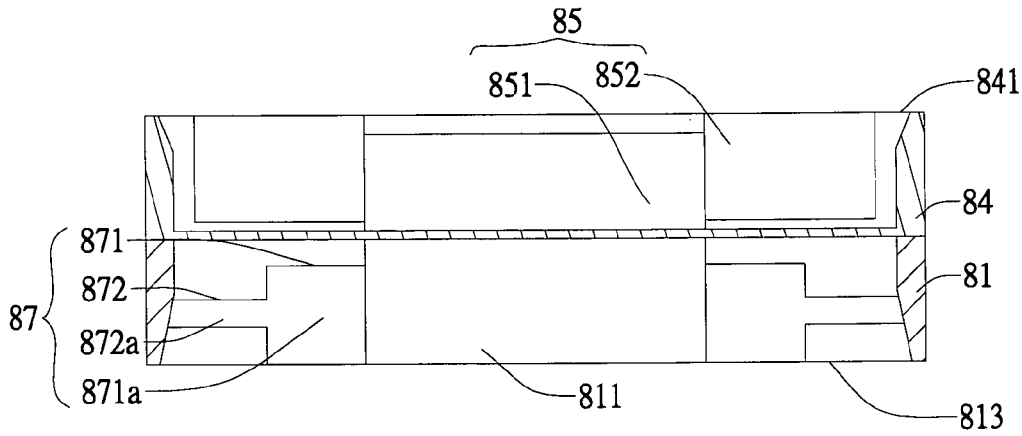
FIG. 75 shows a variant of the directional-guide blade included in the fifteenth embodiment of the present invention.
Figure 76:
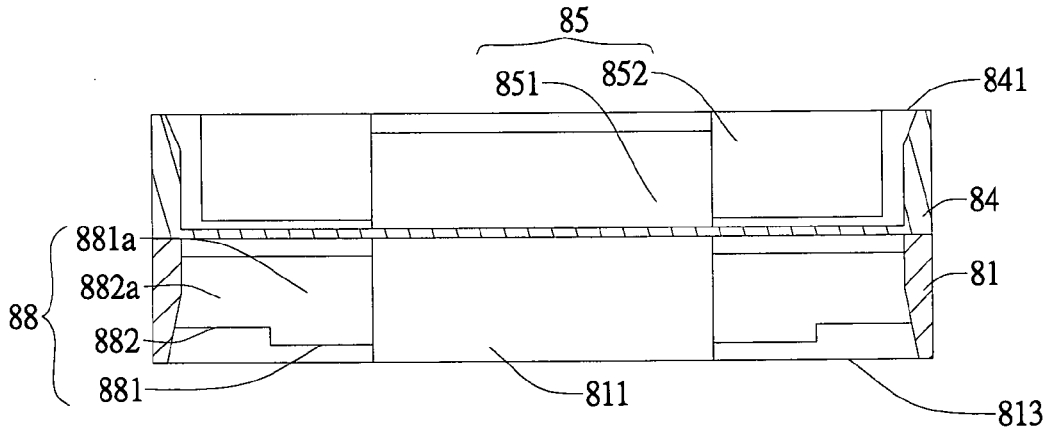
FIG. 76 shows another variant of the directional-guide blade included in the fifteenth embodiment of the present invention.
Figure 77:
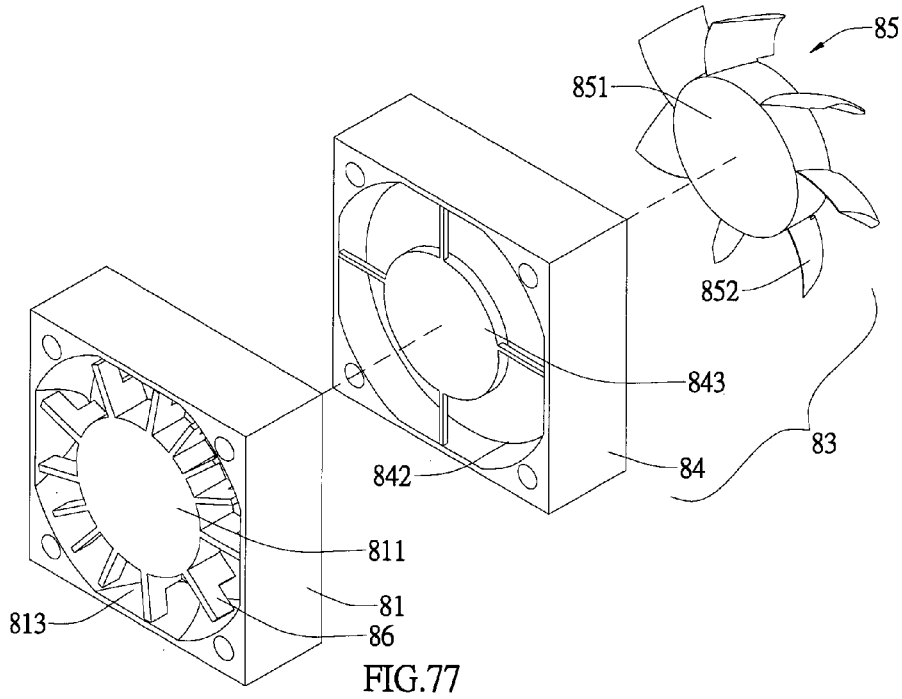
FIG. 77 is a rear exploded perspective view of an outlet airflow direction control device according to a sixteenth embodiment of the present invention.
Figure 78:
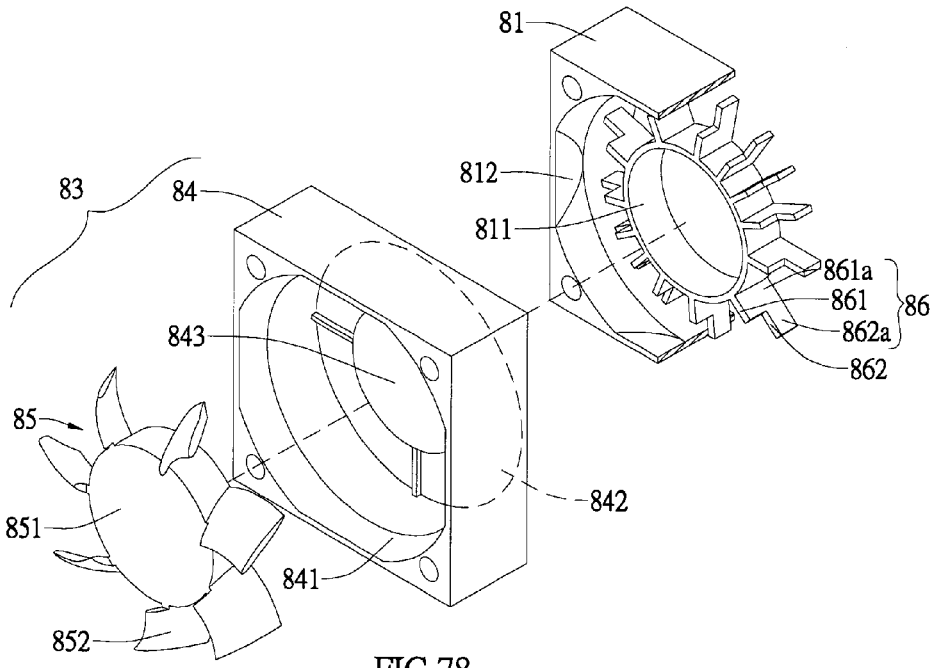
FIG. 78 is a front exploded and partially cutaway perspective view of the outlet airflow direction control device of FIG. 77.
Figure 79:
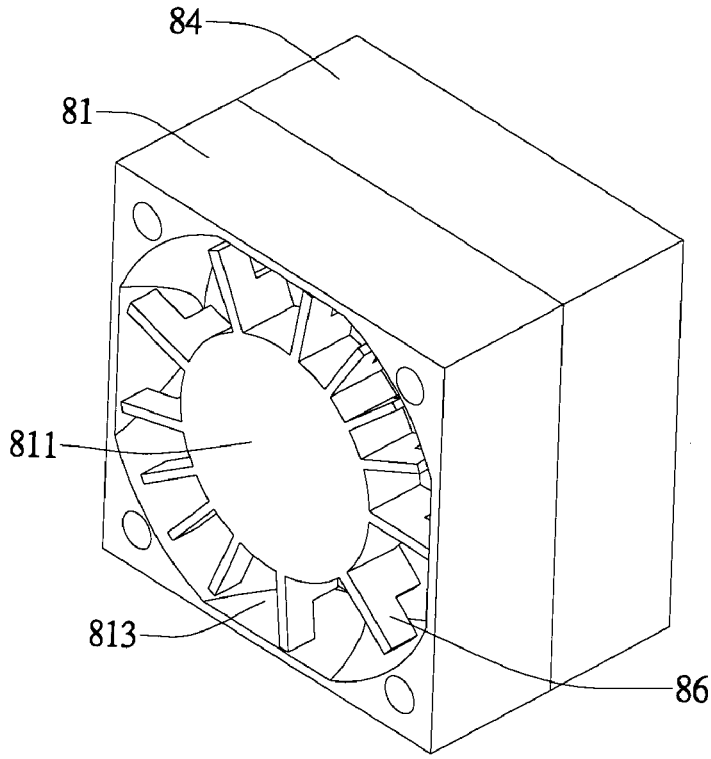
FIG. 79 is a rear assembled perspective view of the outlet airflow direction control device of FIG. 77.
Figure 80:
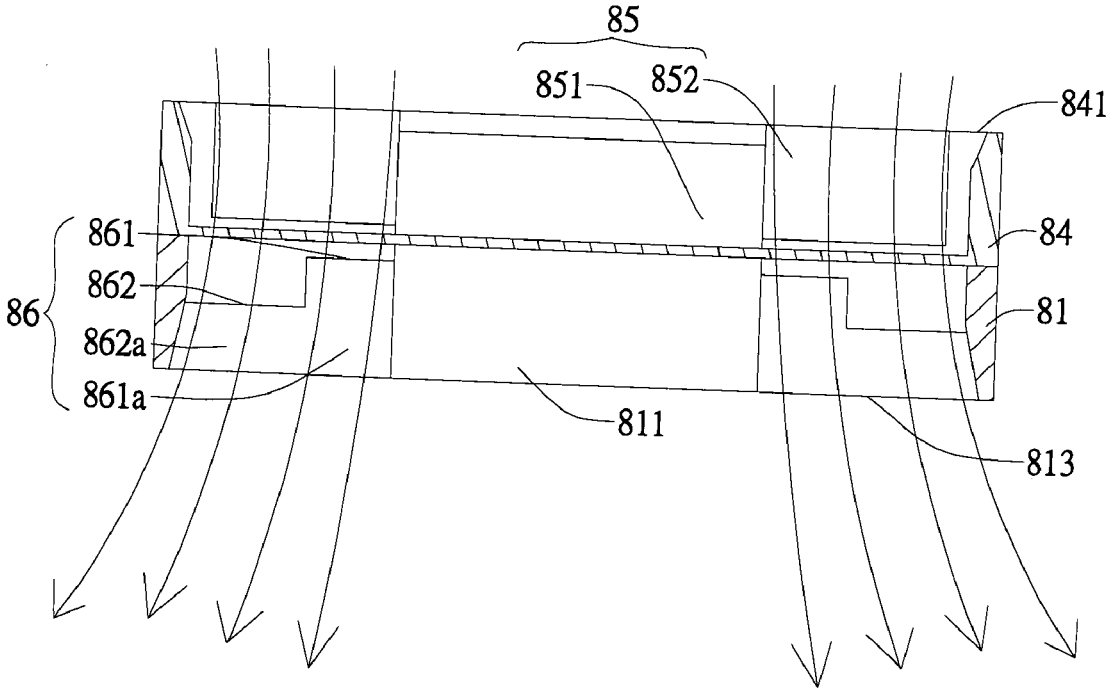
FIG. 80 is a cross sectional view of the outlet airflow direction control device of FIG. 77 showing airflow directions at an outlet of the device.

Please refer to FIGS. 74, 75, and 76. The directional-guide blade 82 for the present invention may be differently configured, such as T-shaped and L-shaped blades 87, 88, as shown in FIGS. 75 and 76, respectively. The T-shaped directional-guide blade 87 includes a directional-guide section 871 having an area 871*a*, and a connecting section 872 having an area 872*a*. The area 871*a* is larger than the area 872*a*. The L-shaped directional-guide blade 88 includes a directional-guide section 881 having an area 881*a*, and a connecting section 882 having an area 882*a*. The area 881*a* is larger than the area 882*a*. All the above two types of directional-guide blades are adapted to change the radial pressure against the fluid passing through the outlet 813 to achieve the effect of controlling the flow direction of the fluid.

Please refer to FIGS. 77, 78, 79, and 80 that are rear exploded, front exploded, rear assembled, and cross sectional views, respectively, of an outlet airflow direction control device according to a sixteenth embodiment of the present invention. As shown, the sixteenth embodiment is structurally and functionally similar to the fifteenth embodiment, except that the hub seat 811 at the outlet 813 of the frame 81 of the sixteenth embodiment is formed on, a peripheral wall thereof with a plurality of radially projected ribs 86. Each of the ribs 86 includes an inner end forming a directional-guide section 861 having an area 861*a*, and an outer end forming a connecting section 862 having an area 862*a*. The area 861*a* is larger than the area 862*a*, so that the ribs 86 are adapted to change the radial pressure against the fluid flowing through the frame 81 and the fan module 83 and thereby achieve the effect of controlling the flow direction of the fluid.

Alternatively, the frame 81 for the fifteenth and the sixteenth embodiment of the present invention may be otherwise connected to the inlet 841 of the fan module 83 to achieve the same functions of changing the radial pressure against the fluid and controlling the flow direction of the fluid.

Figure 81:
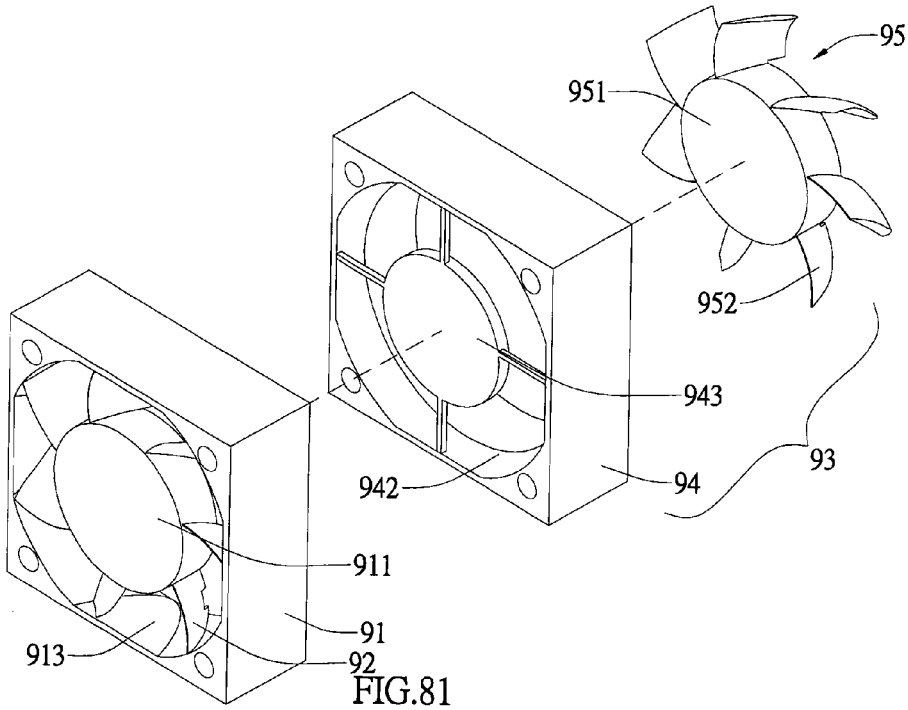
FIG. 81 is a rear exploded perspective view of an outlet airflow direction control device according to a seventeenth embodiment of the present invention.
Figure 82:
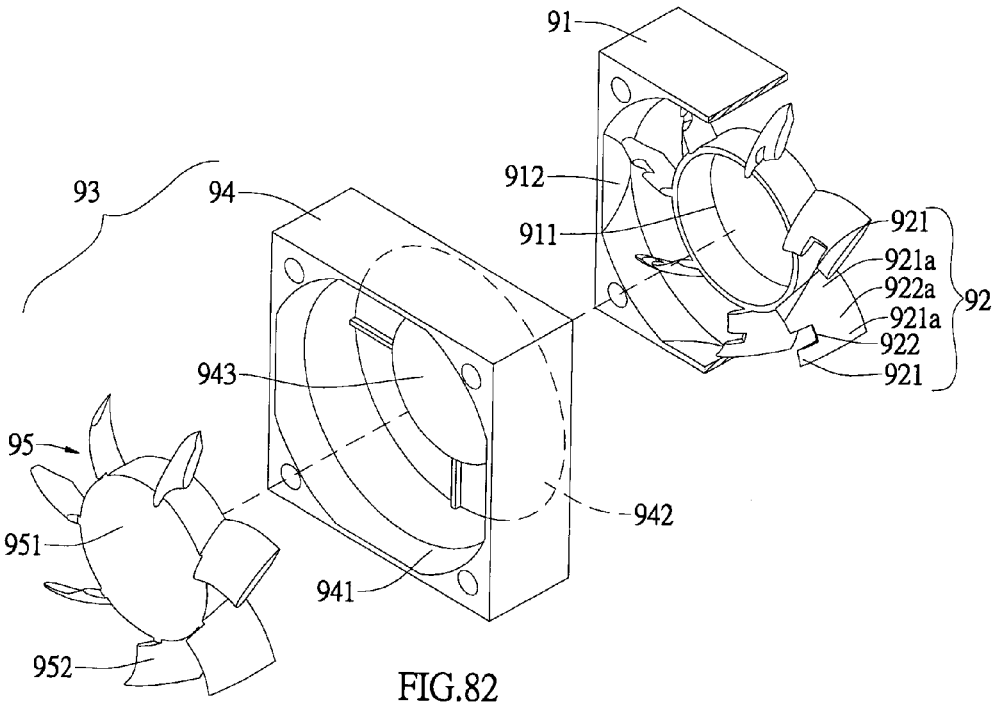
FIG. 82 is a front exploded and partially cutaway perspective view of the outlet airflow direction control device of FIG. 81.
Figure 83:
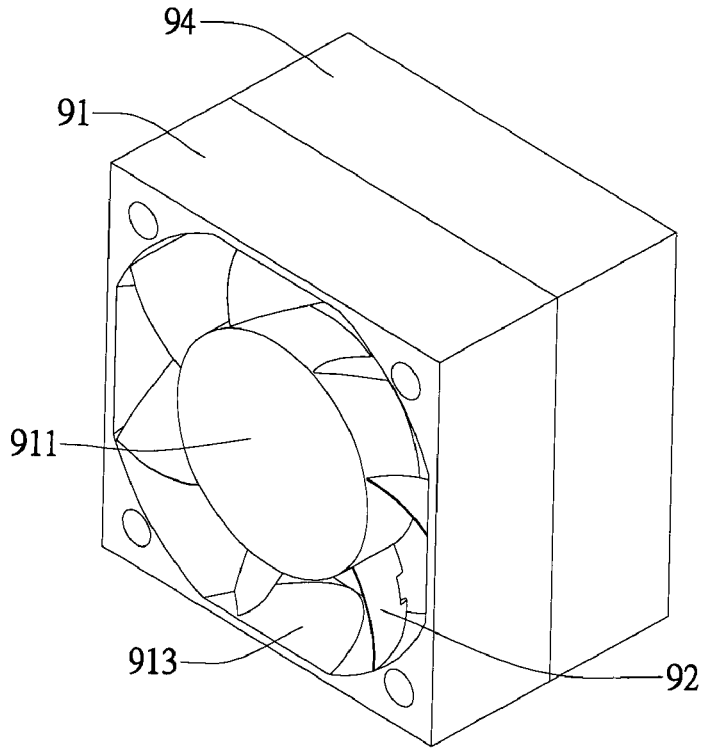
FIG. 83 is a rear assembled perspective view of the outlet airflow direction control device of FIG. 81.

Please refer to FIGS. 81, 82, and 83, in which an outlet airflow direction control device according to a seventeenth embodiment of the present invention is shown. As shown, the seventeenth embodiment includes a frame 91 and a fan module 93. The frame 91 includes an inlet 912 and an outlet 913 via which an amount of fluid flows into and out or the frame 91, respectively. The frame 91 is internally provided with a hub seat 911, on an outer peripheral wall of which a plurality of radially projected directional-guide blades 92 are formed.

The fan module 93 includes a fan frame 94 and a fan 95. The fan frame 94 includes an inlet 941 and an outlet 942, and is internally provided with a support member 943 to which the fan 95 is mounted. The fan 95 consists of a hub 951 and a plurality of blades 952. The hub 951 is supported on the support member 943 to locate the fan 95 in the fan frame 94.

Each of the directional-guide blades 92 is connected at outer and inner end, which form two directional-guide sections 921 of the directional-guide blade 92, to the frame 91 and the hub seat 911, respectively. A middle portion of the directional-guide blade 92 is a connecting section 922 that connects the two directional-guide sections 921 to each other. It is noted the directional-guide section 921 has an area 921*a* larger than an area 922*a* of the connecting section 922. The frame 91 is connected at the inlet 912 thereof to the outlet 942 of the fan module 93. The directional-guide blades 92 are adapted to change a radial pressure against the fluid flowing through the fan module 93 and the frame 91.

Figure 84:
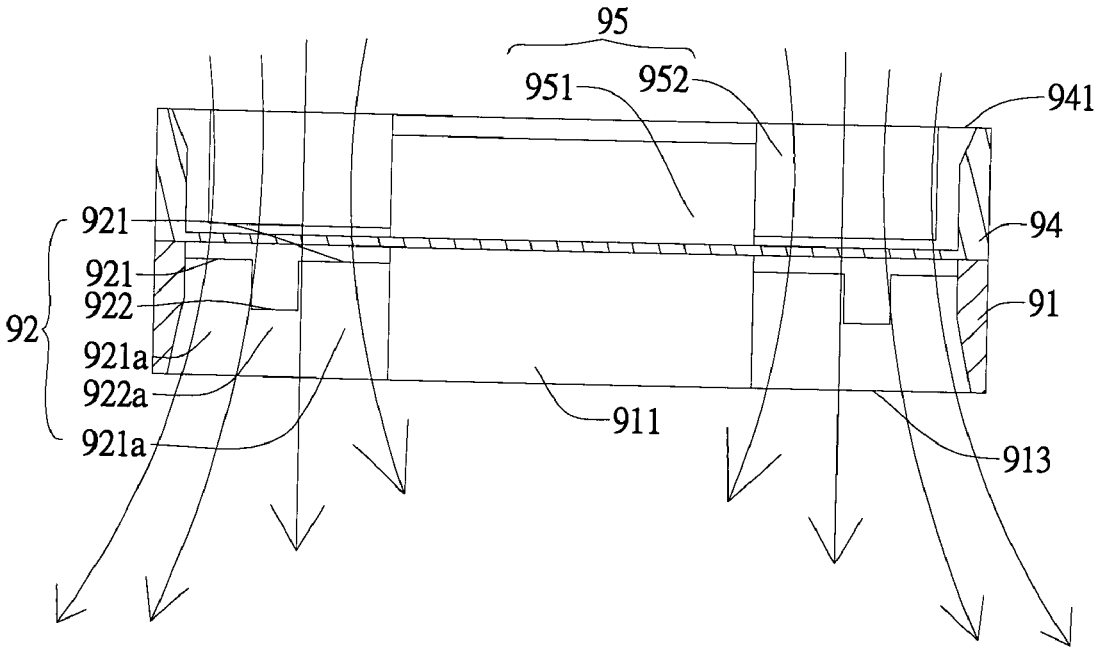
FIG. 84 is a cross sectional view of the outlet airflow direction control device of FIG. 81 showing airflow directions at an outlet of the device.

Please refer to FIGS. 81 and 84. When the blades 952 of the fan 95 are rotated, a non-constant flow field is produced to cause the fluid to flow into the fan module 93 via the inlet 941 thereof, pass through the outlet 942 of the fan module 93 and the inlet 912 of the frame 91, and flow out of the frame 91 via the outlet 913 thereof. When the fluid flows through the outlet 913 of the frame 91, it is controlled by the areas 921*a* of the directional-guide sections 921 of the radially projected directional-guide blades 92 on the frame 91 and is subject to a relatively large radial pressure to therefore flow toward a center behind the hub seat 911 and also diffuse outward. That is, there is an increased amount of the fluid flown to a rear side of the hub seat 911 to reduce a dead-air zone behind the hub seat 911. Therefore, the outlet airflow direction control device of the present invention may be used to carry heat produced in a system to external environments at a largely upgraded radiation efficiency to provide an enhanced radiation effect.

Figure 85:
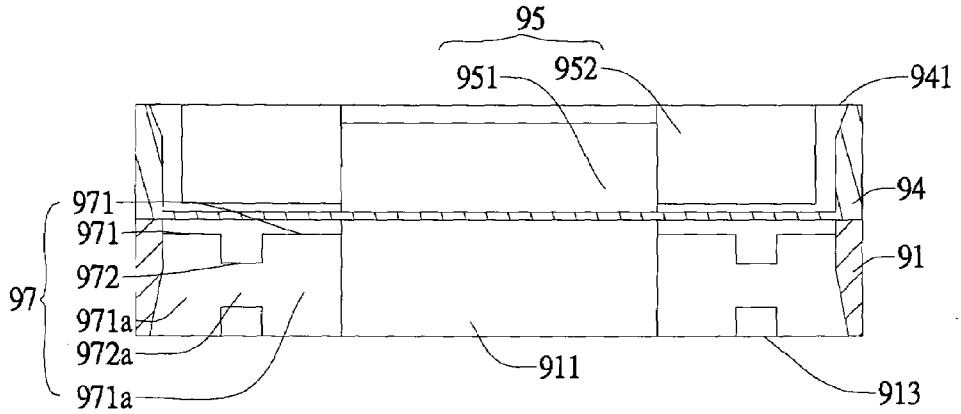
FIG. 85 shows a variant of the directional-guide blade included in the seventeenth embodiment of the present invention.
Figure 86:
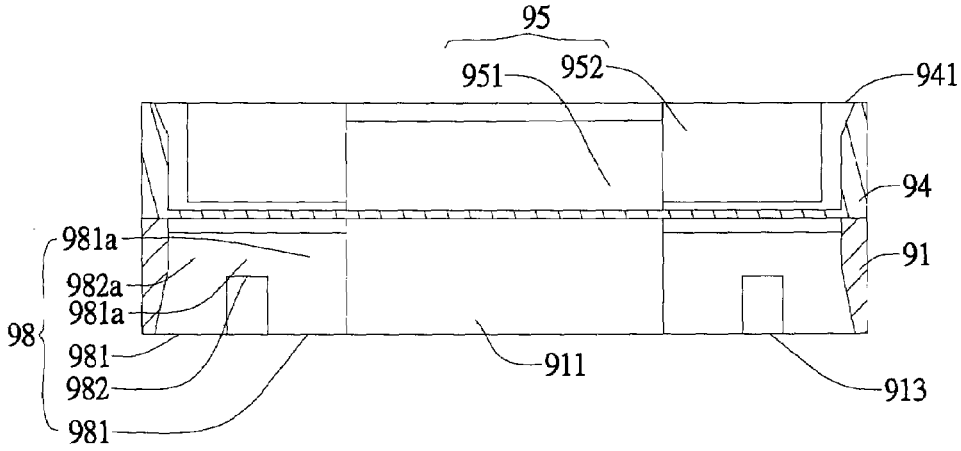
FIG. 86 shows another variant of the directional-guide blade included in the seventeenth embodiment of the present invention.
Figure 87:
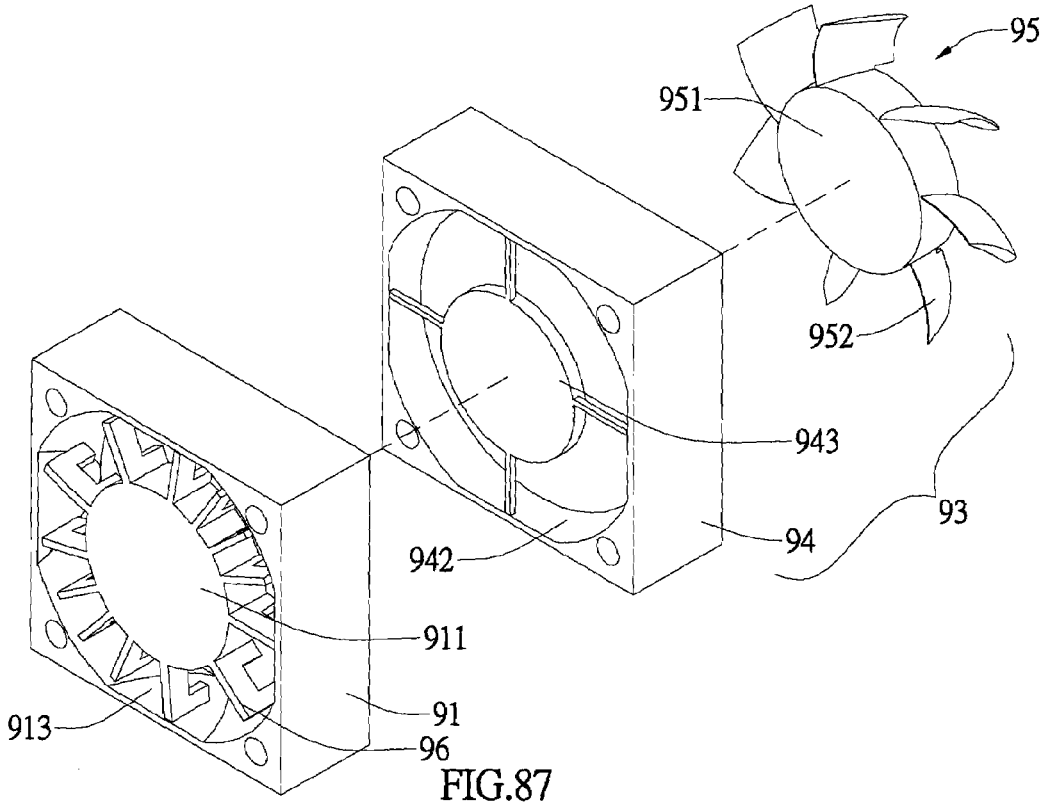
FIG. 87 is a rear exploded perspective view of an outlet airflow direction control device according to an eighteenth embodiment of the present invention.
Figure 88:
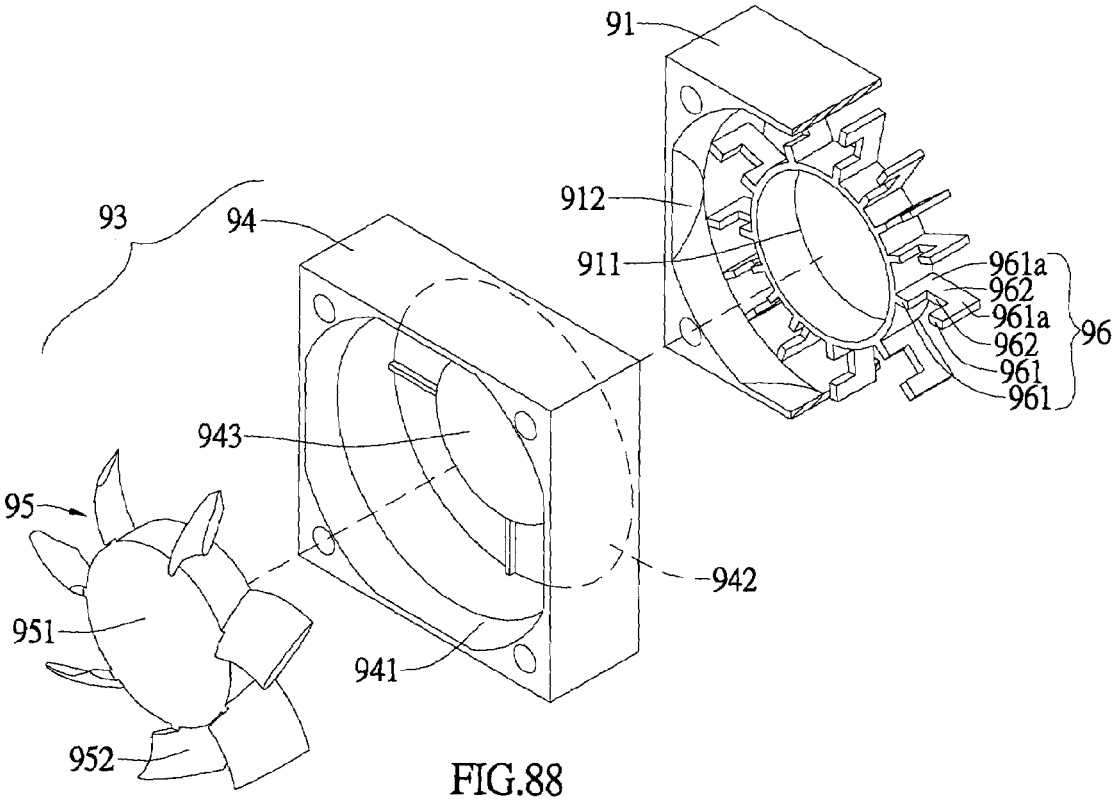
FIG. 88 is a front exploded and partially cutaway perspective view of the outlet airflow direction control device of FIG. 87.
Figure 89:
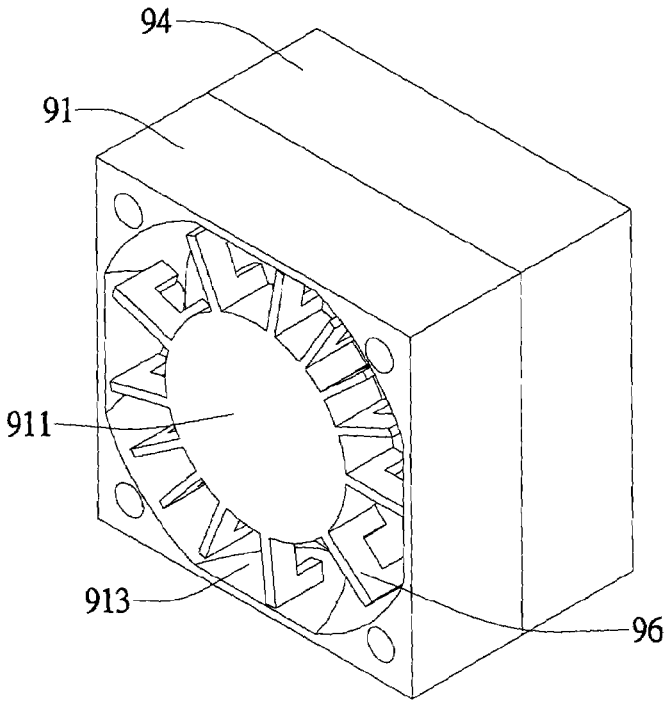
FIG. 89 is a rear assembled perspective view of the outlet airflow direction control device of FIG. 87.
Figure 90:
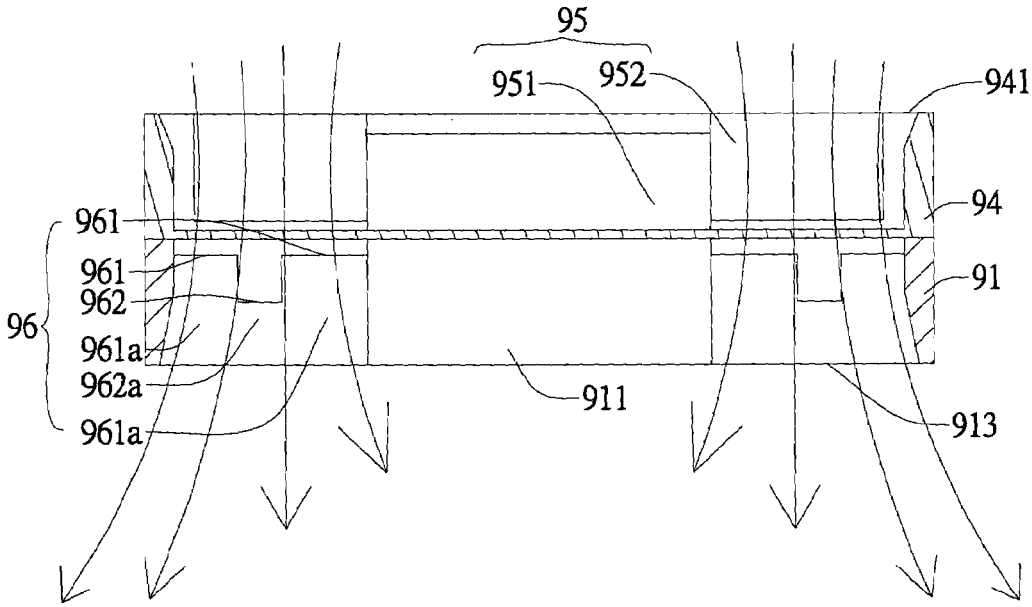
FIG. 90 is a cross sectional view of the outlet airflow direction control device of FIG. 87 showing airflow directions at an outlet of the device.

Please refer to FIGS. 84, 85, and 86. The directional-guide blade 92 for the present invention may be differently configured, such as H-shaped and U-shaped blades 97, 98, as shown in FIGS. 85 and 86, respectively. The H-shaped directional-guide blade 97 includes two directional-guide sections 971 each having an area 971*a*, and a connecting section 972 having an area 972*a*. The area 971*a* is larger than the area 972*a*. The U-shaped directional-guide blade 98 includes two directional-guide sections 981 each having an area 981*a*, and a connecting section 982 having an area 982*a*. The area 981*a* is larger than the area 982*a*. All the above two types of directional-guide blades are adapted to change the radial pressure against the fluid passing through the outlet 913 to achieve the effect of controlling the flow direction of the fluid and producing enhanced radiating power.

Please refer to FIGS. 87, 88, 89, and 90 that are rear exploded, front exploded, rear assembled, and cross sectional views, respectively, of an outlet airflow direction control device according to an eighteenth embodiment of the present invention. As shown, the eighteenth embodiment is structurally and functionally similar to the seventeenth embodiment, except that the hub seat 911 at the outlet 913 of the frame 91 of the eighteenth embodiment is formed on a peripheral wall thereof with a plurality of radially projected ribs 96. Each of the ribs 96 includes an outer and an inner end forming two directional-guide sections 961 each having an area 961*a*, and a middle portion forming a connecting section 962 having an area 962*a* to connect the two directional-guide sections 961 to each other. The area 961*a* is larger than the area 962*a*, so that the ribs 96 are adapted to change the radial pressure against the fluid flowing through the frame 91 and the fan module 93 and thereby achieve the effect of controlling the flow direction of the fluid.

Alternatively, the frame 91 for the seventeenth and the eighteenth embodiment of the present invention may be otherwise connected to the inlet 941 of the fan module 93 to achieve the same functions of changing the radial pressure against the fluid and controlling the flow direction of the fluid.

The present invention has been described with some preferred embodiments thereof and it is understood that many changes and modifications in the described embodiments can be carried out without departing from the scope and the spirit of the invention as defined by the appended claims.

What is claimed is:

1. An outlet airflow direction control device, comprising a fan and a frame;

said frame having an inlet and an outlet, and being internally provided at said outlet with a hub seat; and a plurality of fluid control elements being provided between said frame and said hub seat to connect said hub seat to said frame; and said fan being supported on said hub seat of said frame;

said fluid control elements being radially arranged at said outlet of said frame, and each of said fluid control elements being connected at an outer end, which forms a directional-guide section, to said frame, and at an inner end, which forms a connecting section, to said hub seat, and said directional-guide section having a uniform first axial length and said connecting section having a uniform second axial length, wherein the first axial length is greater than the second axial length;

whereby when said fan is rotated to cause an amount of fluid to flow into and out of said frame via said inlet and said outlet, respectively, said fluid control elements are adapted to control a flow direction of said fluid flown out of said outlet of said frame.

2. The outlet airflow direction control device as claimed in claim 1, wherein said fluid control elements are directional-guide blades.

3. The outlet airflow direction control device as claimed in claim 1, wherein said fluid control elements are ribs.

* * * * *